US007217186B2

(12) United States Patent
Basset et al.

(10) Patent No.: US 7,217,186 B2
(45) Date of Patent: May 15, 2007

(54) MOBILE AERAULIC ISOLATION DEVICE AGAINST AIRBORNE CONTAMINATION WITH VARIABLE GEOMETRY AIR DIFFUSER

(75) Inventors: Frédéric Basset, Grande-Bretagne (GB); Jean-Marie Billiotte, Grande-Bretagne (GB); Alexandre Vladimirovitch Nagolkin, Moscou (RU); Elena Vladimirovna Volodina, Moscou (RU)

(73) Assignee: Airinspace Limited, Hamilton (BM)

( * ) Notice: Subject to any disclaimer, the term of this patent is extended or adjusted under 35 U.S.C. 154(b) by 204 days.

(21) Appl. No.: 10/498,991

(22) PCT Filed: Oct. 9, 2002

(86) PCT No.: PCT/FR02/03436

§ 371 (c)(1),
(2), (4) Date: Jan. 18, 2005

(87) PCT Pub. No.: WO03/056253

PCT Pub. Date: Jul. 10, 2003

(65) Prior Publication Data

US 2005/0136827 A1 Jun. 23, 2005

(30) Foreign Application Priority Data

Dec. 21, 2001 (FR) ..... 01 16851

(51) Int. Cl.
*B01L 1/04* (2006.01)

(52) U.S. Cl. ..... 454/187; 55/385.2

(58) Field of Classification Search ..... 454/187, 454/189; 55/356, 385.2
See application file for complete search history.

(56) References Cited

U.S. PATENT DOCUMENTS 3,935,803 A * 2/1976 Bush ..... 454/189
4,045,192 A * 8/1977 Eckstein et al. ..... 96/224
4,163,650 A * 8/1979 Watson et al. ..... 96/57
6,099,607 A * 8/2000 Haslebacher ..... 55/356
6,162,118 A 12/2000 Arts et al.
2004/0147214 A1* 7/2004 Oono ..... 454/187

FOREIGN PATENT DOCUMENTS

| | | |
|---|---|---|
| DE | 23 43 015 A | 2/1975 |
| DE | 94 00 998 U | 3/1994 |
| GB | 1 295 551 A | 11/1972 |
| WO | WO 85 04240 A | 9/1985 |

* cited by examiner

*Primary Examiner*—Gregory Wilson
(74) *Attorney, Agent, or Firm*—Beyer Weaver LLP

(57) ABSTRACT

Mobile aeraulic isolation device (1*a*) with variable geometry multi-block air diffusion chamber (4), comprising at least two mobile plenums (5,6) to protect a sensitive area such as a bed (2) against contaminating airborne aerosols. It comprises an air diffusion chamber (4) formed of at least two rigid plenums (5,6) mechanically connected together so as to be mobile relative to one another, and having a lower air diffusing surface (7,8) substantially planar and porous to air. Relative movement means (10) for mobile plenums (5,6) enable their positioning in relation to one another in at least two distinct relative positions. The device (1*a*) comprises physical decontamination means (20,21,22,23) for moving air passing through it, air pressurising means (25), aeraulic connection (30) and air circulation means, and a mobile supporting chassis (12). The device 1*a*) is characteristic in that it comprises complementary means for absolute movement (13) of the group of two rigid plenums (5,6) relative to chassis (12). So that its two plenums (5,6) are both mobile, both relative to one another and relative to chassis (12). Device 1*a*) forms a mobile protective isolation device for immunosuppressed persons.

41 Claims, 37 Drawing Sheets

MOBILE AERAULIC ISOLATION DEVICE AGAINST AIRBORNE CONTAMINATION WITH VARIABLE GEOMETRY AIR DIFFUSER

TECHNICAL FIELD

The invention comes within the technological sphere of ventilation devices fitted with an airflow diffuser to protect a sensitive zone against the entry of outside contamination. It concerns devices for decontaminating a gaseous fluid, of aerological isolating type, that is to say intended to deliver a flow of decontaminated air or to extract a flow of contaminated air, within a spatial part of a room. The invention specifically relates to the technological area of aerological isolating devices:

- comprising a mobile supporting chassis enabling global movement of the device (in moving position) relative to a bearer surface, the floor in particular, and an air diffuser (or air diffusion chamber),
- having a multi-block air diffusion chamber of variable geometry, that is to say containing at least two rigid air-diffusing plenums (diffusing parts), mechanically connected to one another so that they are mobile relative to each other,
- and fitted with complementary means for relative movement (in fixed in-use position) of at least one plenum of the air diffusion chamber relative to the other plenum and/or chassis.

The ambient air of premises is permanently contaminated by microorganisms derived from persons or the environment (bacteria, viruses, yeasts, moulds, . . . ). The human body is therefore surrounded by a considerable number of microorganisms. The germs in the air have twofold origin: environmental and human.

Aerological biocontaminating vectors of human origin contain rhino-pharyngeal droplets, called Pflügge droplets (emitted when speaking, coughing or sneezing) of a diameter generally lying between 5 and 100 microns. As and when they settle, these droplets lose their water content, reducing their diameter down to as far as 0.5 microns forming droplet nuclei. These are all the more dangerous as they are concentrated in germs, they remain in suspension in air for a long time and may enter the respiratory tracts. In a hospital environment, airborne flora of human origin also contains bacteria from cutaneous and possibly digestive commensal flora of the surgical team, medical team and patients.

Environmental aerological biocontaminating vectors especially contain particles of dust or fabric coated with microorganisms. Airborne flora of outside air is mostly made up of *bacilli, micrococci, staphylococci*. Gram negative *bacilli* and anaerobic bacteria are also found. Yeasts and fungi also belong to this environmental flora (e.g. *aspergillus fumigatus* . . . ). Finally, contaminated liquid particles are found in air caused by disturbance of contaminated water media (*Legionellosis* . . . ).

In the air, the lifetime of bacteria is sufficiently long for them to be considered as potential infection agents. Being a vector of intra-hospital contamination, air disperses particles carrying microorganisms over greater or lesser distances and insidiously promotes gradual contamination of the hospital environment. Several factors contribute towards the development of microorganisms in hospitals—firstly modern air treatment technologies (air conditioning) which, despite their beneficial effects, also set up dangerous germ reservoirs in piping, and secondly the increasing use of antibiotics, antiseptics and disinfectants which has led to the selection of increasingly resistant germs. At the same time, medical techniques have been developed in hospitals that are more and more advanced but also more aggressive for patients, while these patients have become more immunocompromised and therefore with high risk of infection. This accounts for the increasing occurrence of nosocomial infections caused by germs in the hospital environment (which usually have little intrinsic virulence) affecting patients with reduced resistance.

At the international conference on nosocomial infections in 1970, Brachman estimated that 10 to 20% of endemic nosocomial infections are airborne.

Some of these microroganisms colonise patients' respiratory tracts and may, in weaker patients, be the cause of respiratory nosocomial infection.

In addition, to protect patients with low resistance to infection, the use of invasive procedures (that is to say investigation procedures or treatment which enters the skin, mucosa or a natural cavity of the body) can only be considered in a controlled microbial aerological environment.

The prevention of nosocomial diseases in hospitals requires breaking the chain of transmission of infectious agents, in particular the chain of airborne contamination.

To achieve this, a distinction is made between protective septic isolation intended to prevent a patient carrying a bacterial or viral infection, or who is colonised by a germ, from diffusing this infection. This is the case in particular for patients suffering or suspected to be suffering from contagious respiratory infections such as tuberculosis. On the other hand, a patient at risk is likely to be infected by the environment, by other patients, or by visits. Such patients must be given aseptic protective isolation. This type of case is normally found in burns units, haematology, oncology or transplantation departments. This particularly concerns patients who are immunocompromised through illness, neutropaenia treatment or suffering from medullary aplasia. The purpose of aseptic protective isolation is to avoid contact between a person and a pathogenic agent. These microorganisms may always be pathogenic (*tuberculosis bacillus* . . . ) or potentially pathogenic when they contaminate persons with reduced immune response (*pyocyanic bacillus, aspergillus*, . . . ). It sets out to protect immunocompromised patients against all contamination of environmental or human origin (environment, staff, other patients, visitors . . . ).

Traditionally, the decontamination of airborne microorganisms around a sensitive area by means of ventilation is made:

- either globally inside the entire room, so-called "clean room" or "isolation room",
- or within a reduced delimited area, so-called "isolation area" inside a larger room.

A distinction is made between two types of clean or isolation rooms in the hospital sector:

- septic (infectious) isolation rooms which are generally maintained under negative pressure relative to adjacent premises, to prevent the exfiltration of infectious microorganisms derived from a patient in the room,
- protective isolation rooms or aseptic isolation rooms which are generally maintained under positive pressure relative to adjacent premises, to avoid the infiltration of infectious organisms and to protect a susceptible patient in the room.

The invention concerns isolators both under positive pressure for aseptic isolation and under negative pressure for septic isolation.

Isolators or "bubbles" placed inside a room are generally made up of an envelope which surrounds:

either an infectious patient, for septic isolators or a susceptible patient, for aseptic isolators (or soft wall clean room).

The conventional decontamination method consists of causing a very large quantity of air to enter the isolation room, or the effective volume of the isolator. The effect of adding of this quantity of air is:

either to dilute the contaminated air before it is expelled towards the outside, in turbulent or "non-unidirectional" systems, or to ensure a "piston effect" repelling the contamination towards the outside, in laminar flow or "unidirectional" systems.

The air is filtered upstream from the flow in aseptic rooms or isolators, and downstream from the flow in septic rooms or isolators.

DESCRIPTION OF PRIOR ART

It is frequent practice for local air treatment to use an isolating device comprising a diffuser with variable geometry.

In the remainder of the description, the following equivalent terms will be used indifferently: diffuser or air diffusion chamber. Also the following will be used indifferently: air diffusing portion or air diffusion plenum.

In the great majority of devices of the prior art, the air diffuser is in a single block (that is to say it comprises only one air diffusion portion) and can be adjusted.

A first category of mobile aeraulic isolation devices comprises single block diffuser devices connected to their base (which includes an air purifying system) via a flexible duct to enable air to pass.

U.S. Pat. No. 4,163,650 Watson et al. describes a floor mobile device comprising a mobile cabinet on wheels equipped with decontamination means (formed of an ioniser and an electrofilter) and a fan. A hose is connected to the cabinet and leads to a conical-shaped diffuser.

U.S. Pat. No. 4,512,245 Goldman describes a device for local extraction of fumes comprising an air treatment unit connected by a flexible air suction tube to an exhaust outlet.

U.S. Pat. No. 5,129,928 Chan et al. describes a portable device for locally reducing the concentration of allergens in air. The system comprises a base fitted with a fan, pre-filters, and a flexible air duct leading to a conical diffusing head fitted with a filter.

U.S. Pat. No. 5,281,246 Ray et al. describes an air purifier intended to aspirate and filter fumes. It is formed of a cabinet on wheel, fitted with filters and fans. A conical deflector is connected to an articulated duct conveying the aspirated air towards the treatment cabinet.

U.S. Pat. No. 5,290,331 Miles et al. describes a cylindrical head for diffusing decontaminated air placed in a localised area, connected by a flexible air tube to an air ventilation and decontamination system.

The isolators in this first category, having a single block diffuser connected to an articulated or flexible duct, can only be used for treating air over small areas, owing to the mechanical impossibility of the duct to carry a large diffuser.

Patent DE 3639708 Kreyenberg Karl Heinz describes a variant of isolator in this first category, formed of a single block diffuser of semi-torus shape provided with air diffusion holes and connected via a flexible pipe to a box unit containing decontamination and air pressurizing means, placed on a floor mobile base frame. The diffusing torus is arched over the patient to create a protective air curtain of semi-cylindrical shape.

A second category of mobile aeraulic isolation device comprises single block air diffusing devices articulated on a mobile base frame.

U.S. Pat. No. 3,724,172 Wood describes an aseptic isolator with a diffuser joined to a mobile base frame and positioned at the head or side edge of the bed setting up a flow of air parallel to the mattress. In its versions adaptable to the head of the bed, the diffuser is fixed at the top of the mattress and can pivot with the latter. This device does not give satisfactory use since the diffuser is too close to the sensitive zone (patient's head and body) and the horizontal position of the air flow brings interference with the pillow and patient's body setting up turbulence.

U.S. Pat. No. 3,385,036 Webb describes an isolator with a conical diffuser fitted on the inside with a filter, placed at the end of a positioning arm mounted on a mobile frame, and connected to a fan integral with the frame via a flexible pipe. The diffuser is in a single block and can be inclined.

U.S. Pat. No. 3,820,536 Anspach, Jr et al. and U.S. Pat. No. 4,045,192 Eckstein et al and patent DE 20018765U Laflow Reinraumtechnik each describe an isolator formed of an articulated box unit mounted on a floor mobile frame, comprising decontamination and air pressurizing means and leading to an angle-adjustable single block diffuser.

U.S. Pat. Nos. 4,272,99 and 6,099,607 Haslebacher describe an isolator formed of a box unit containing decontamination and air pressurizing means placed on a floor mobile frame and connected to a single block air diffuser via a flexible articulated pipe. So that the single block diffuser is angle-adjustable.

U.S. Pat. No. 5,312,465 Riutta describes an isolator formed of a box unit comprising decontamination and air pressuring means, placed on a floor mobile frame and connected to a plenum made up of an inflatable bag fitted with a diffuser at its end. The diffuser is single block and angle-adjustable.

U.S. Pat. No. 5,487,766 Merlin R. Vannier describes an isolator formed of a floor mobile frame surmounted by a box unit fitted with a horizontal extraction hood, including decontamination and air pressurizing means, and surmounted by a horizontal single block diffuser with vertical lower diffusion. The diffuser is connected to the box by a height-adjustable air pipe so that the vertical position of the diffuser can be adjusted.

The isolators in this second category, with a single block diffuser articulated on a mobile chassis, are unable to provide both a sufficiently large diffusion surface for the horizontal coverage of a large-size sensitive area (greater than the size of a hospital bed for example, i.e. approximately 2.2 m×1 m) and possible passage through a doorway (approximately 0.8 m wide) smaller in size than the sensitive area.

A third category of mobile isolators comprises devices formed of a tent with an inner monolithic diffuser. A device of this type with a fixed bar frame is described in patent GB 1066145 Bunyan John. Another device of this type with a fixed frame in inflatable tubes is described in U.S. Pat. No. 5,832,929 Yamaha Isao et al.

The tent isolators in this third category with a monolithic diffuser have the drawback firstly of being distressing for persons inside, patients in particular; and secondly of having difficult access for care givers if these tents are used for patient isolation; and finally they require time-consuming installation procedure.

A fourth category of mobile aeraulic isolation device comprises variable geometry air diffusion devices of multi-block type; that is to say comprising several (at least two) plenums (air diffusion portions). This is the prior art that is closest to the invention. A device of this type is described in U.S. Pat. No. 3,935,803 Louis Bush. It is a mobile aeraulic isolation device for a sensitive zone (a bed) against contaminating airborne aerosols, also comprising a twin-block diffuser (or air diffusion chamber—that is to say with two connected plenum portions) giving this air diffuser variable geometry (that is to say mobility of one plenum portion relative to the other).

This isolation device comprises a console air diffuser made up of two rigid air diffusion plenums, mechanically connected to each other, and mobile relative to one another each having a lower planar air-diffusing surface that is porous to air. Means of relative movement, formed by a horizontal axis and fixation means in horizontal or vertical position, enable a second downstream mobile rigid air diffusion plenum positioned at one end to pivot relative to the other first, fixed, rigid upstream air-diffusing plenum. They also enable this second mobile rigid plenum to be tilted in relation to the chassis, in two distinct relative positions. In a first position shown in FIG. 1, which we call the fixed in-use position, the second mobile diffusing surface of the second mobile downstream plenum is horizontal and extends the first diffusing surface of the first fixed upstream rigid plenum connected to the chassis. These two diffusing surfaces form only one surface and are positioned horizontally facing and away from the floor. A flow of air curses through the two diffusing surfaces in a substantially vertical air direction covering the sensitive zone that is the bed. In operating use, the floor projecting surface of the second mobile downstream diffusing surface is maximal and covers the bed. The first diffusing surface of the first upstream plenum and the first upstream plenum are fixed relative to the chassis.

In the other position, shown in FIG. 2 which we will call floor movement position, the downstream plenum is folded vertically. The floor projecting surface of the second mobile downstream diffusing surface is of minimal size. The floor projection of the first upstream diffusing surface of the fixed upstream plenum remains unchanged.

The device also comprises a vertical chassis-cabinet, whose width is substantially the same as the width of the bed and includes physical means for decontaminating moving air formed of filters and air pressurizing means formed by a fan.

Aeraulic connection and air circulation means (formed by this chassis-cabinet) aeraulically connect the fan, the filters and the two rigid air diffusion plenums of the air diffuser, forcing the air to pass through their air diffusing porous surfaces.

The mobile supporting chassis-cabinet is connected mechanically and rigidly to the first fixed upstream plenum and indirectly to the second mobile downstream plenum of the air diffuser. It gives rigid support to the cabinet containing the air decontamination filters, fan for pressurizing air and the aeraulic connection assembly. The chassis is fitted with means for horizontal movement of the chassis relative to the floor, formed of casters.

This mobile twin-block aeraulic isolation device of the prior art, with variable geometry diffuser, indeed has the advantage of being able to diffuse filtered air over the entire upper surface of a bed and can be folded away.

One first essential aspect of this device of the prior art is that it comprises only one plenum that is mobile relative to its mobile supporting chassis-cabinet, the other is fixed.

Yet there are two main sizes for hospital beds:

Type 1: Europe and India, width 80 to 90 cm, length 190 to 200 cm;

Type 2: U.S. and Europe, width 91 to 110 cm, length 214 to 227 cm.

One consequence of the geometry of the system, apparent in the description, is that the minimum sizes of this system of the prior art to protect a hospital bed are:

in opened, in-use position:
- height: 76 inches, i.e. 193 cm
- length: 118 inches, i.e. 300 cm, of which 30 inches, i.e. 76.2 cm for chassis-cabinet thickness and 88 inches, i.e. 223 cm, for length of plenums
- width: 47 inches, i.e. 120 cm.

in vertical, closed position for floor movement
- height: 76 inches, i.e. 193 cm
- length: 68 inches, i.e. 173 cm
- width: 47 inches, i.e. 120 cm in closed position with 90° pivot floor movement
- height: 68 inches, i.e. 173 cm
- length: 76 inches, i.e. 193 cm
- width: 47 inches, i.e. 120 cm It therefore appears that in folded position, the smallest dimension of this device of the prior art is its width (width of the plenums). It is therefore in longitudinal direction, that is to say along the axis of the plenums, that it passes more easily through a doorway. So that in folded position, the minimum door width through which the device can be passed is greater than the width of the bed it is to protect (i.e. 47 inches or 120 cm) and is equivalent to the width of its plenums.

Yet, outside the hospital (or industrial) environment, the most frequent door size found in homes is approximately 205 cm high and 80 cm wide i.e. 81 inches×31 inches.

So that the first defect of this system of the prior art, having a single mobile plenum, is that its geometry does not allow its use in home hospitalisation applications, in particular for the treatment of immunosuppressed patients at home, since it cannot pass through standard doorways.

A second defect of this system of the prior art is that the effective width of the plenums it can use is limited by door widths. So that the volume of protection surrounding the patient is itself restricted. This is adverse to patient comfort and protection.

A second essential particular aspect of this device of the prior art is that its physical means for air decontamination are chiefly located in the body of its chassis-cabinet and are formed of filters. On account of this configuration, the chassis-cabinet takes up much space: width substantially equivalent to that of the bed, 47 inches i.e. 120 cm and depth 30 inches i.e. 76 cm. So that either the chassis-cabinet is placed at the foot of the bed in which case it completely blocks out the patient's view in this direction, leading to a feeling of imprisonment detrimental to patient comfort. Also it also blocks out the view of medical staff attending the patient. In addition, its large size makes this configuration impossible in most rooms. Either the chassis-cabinet is placed at the head of the bed, as shown in FIG. 1. However the cabinet is the part of the device which requires the most vertical space.

So that a third defect of mobile aeraulic isolation devices with variable geometry, twin-block diffuser and one single mobile plenum (such as described above) is that when they are used to protect beds, the most sensitive area, the head of the bed is next to that part of the device which is the most closed and most voluminous vertically. It will be understood that this considerably hampers access by medical staff to the sensitive area via the head of the bed (which is the part of the bed which requires most access by attending staff: tube insertion, intravenous drips, disinfection, hygiene . . . ). So that these devices hinder the work of hospital staff.

In addition, the head of the bed is the area with the least available floor and vertical space. The treatment cabinet uses all the rear volume of the sensitive zone formed by the head of the bed. And the head of the bed is precisely where by tradition the majority of the room's technical equipment is located (monitoring equipment, resuscitation equipment, gas inlets . . . ) So that these devices disorganize and hinder the functioning of technical equipment.

A fourth defect of mobile aeraulic isolation devices with variable geometry twin-block diffuser and a single mobile plenum (such as described above) is that the mobile supporting trolley is of fixed geometry. For reasons of space, the length of the frame parts of this trolley is far smaller than the overall length of the diffuser when corbelled in opened operating use. It will be understood that on this account the device of the prior art has very precarious balance when opened for use.

A fifth defect of mobile aerological isolation devices with variable geometry twin-block diffuser and a single mobile plenum (as described above) is that the different mass parts (chassis-cabinet . . . ) giving counterweight to prevent collapse of the device when the corbelled diffuser is in open operating position, are fixed relative to the polygonal centre of sustentation. So that there is no means to offset displacement of the centre of gravity towards the free end of the device when the mobile plenum is opened for use. For this reason, the equilibrium of the device of the prior has further precariousness when opened for use.

A sixth defect of mobile aeraulic isolation devices with variable geometry twin-block diffuser (such as described above) is that their lateral air curtain is insufficient to prevent penetration inside the sensitive bed zone of Pflügge droplets emitted by visitors or attending staff when speaking, coughing or sneezing. These Pflügge droplets generally have a diameter of between 5 and 100 microns and are emitted at very high speed (at times close to the speed of sound). S that the curtain of air is not able to stop their passage on account of their high kinetic energy. This obliges visitors and attending staff to wear a mask close to the device if the device is used to protect a patient with very low immunity response, which is nonetheless its chief function.

A seventh defect of mobile aeraulic isolation devices with variable geometry twin-block diffuser (such as described above) is that their lateral air curtain is generally very noisy and energy-consuming.

An eighth defect of mobile aeraulic isolation devices with variable geometry twin-block diffuser (such as described above) is connected with their first particular aspect described above. The minimum lateral space required by this device in movement position is equivalent to the width of plenum protection. So that it is not possible provide these plenums with sufficient width so that, within the protected surface underneath the plenums, they can house visitors or attending staff and/or equipment to make life more pleasant for patients (tables, lounge chair, reading chair . . . ). Otherwise the device could not go through doorways.

SUMMARY OF THE INVENTION

The invention concerns a mobile aeraulic isolation device with multi-block, variable geometry air diffusion chamber to protect a sensitive area such as a bed against contaminating airborne aerosols.

The isolation device of the invention is of the type comprising an air diffusion chamber (or diffuser) formed of at least two rigid air diffusion plenums, mechanically connected to each other so that they are mobile relative to one another. Each of the two rigid plenums is delimited by an outer envelope of substantially parallelepiped shape (optionally dihedral) with substantially rectangular cross-section having an air diffusing undersurface that is substantially planar and porous to air, to allow air diffusion through it. The outer envelope of each plenum, at least at one first contact end, is provided with a first free end contacting surface (open) substantially perpendicular to the corresponding diffusing surface. This first free end contacting surface is surrounded by a so-called intermediate ring joint plane of substantially identical size and geometry for both rigid plenums.

The invention specifically relates to mobile plenum aeraulic isolation devices, that is to say also comprising means of relative movement for at least one first mobile plenum relative to the other second mobile plenum, and enabling them to be positioned relative to one another in at least two distinct relative positions, including a so-called open relative position and a so-called closed relative position.

In the open relative position, the first diffusing surface of the first mobile plenum is substantially coplanar and abutting, substantially in the extension of the second diffusing surface of the second mobile plenum. The intermediate joint planes of the mobile plenums are immediately adjacent so that the mobile plenums are hermetically coupled.

In the other so-called closed relative position, the first diffusing surface of the first mobile plenum does not lie in the extension of the diffusing surface of the second mobile plenum. Also, the intermediate joint planes of the mobile plenums are distanced from each other and uncoupled.

An aeraulic isolation device with mobile plenum according to the invention is of the type fitted with at least one physical means for decontaminating air moving through it, and with at least one air pressurizing means. It is equipped with aeraulic connection and air circulation means, which aeraulically connect the air pressurizing means, the physical air decontamination means and a second free inlet surface of at least one of the two rigid plenums of the air distribution chamber, forcing the flow of air to pass through the porous air diffusing surfaces when the plenums are in open, hermetically coupled position.

An aeraulic isolation device with mobile plenum of the invention is of the type placed on a mobile supporting chassis, mechanically connected to the two rigid plenums of the air diffusion chamber, to the one or more physical air decontamination means, to the air pressurizing means and to the aeraulic connection means. This mobile supporting chassis is equipped with means for horizontal movement of the chassis relative to the floor.

One first particular aspect characteristic of the mobile aeraulic isolation device of the invention compared with mobile plenum systems of the prior art is that, in addition, it comprises at least one complementary means for absolute movement of the group of two rigid plenums relative to the mobile supporting chassis. So that that mobile aeraulic isolation device with mobile plenums of the invention is easily recognizable in that its first rigid plenum and its second rigid plenum for air diffusion are both mobile, both relative to one another and relative to the chassis.

DRAWINGS AND FIGURES

In the remainder of the description and drawings, three different variants of embodiment of the invention will be described, differing in the nature of the combined kinematics:

of the relative movement means for the first upstream mobile plenum relative to the second downstream mobile plenum, and of the complementary means of absolute movement for the group of two rigid plenums relative to the mobile supporting chassis.

Therefore:

FIGS. 1 to 10*a* show a first variant of embodiment of a mobile aeraulic device (1*a*) of the invention provided with:

means of relative movement for the plenums which slide into one another drawer-fashion, complementary means of absolute movement for the group of two rigid plenums, of horizontal rotating axis type for absolute movement joining the mobile supporting chassis and one of the plenums.

Figure 3A:
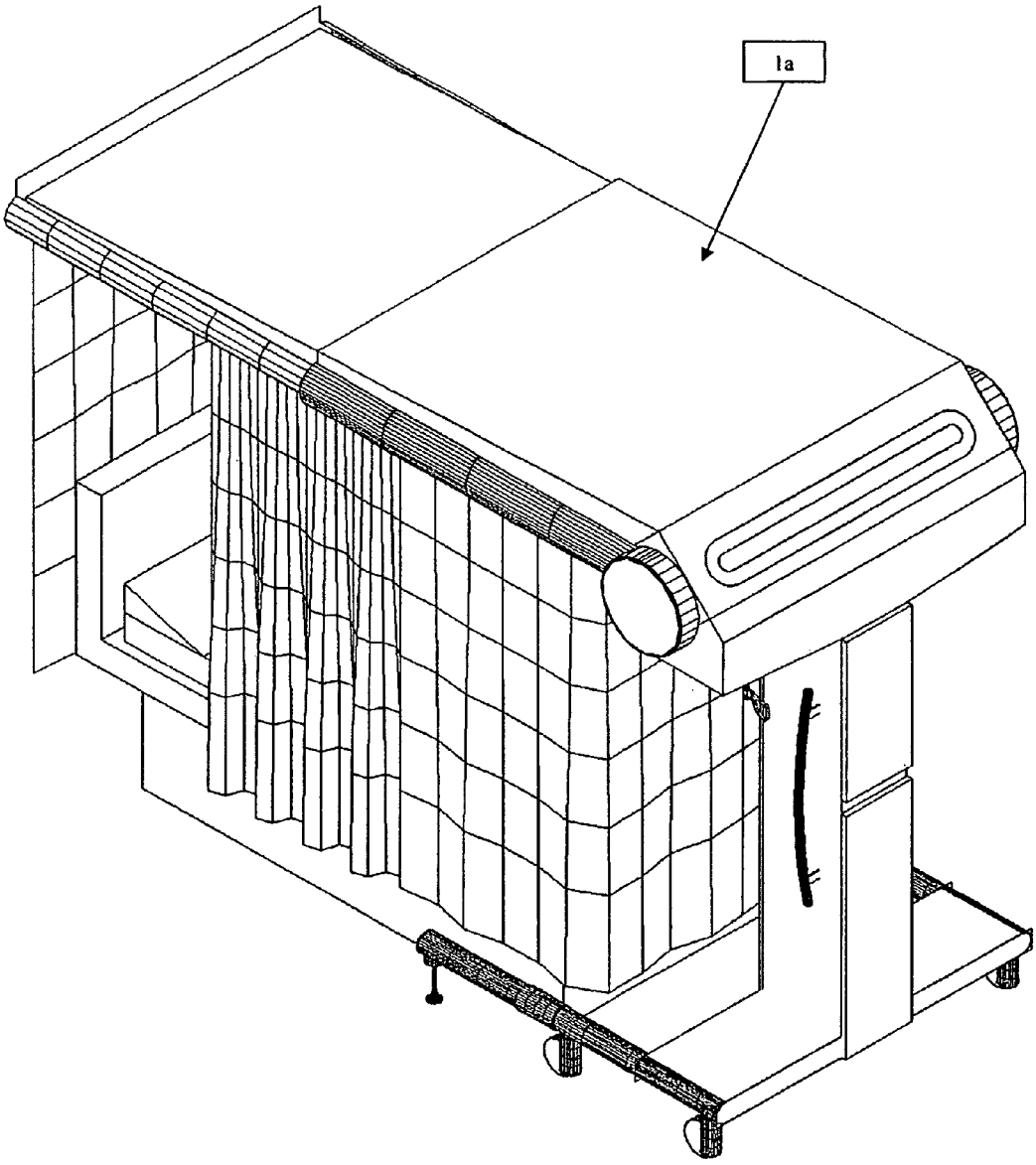

FIG. 3*a* is an upper rear perspective view of a mobile aeraulic isolation device 1A (of standard plenum width type) in open position (fixed in use) covering a hospital bed.

Figure 3B:
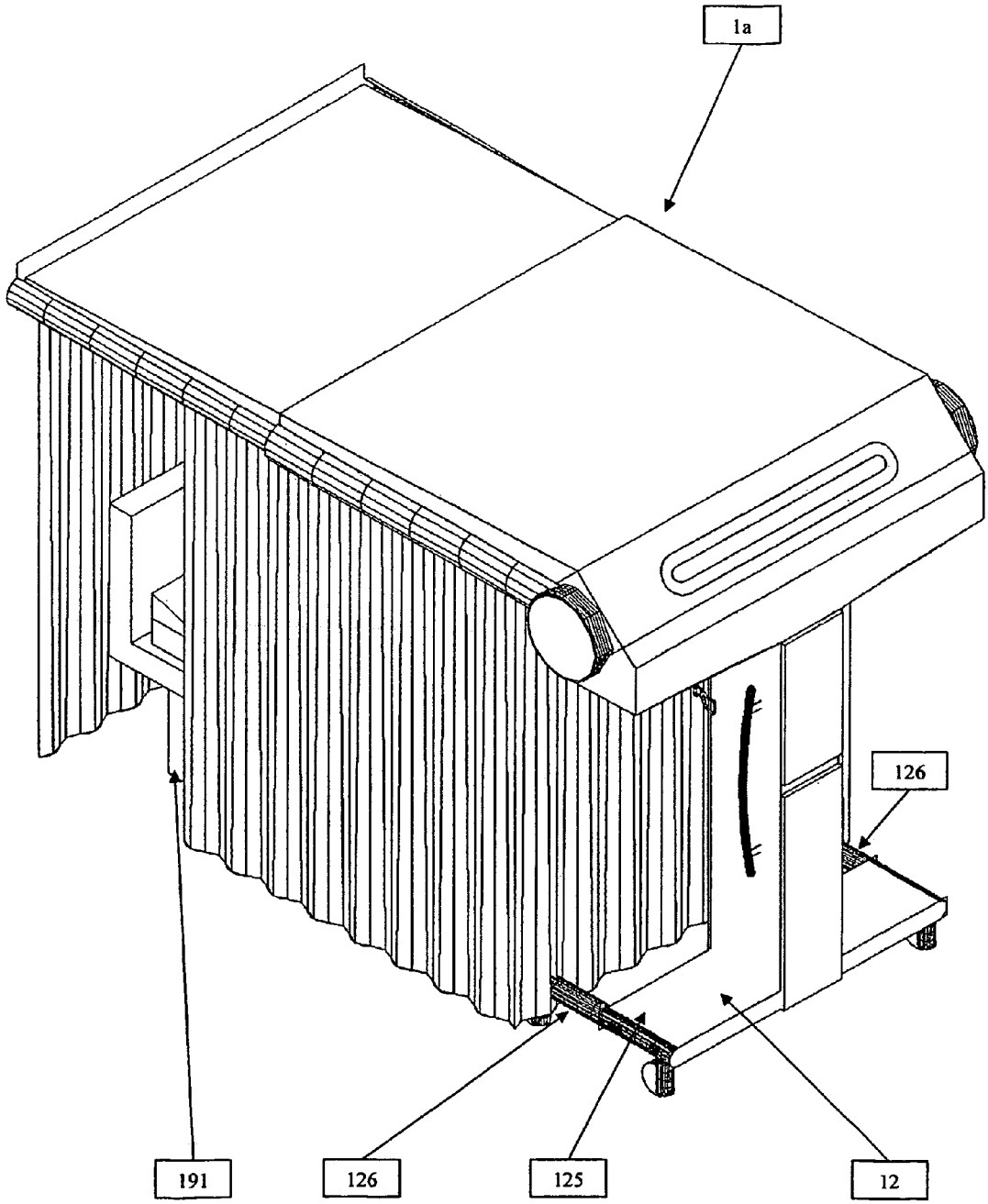

FIG. 3*b* is an upper rear perspective view of a mobile aeraulic isolation device 1*a* (of large plenum width type) in open position (fixed in use) covering a hospital bed.

Figure 4:
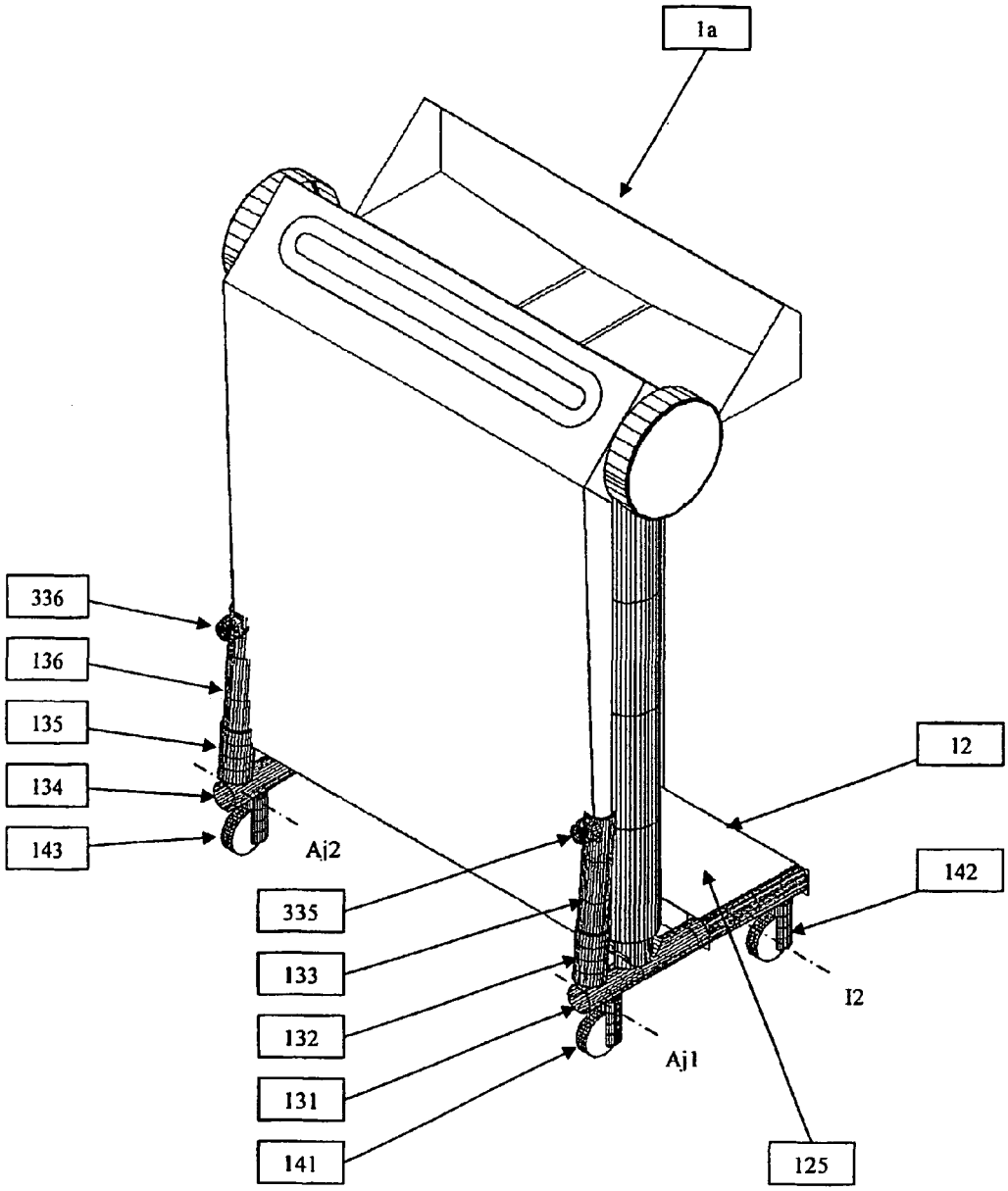

FIG. 4 is a front perspective view of a mobile aeraulic isolation device 1*a* in closed position (for floor movement).

Figure 5:
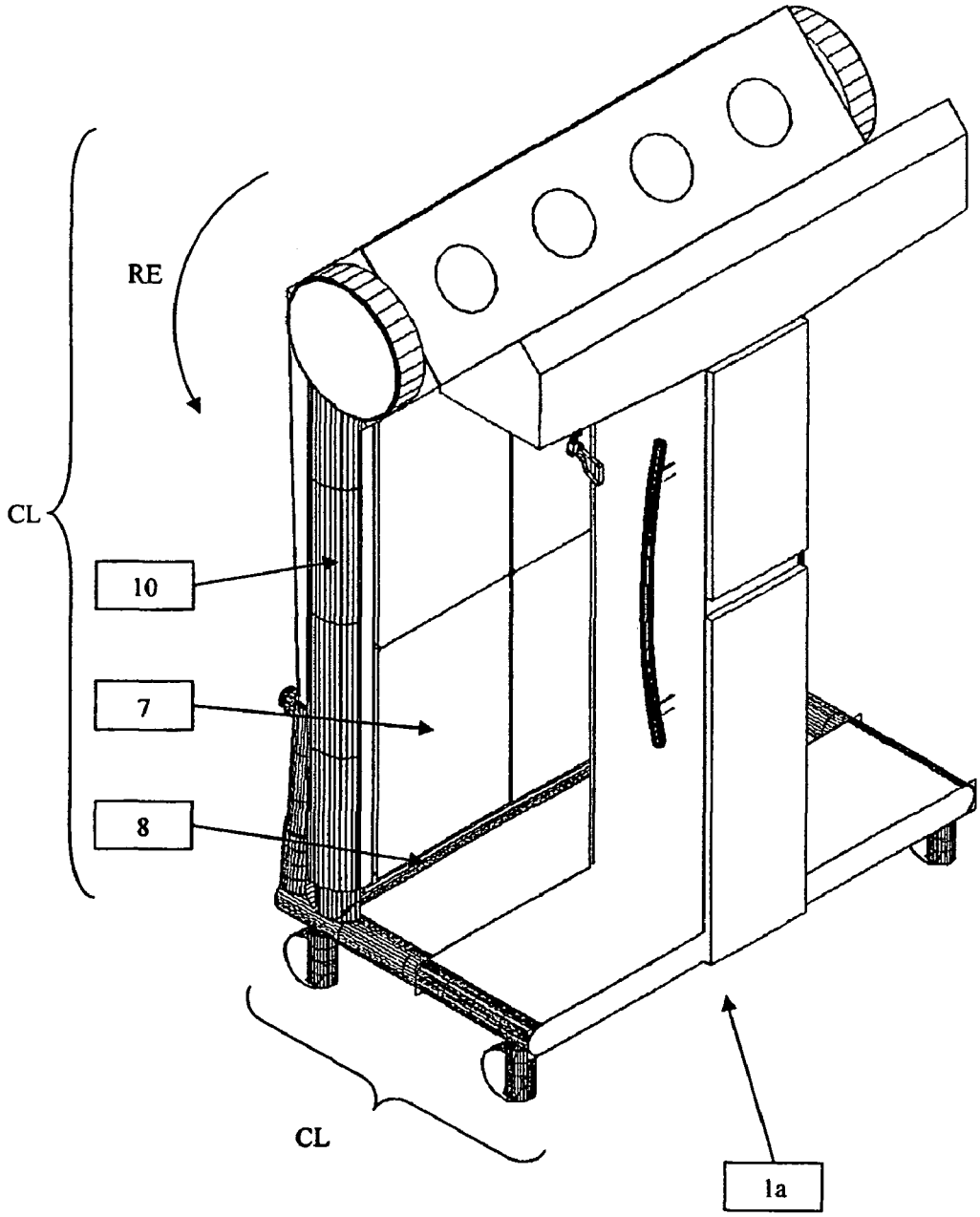

FIG. 5 is a rear perspective view of a mobile aeraulic isolation device 1*a* in closed position (for floor movement).

Figure 6A:
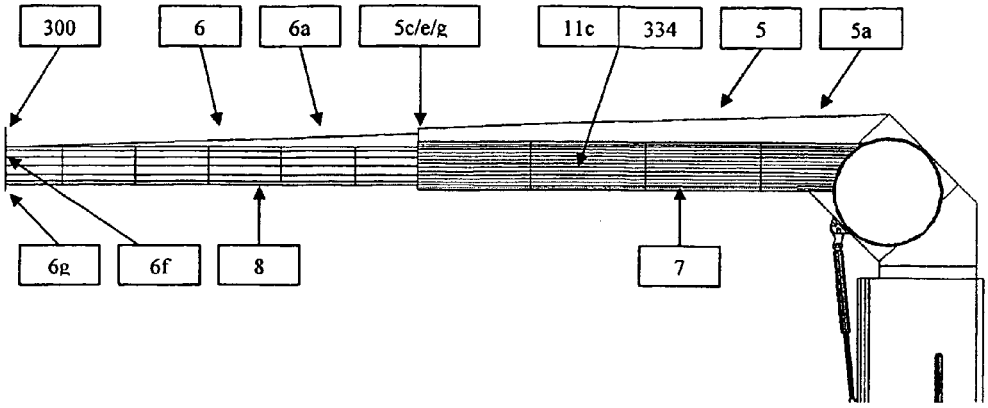
Figure 6B:
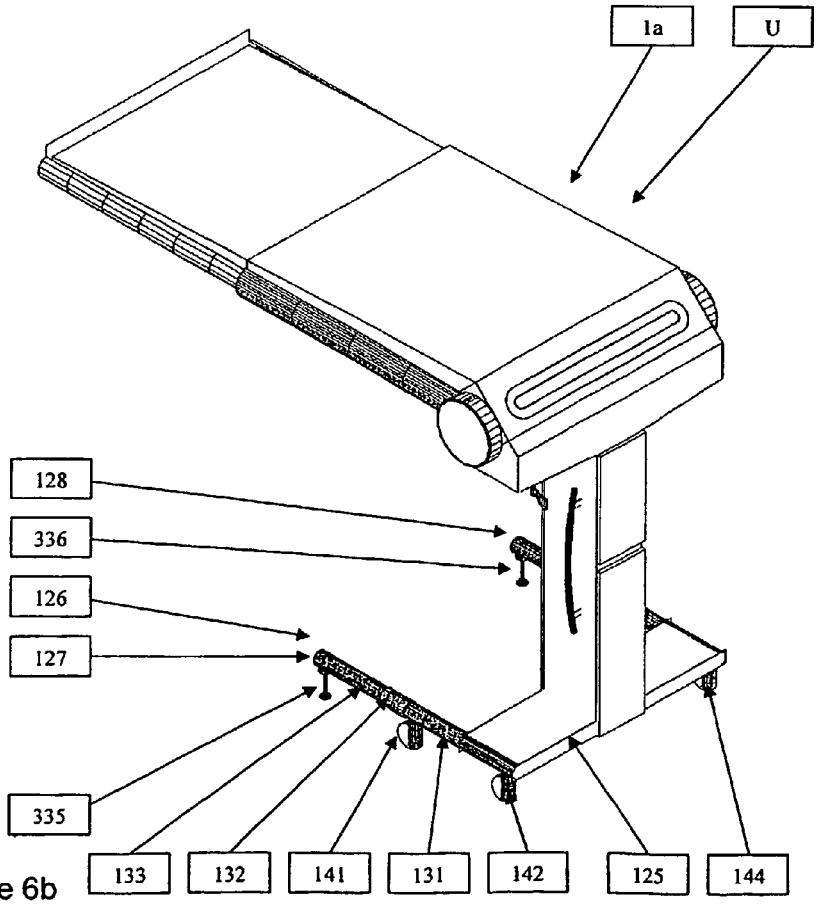

FIGS. 6*a* and 6*b* are left upper(overhead) rear perspective views of the diffuser and of a mobile aeraulic isolation device 1*a* in open position (fixed in use).

Figure 7:
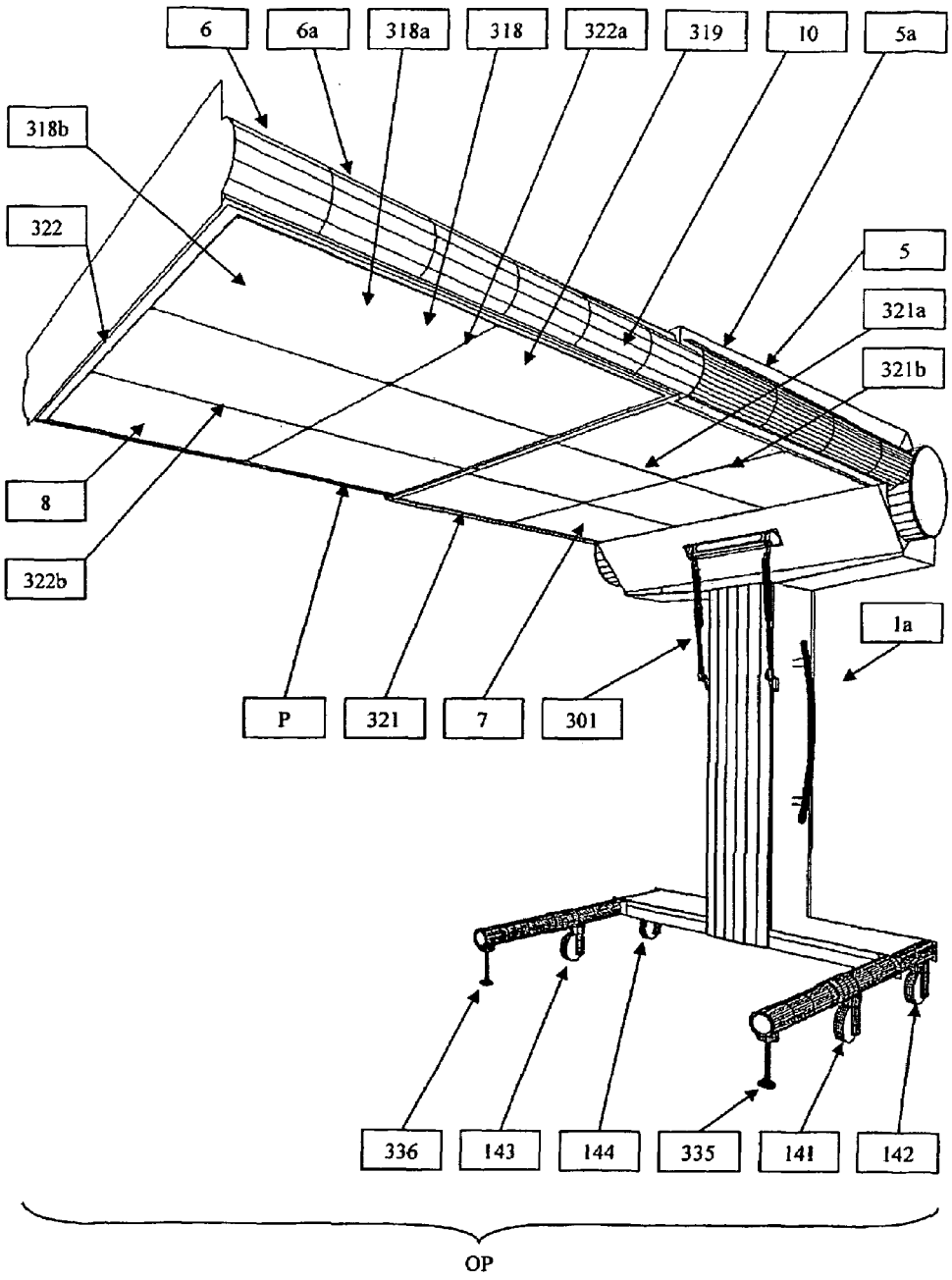

FIG. 7 is a front lower perspective view of a mobile aeraulic isolation device 1*a* in open position (fixed in use).

Figure 8:
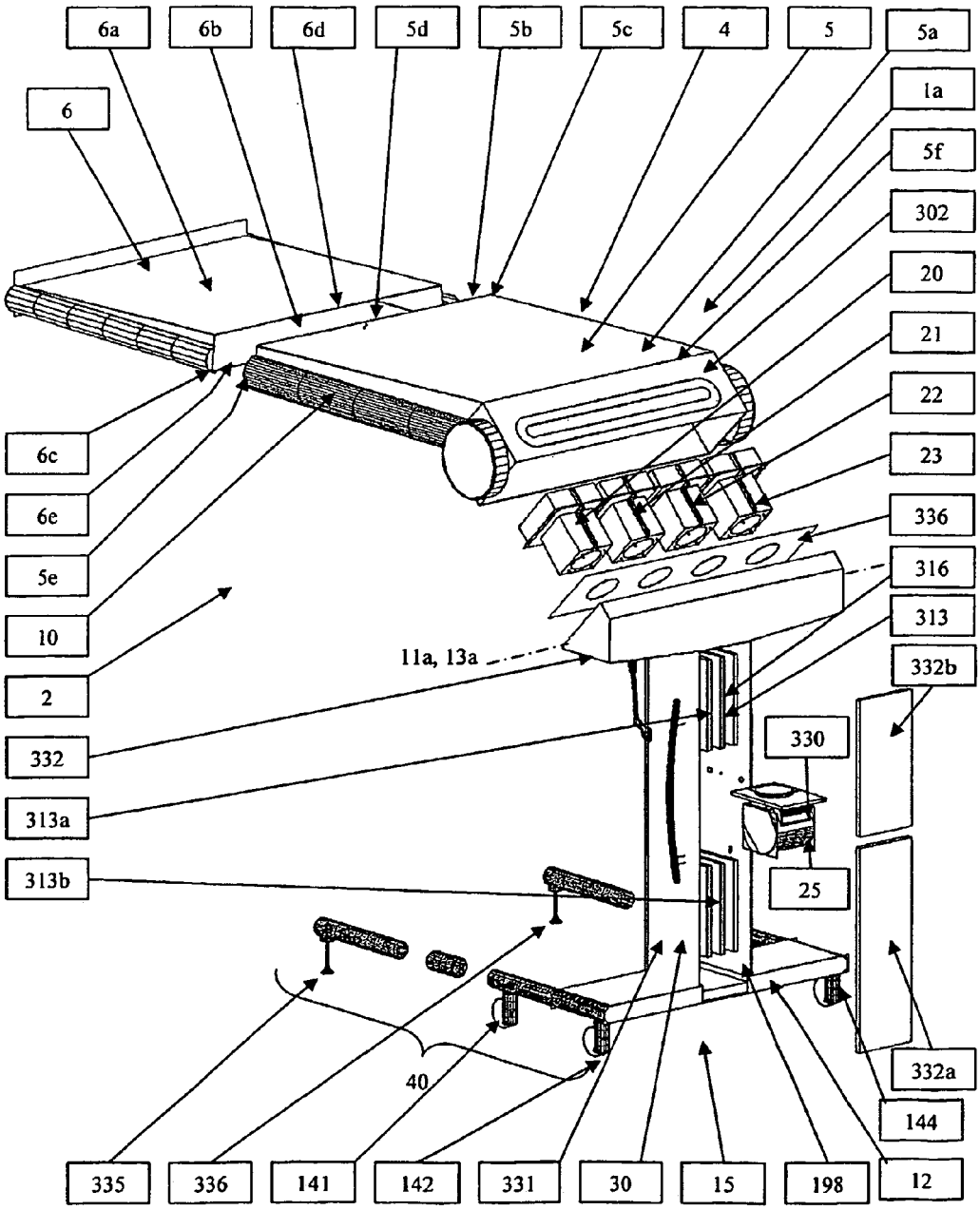

FIG. 8 is a rear perspective exploded view of a mobile aeraulic isolation device 1*a* in open position (fixed in use).

Figure 9A:
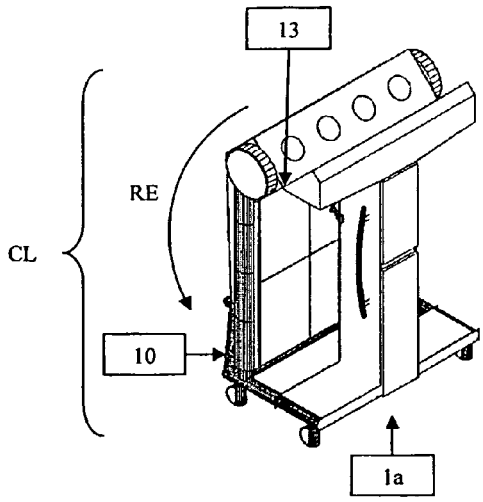
Figure 9B:
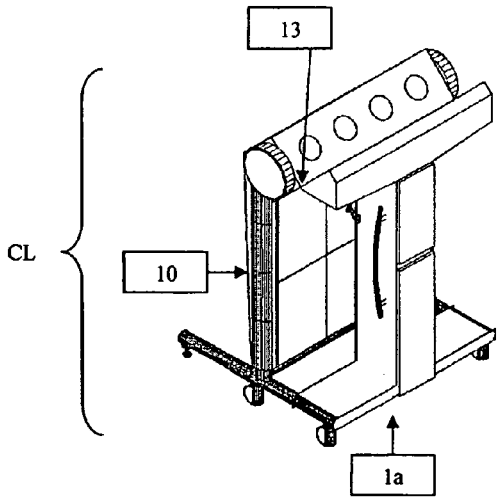
Figure 9C:
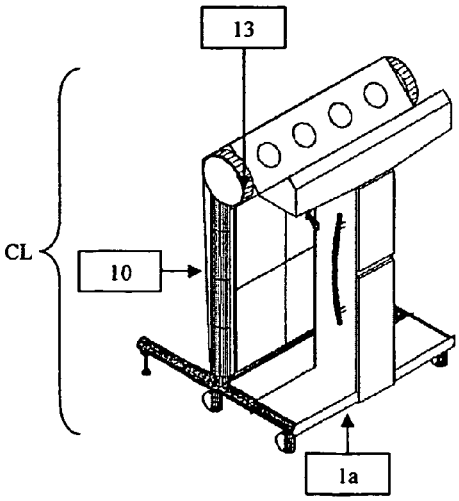
Figure 9D:
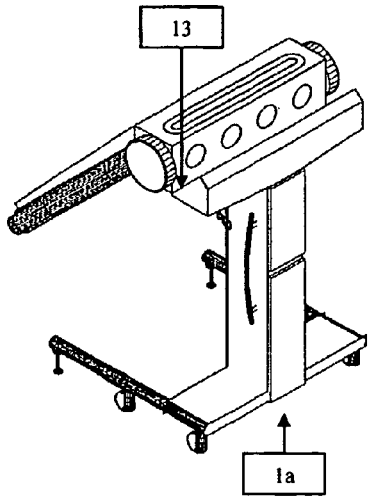
Figure 9E:
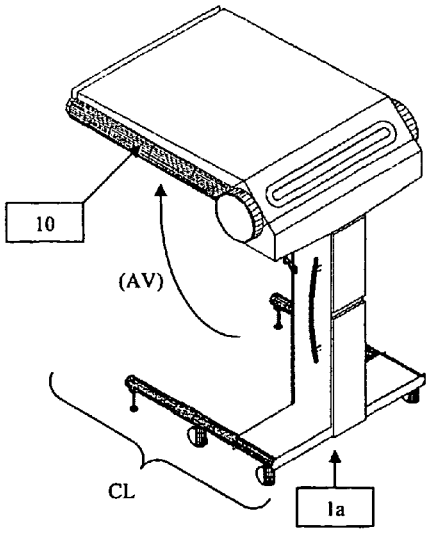
Figure 9F:
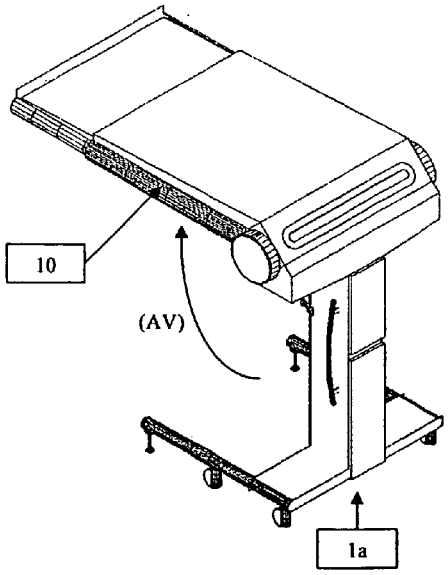
Figure 9G:
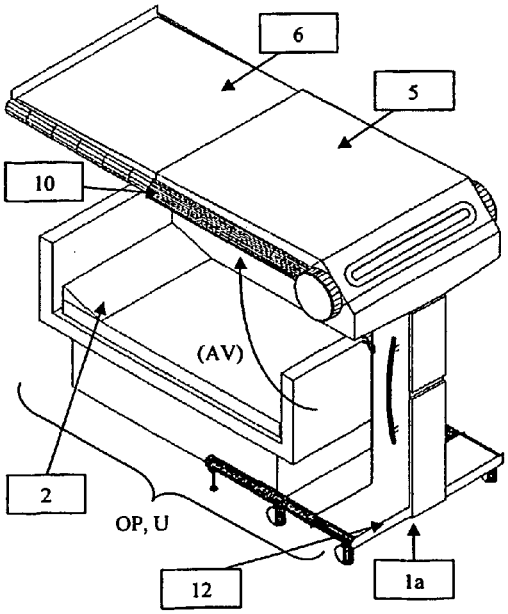
Figure 9H:
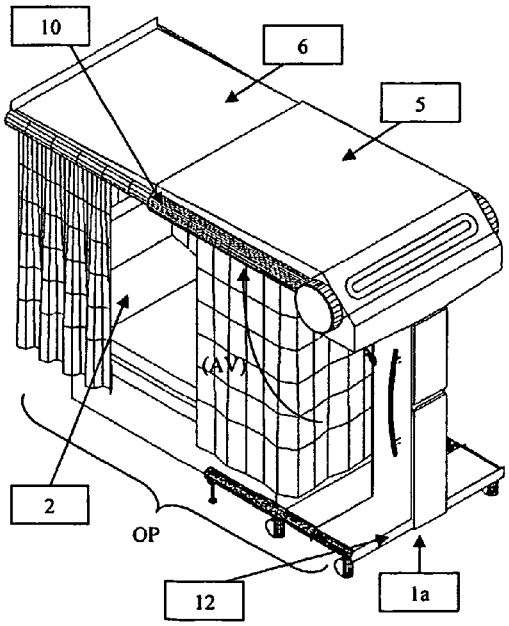

FIGS. 9*a* to 9*h* are rear upper perspective views of the different phases of setting up a mobile aeraulic isolation device 1*a* from closed position (for floor movement) to open position (fixed in use):

FIG. 9*a*: in floor movement position, global recessed vertical position of the plenums, with downstream plenum folded drawer fashion inside the upstream plenum, feet raised, FIG. 9*b*: global recessed position, with downstream plenum folded, feet lowered, FIG. 9*c*: global recessed position, with downstream plenum folded, feet lowered, shoe blocks resting FIG. 9*d*: global intermediate position with downstream plenum folded, and partial rotation of the group of two plenums, FIG. 9*e*: global horizontal forward position of plenums, with downstream plenum folded, FIG. 9*f*: global horizontal, forward position of plenums, with downstream plenum half-opened, FIG. 9*g*: global horizontal forward position of the plenums, with downstream plenum opened and covering a bed, FIG. 9*h*: in use mode with curtains and covering a bed.

Figure 10:
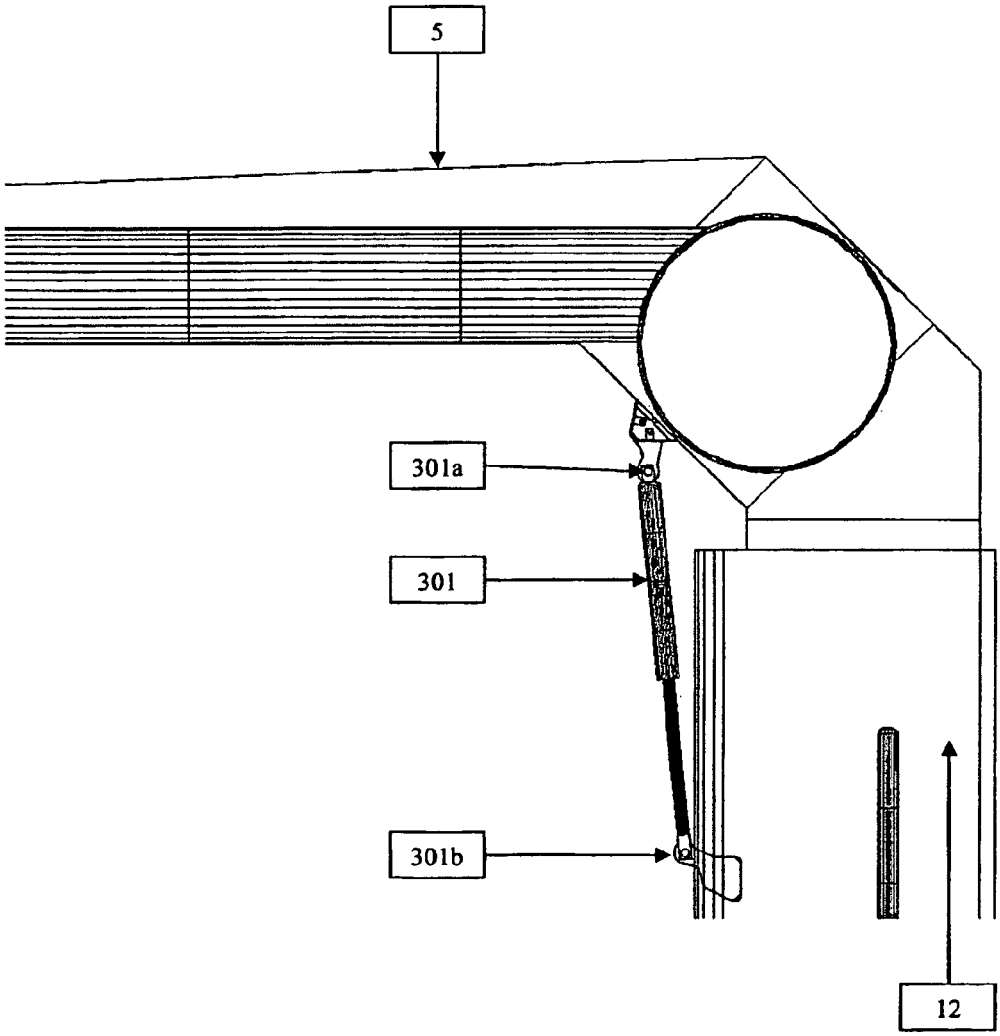

FIG. 10 is a detailed left view of a mobile aeraulic isolation device 1*a*, showing the arrangement of the gravity effect compensation means(jacks) on the plenums.

FIGS. 11 to 20 show a second variant of embodiment of a mobile device 1*b* for aeraulic isolation according to the invention, provided with:

means for relative movement of the plenums by rotation about a mobile horizontal axis of relative movement connected to both of the plenums, and complementary means for absolute movement of the group of two rigid plenums, of fixed horizontal rotating axis type for absolute movement connected to the mobile supporting chassis and to one of the plenums.

Figure 11:
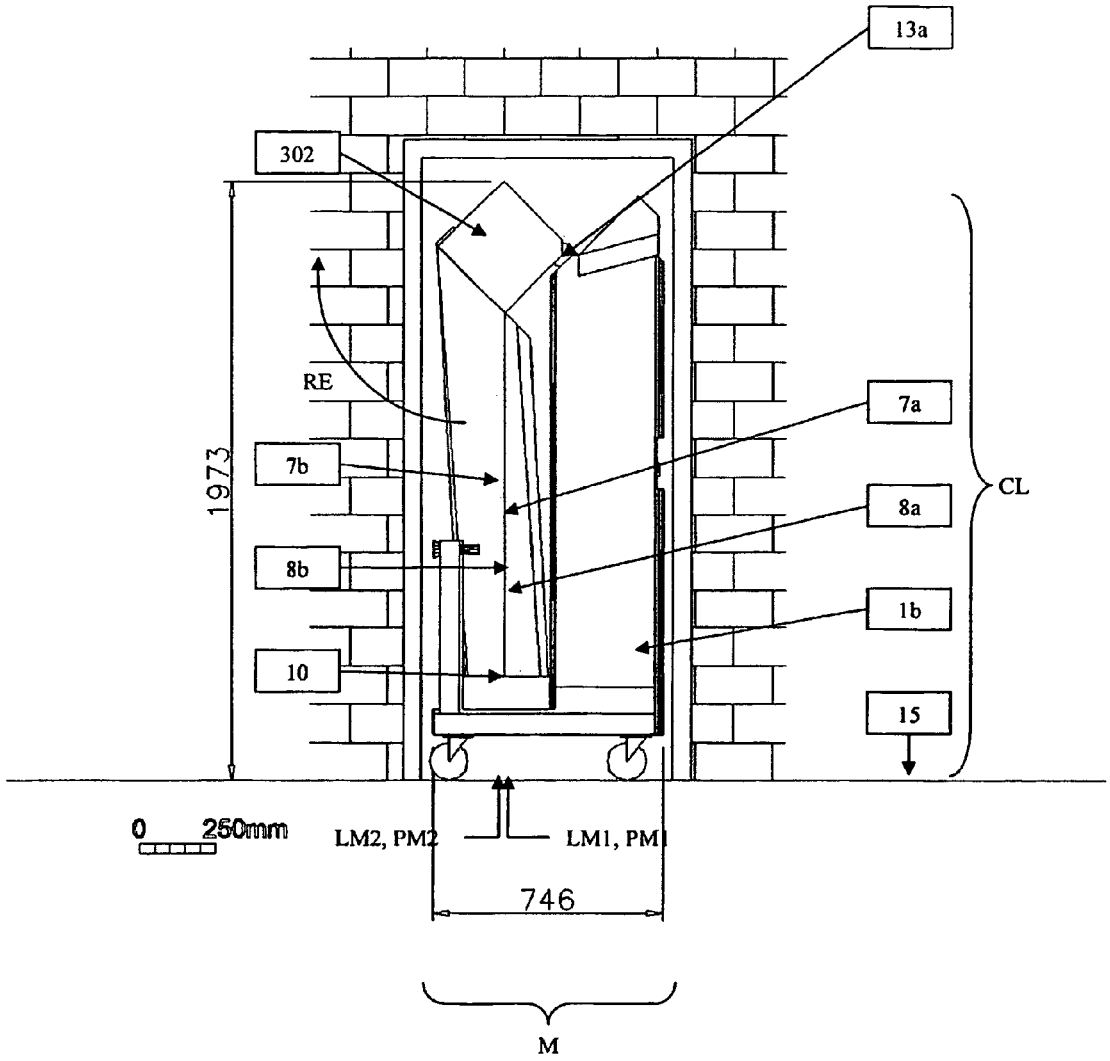

FIG. 11 is a left view of a mobile aeraulic isolation device 1*b* in closed position (for floor movement) when passed through a doorway.

Figure 12:
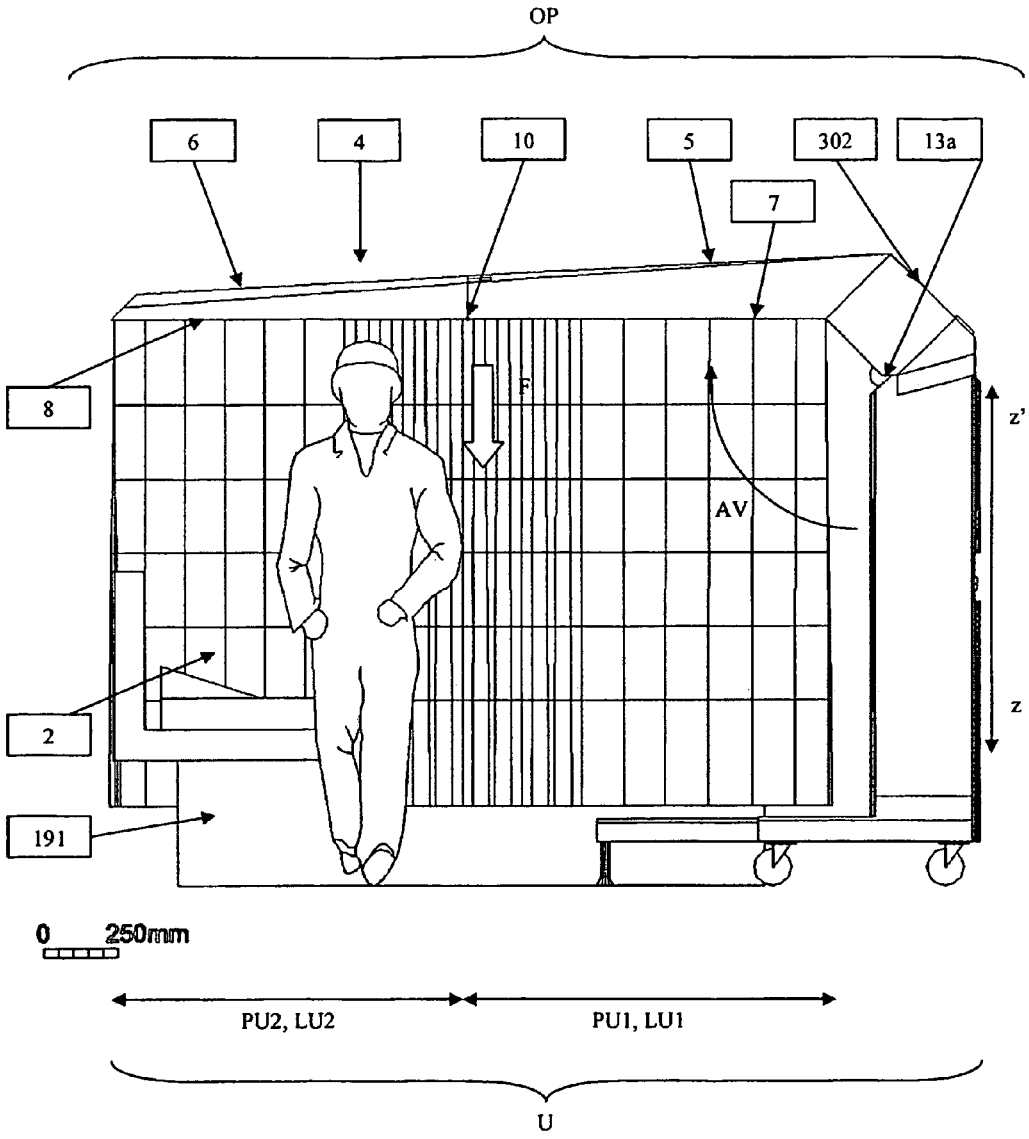

FIG. 12 is a left view of a mobile aeraulic isolation device 1*b* in open position (fixed in use) covering a hospital bed.

Figure 13:
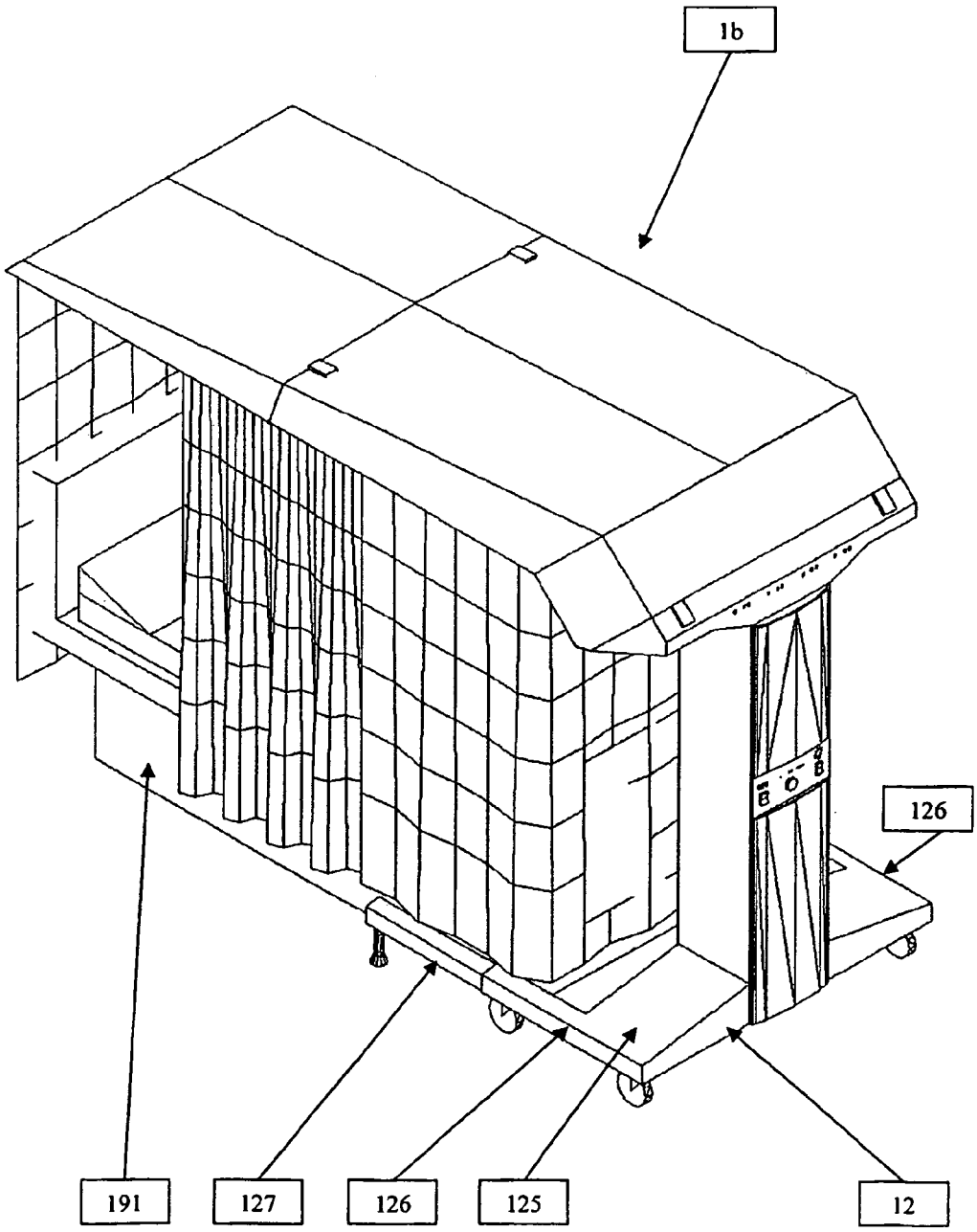

FIG. 13 is an upper rear perspective view of a mobile aeraulic isolation device 1*b* in open position (fixed in use) covering a hospital bed.

Figure 14:
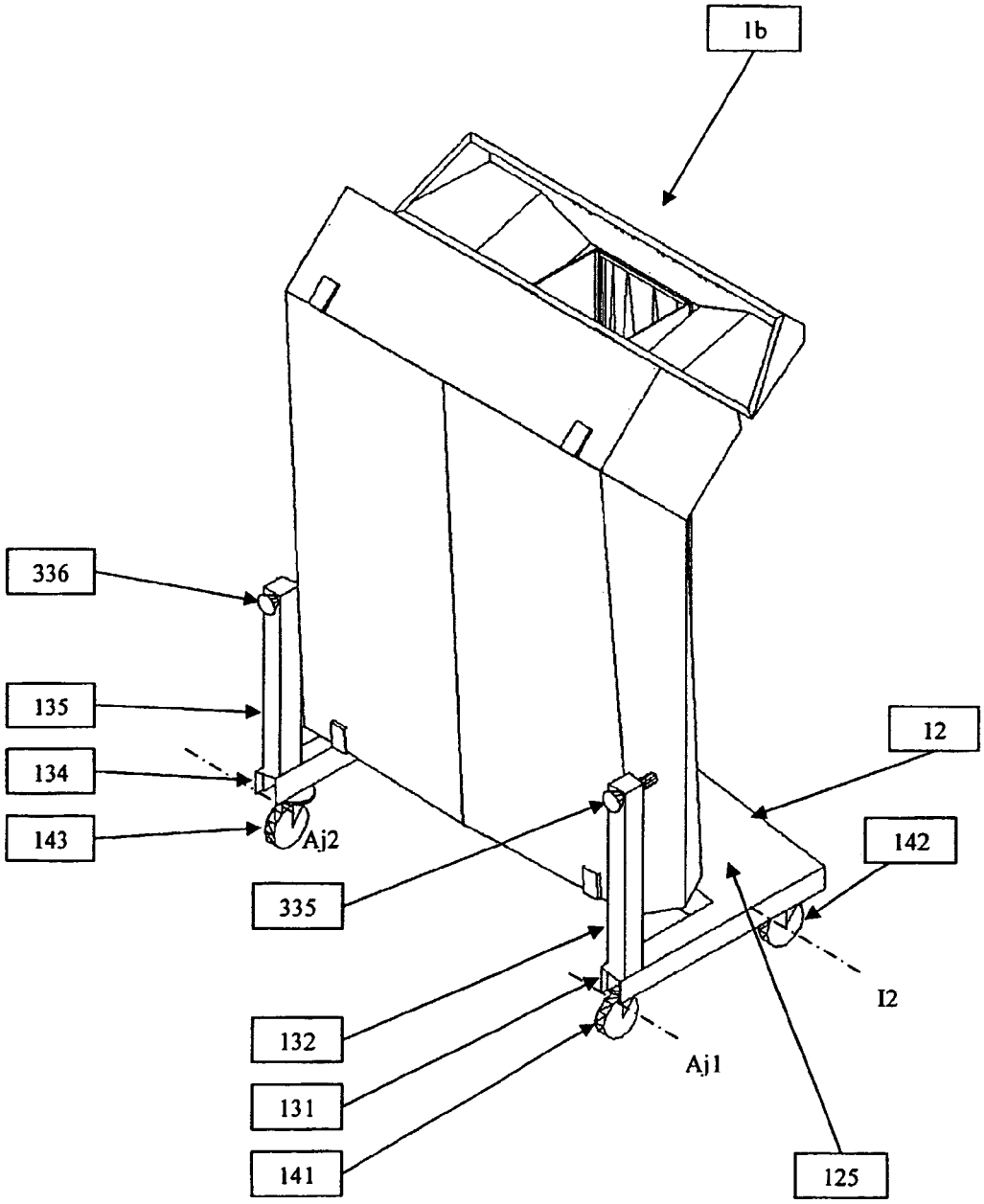

FIG. 14 is a front perspective view of a mobile aeraulic isolation device 1*b* in closed position (for floor movement).

Figure 15:
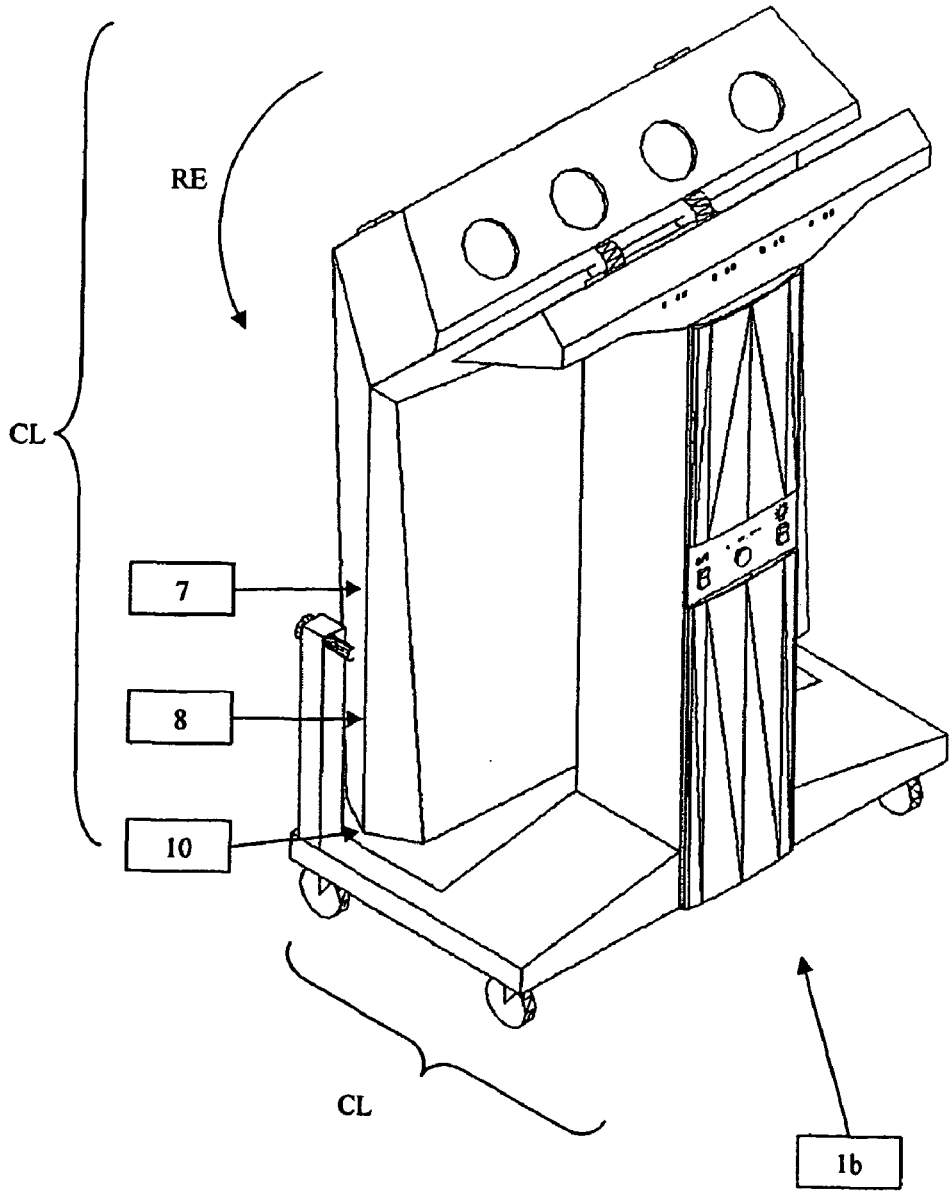

FIG. 15 is a rear perspective view of a mobile aeraulic isolation device 1*b* in closed position (for floor movement).

Figure 16A:
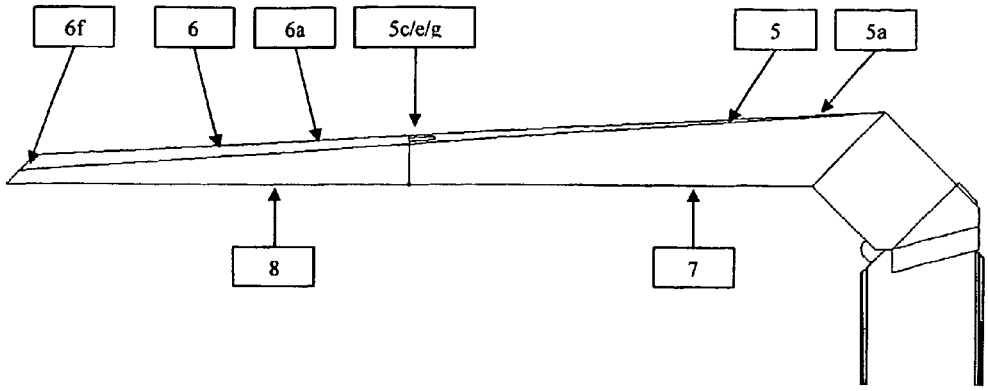
Figure 16B:
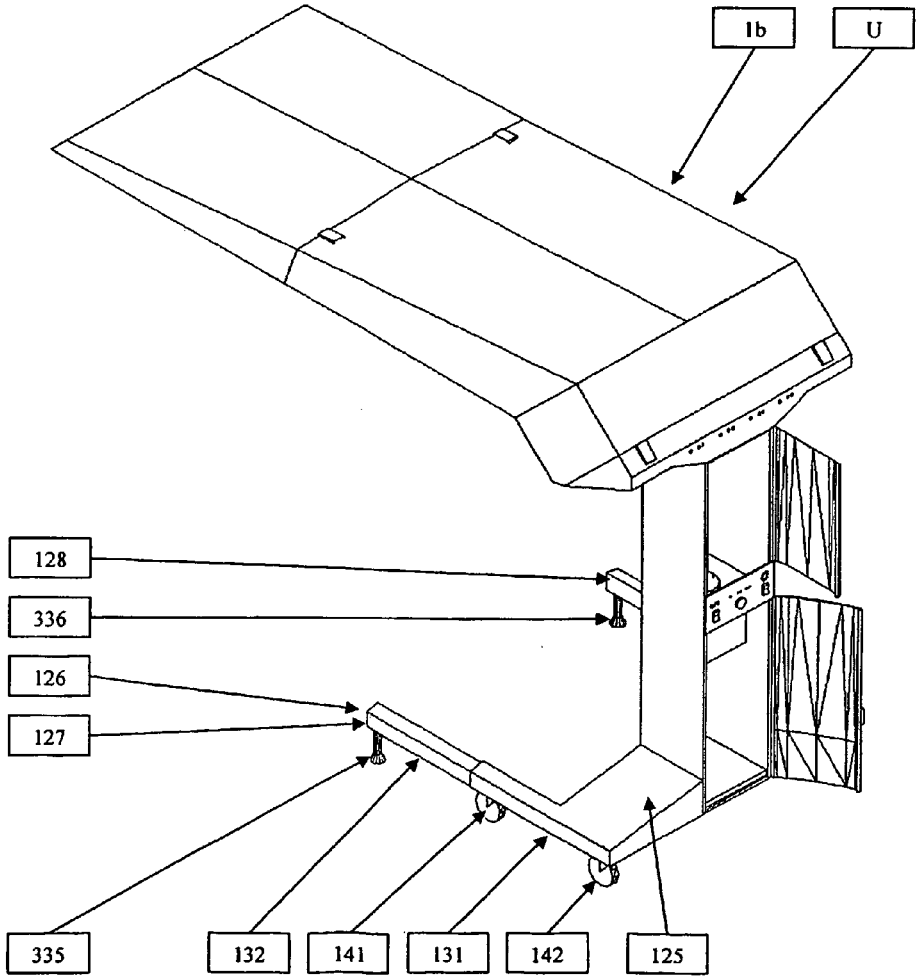

FIGS. 16*a* and 16*b* are left views and in upper rear perspective of the diffuser and mobile aeraulic isolation device 1*b* in open position (fixed in use).

Figure 17:
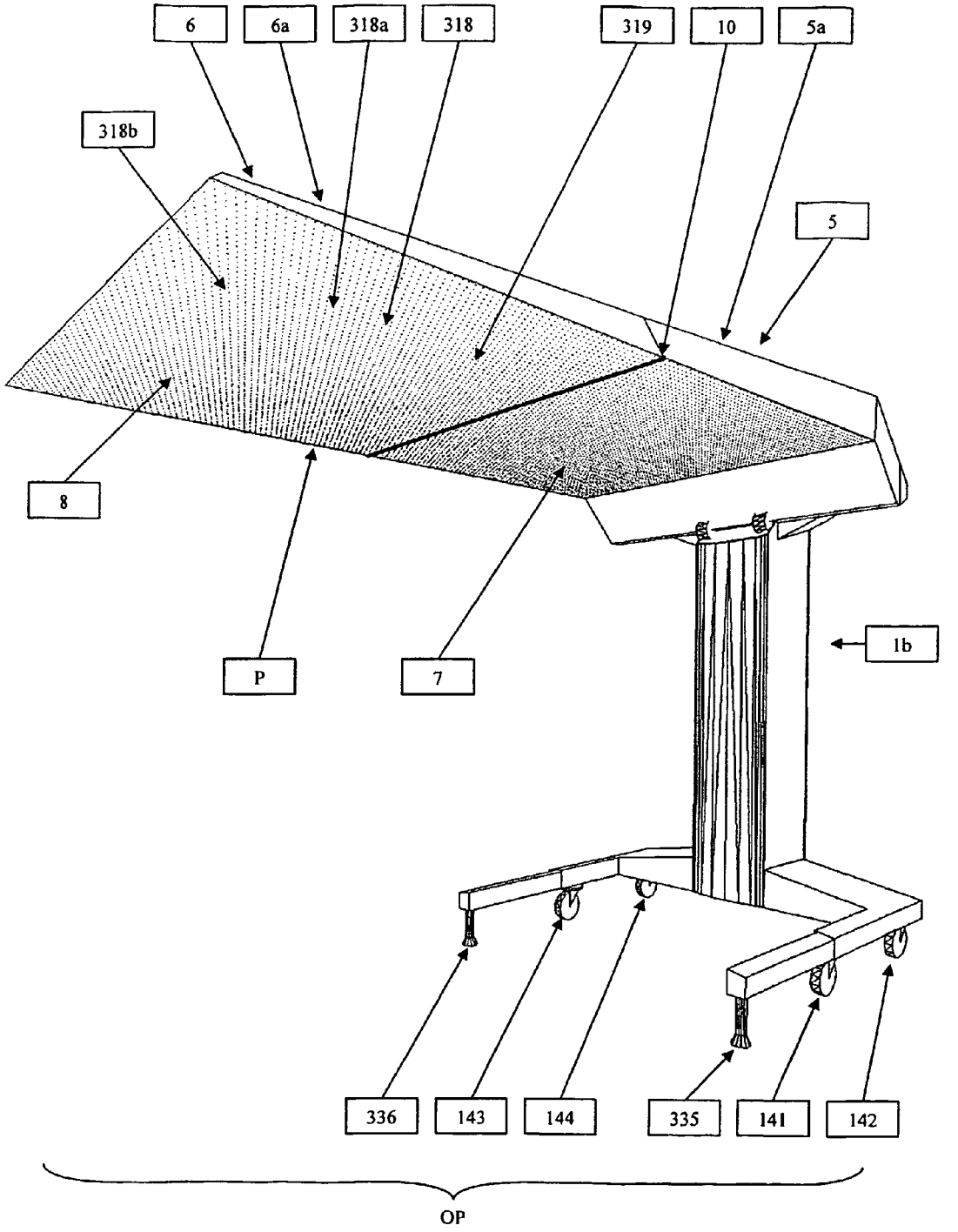

FIG. 17 is a lower front perspective view of a mobile aeraulic isolation device 1*b* in open position (fixed in use).

Figure 18:
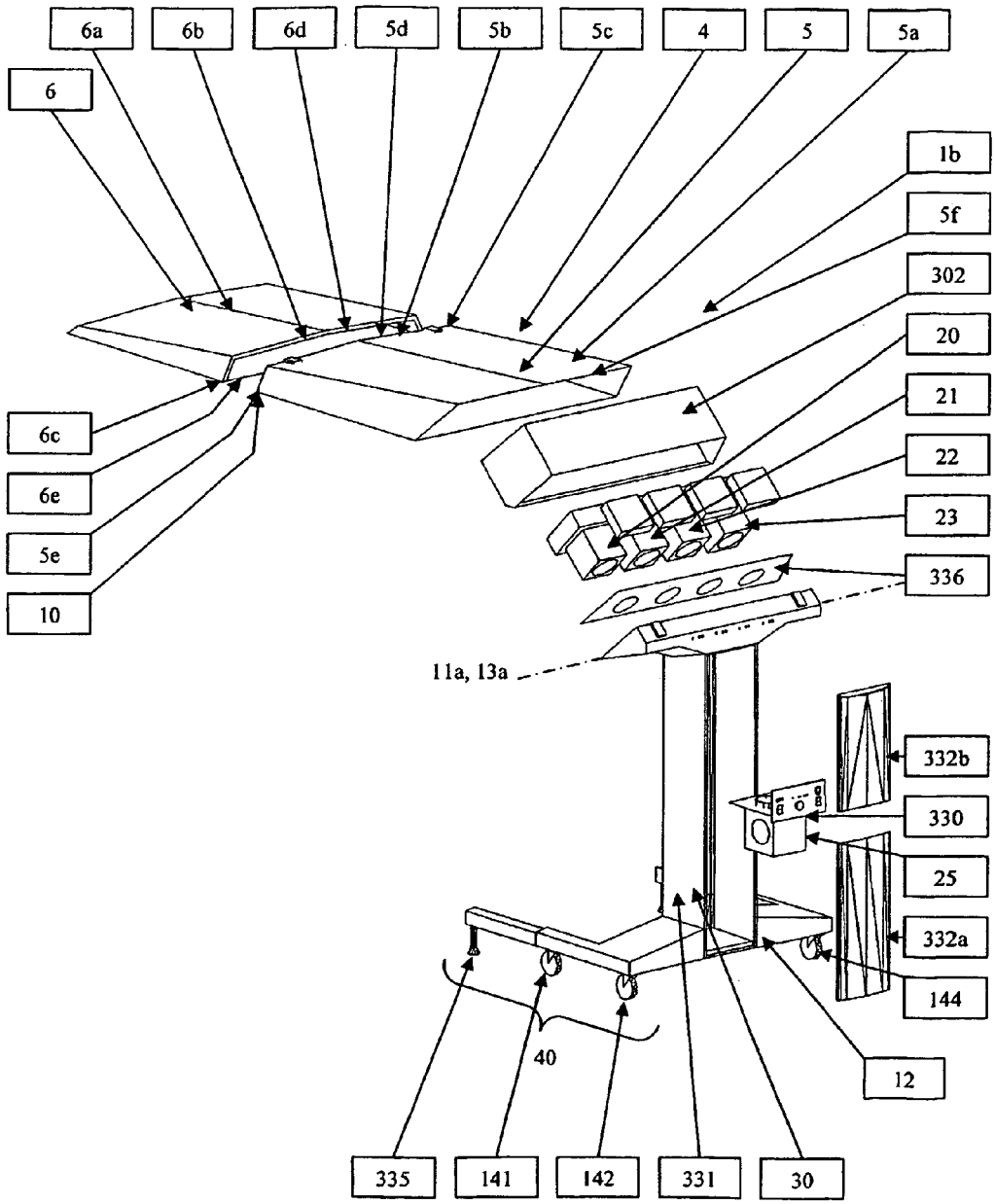

FIG. 18 is a rear exploded perspective view of a mobile aeraulic isolation device 1*b* in open position (fixed in use).

FIGS. 19*a* to 19*h* are an upper rear perspective views of the different phases in setting up a mobile aeraulic isolation device 1*b* from a closed position (floor movement) to the open position (fixed in use).

Figure 19A:
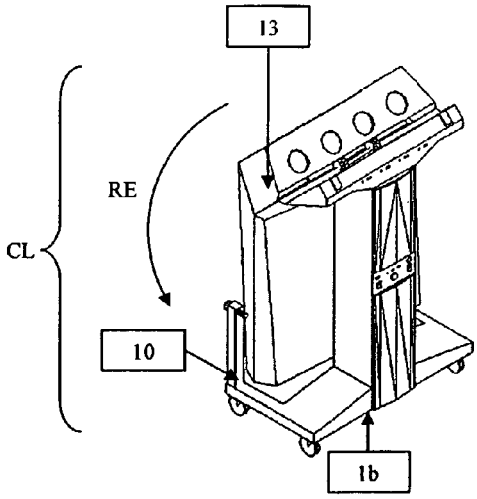
Figure 19B:
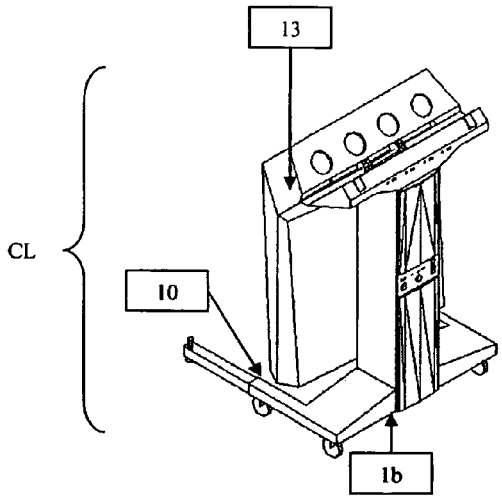
Figure 19C:
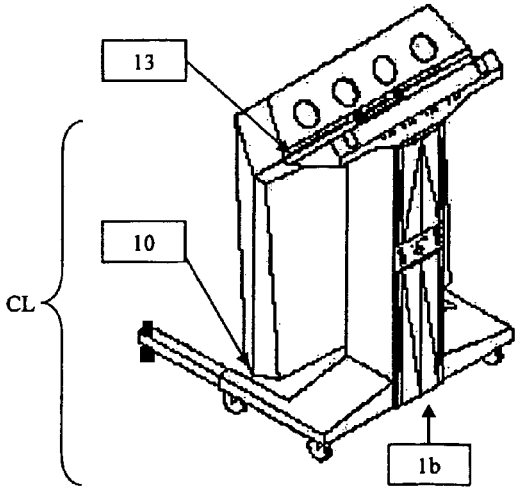
Figure 19D:
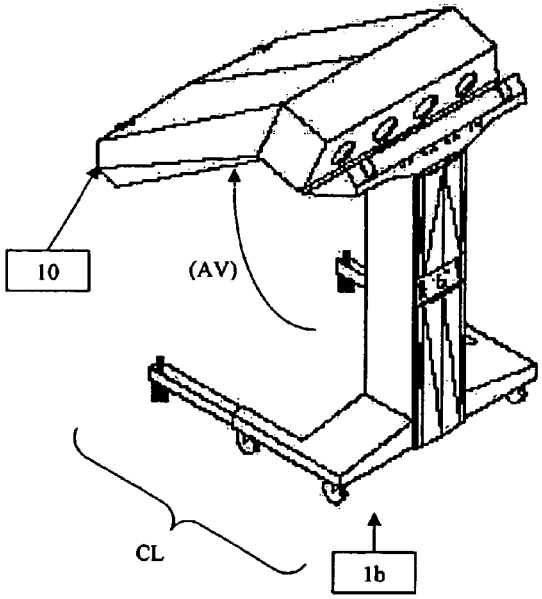
Figure 19E:
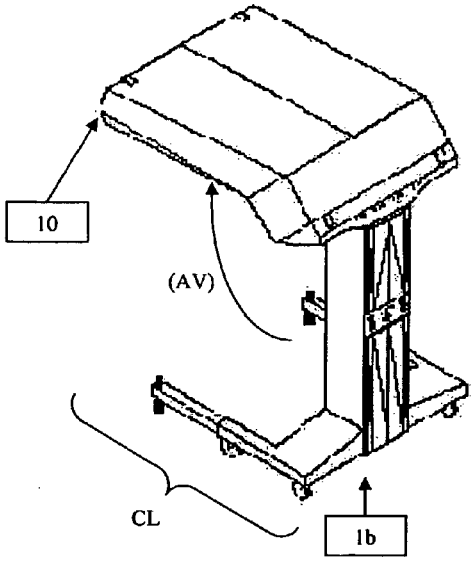
Figure 19F:
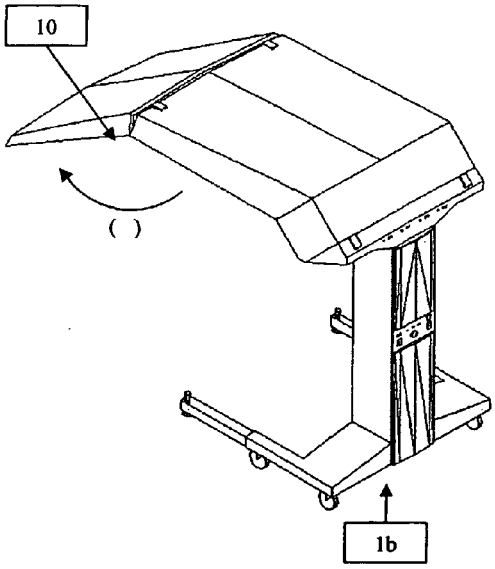
Figure 19G:
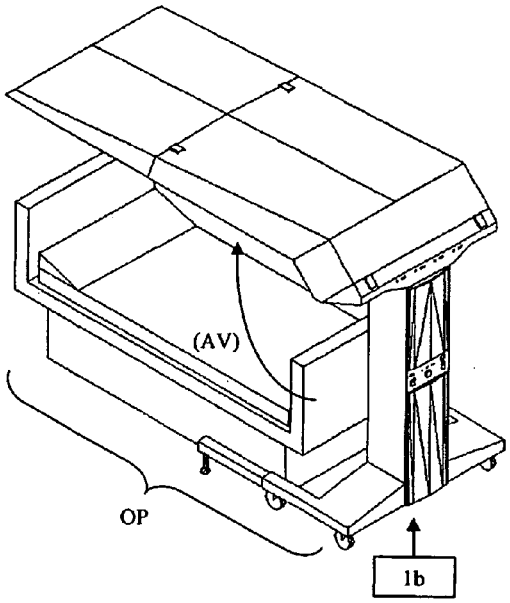
Figure 19H:
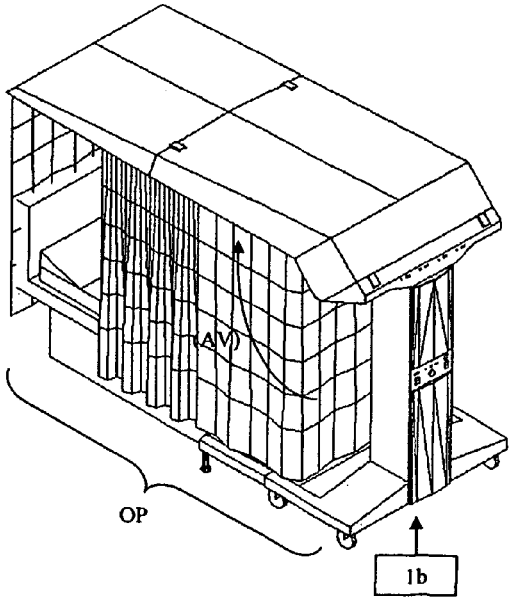

FIG. 19*a*: in floor movement mode, global vertically recessed position of plenums with downstream plenum folded against the upstream plenum, feet raised, FIG. 19*b*: global recessed position, with downstream plenum folded, feet lowered, FIG. 19*c*: global recessed position, with downstream plenum folded, feet lowered, shoe blocks resting FIG. 19*d*: intermediate global position with downstream plenum folded and partial rotation of the group of two plenums, FIG. 19*e*: global horizontal forward position of the plenums with downstream plenum folded, FIG. 19*f*: global horizontal forward position of the plenums with downstream plenum half-opened, FIG. 19*g*: global horizontal forward position of plenums with downstream plenum opened and covering a bed, FIG. 19*h*: in-use mode with curtains, covering a bed.

Figure 20:
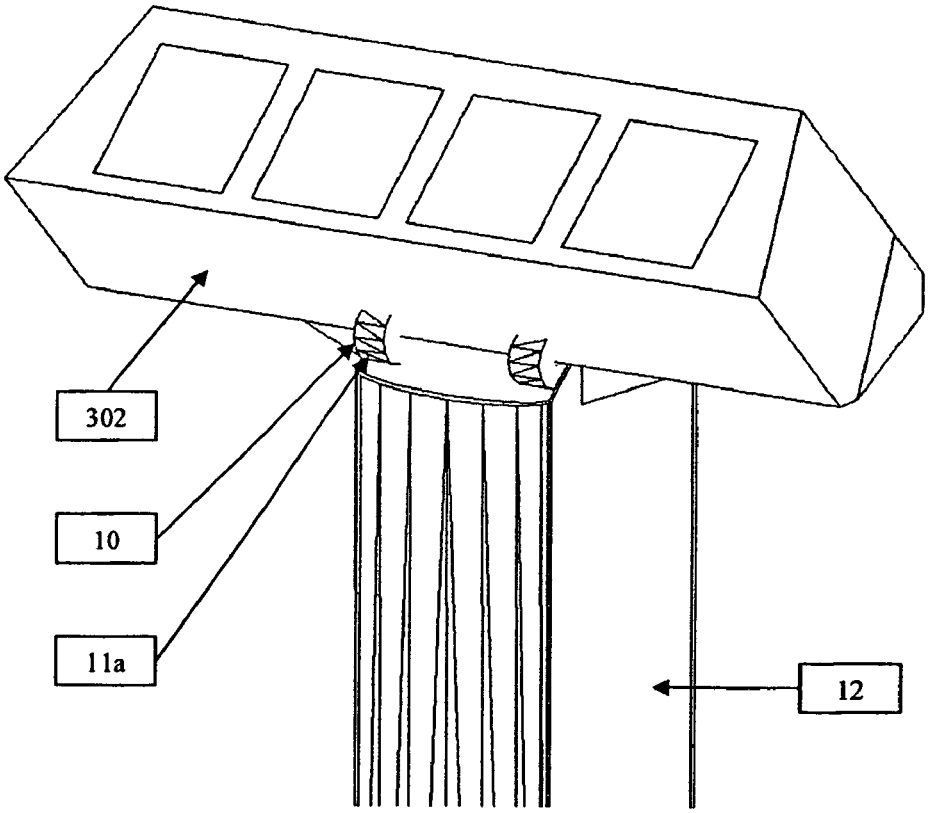

FIG. 20 is a detailed view of the relative rotation axis of the plenums in a mobile aeraulic isolation device 1*b* according to the invention.

FIGS. 21 to 33A show a third variant of embodiment of a mobile aeraulic isolation device 1*c* according to the invention, provided with:

means for relative movement of the plenums by rotation about a mobile horizontal axis for relative movement connected to both plenums, complementary means for absolute movement of the group of two rigid plenums, of the type with horizontal translation of the mobile horizontal axis for relative movement.

Figure 21:
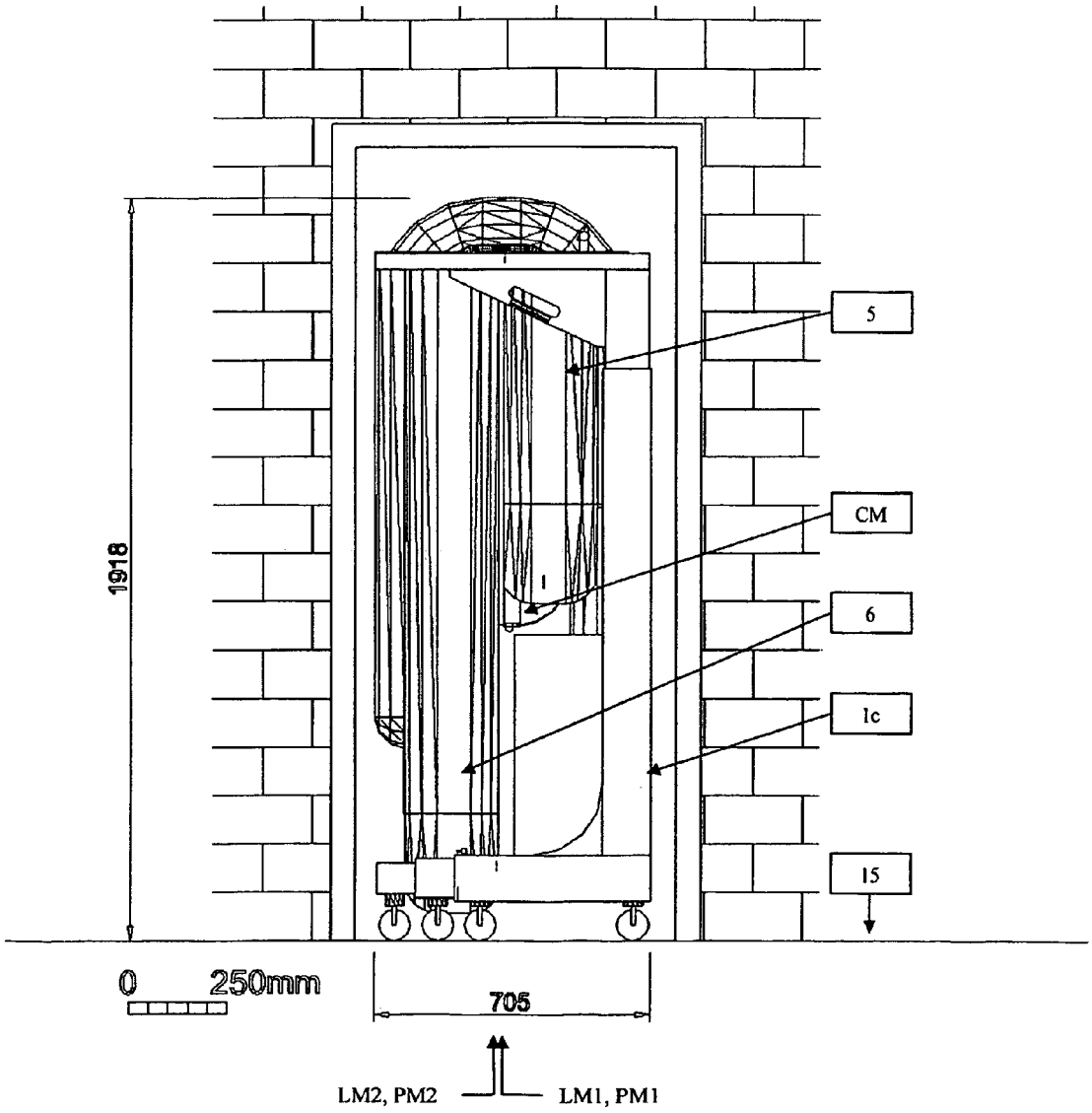

FIG. 21 is a left view of a mobile aeraulic isolation device 1*c* in closed position (for floor movement) passing through a doorway.

Figure 22:
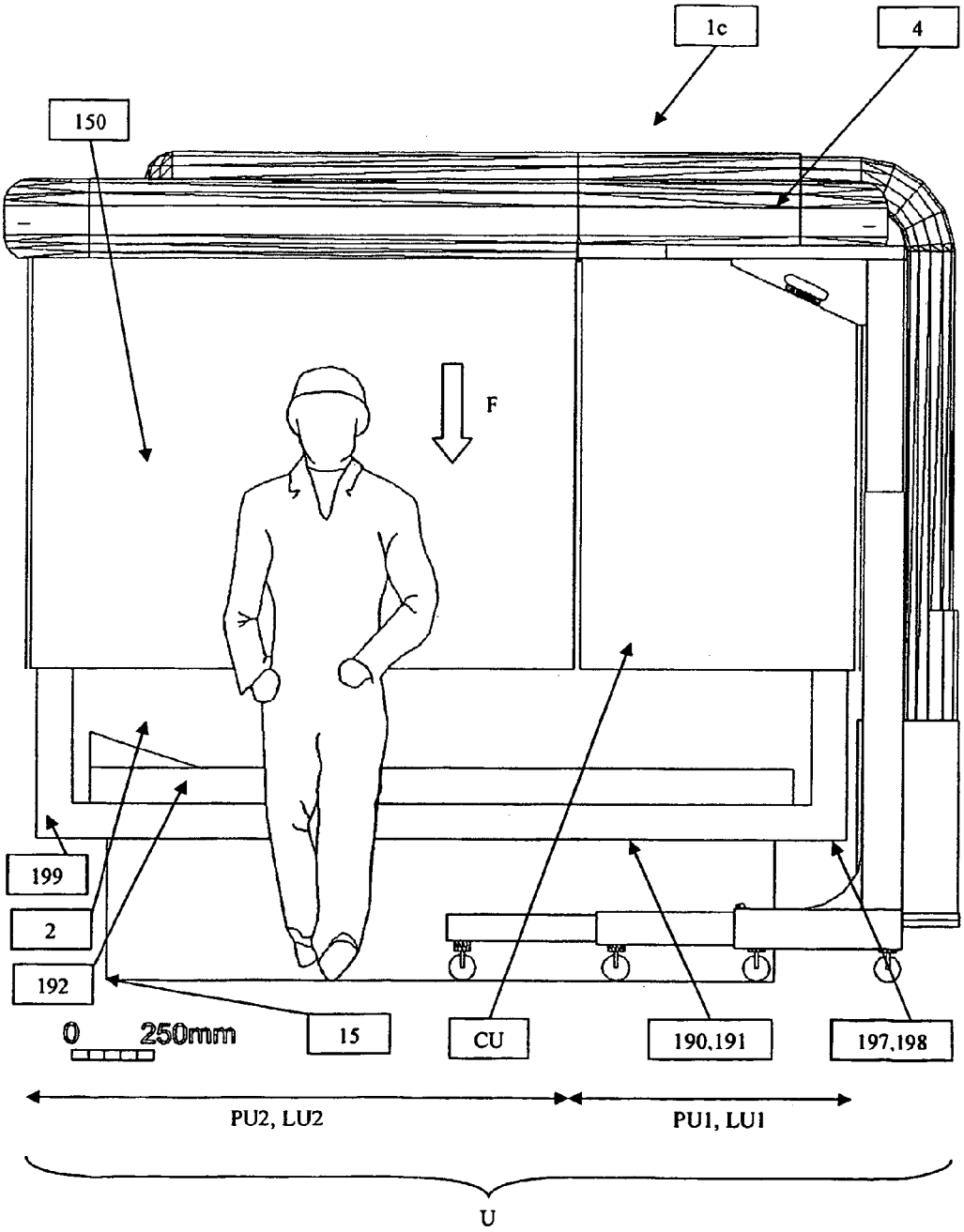

FIG. 22 is a left view of a mobile aeraulic isolation device 1*c* in open position (fixed in use) covering a hospital bed.

Figure 23:
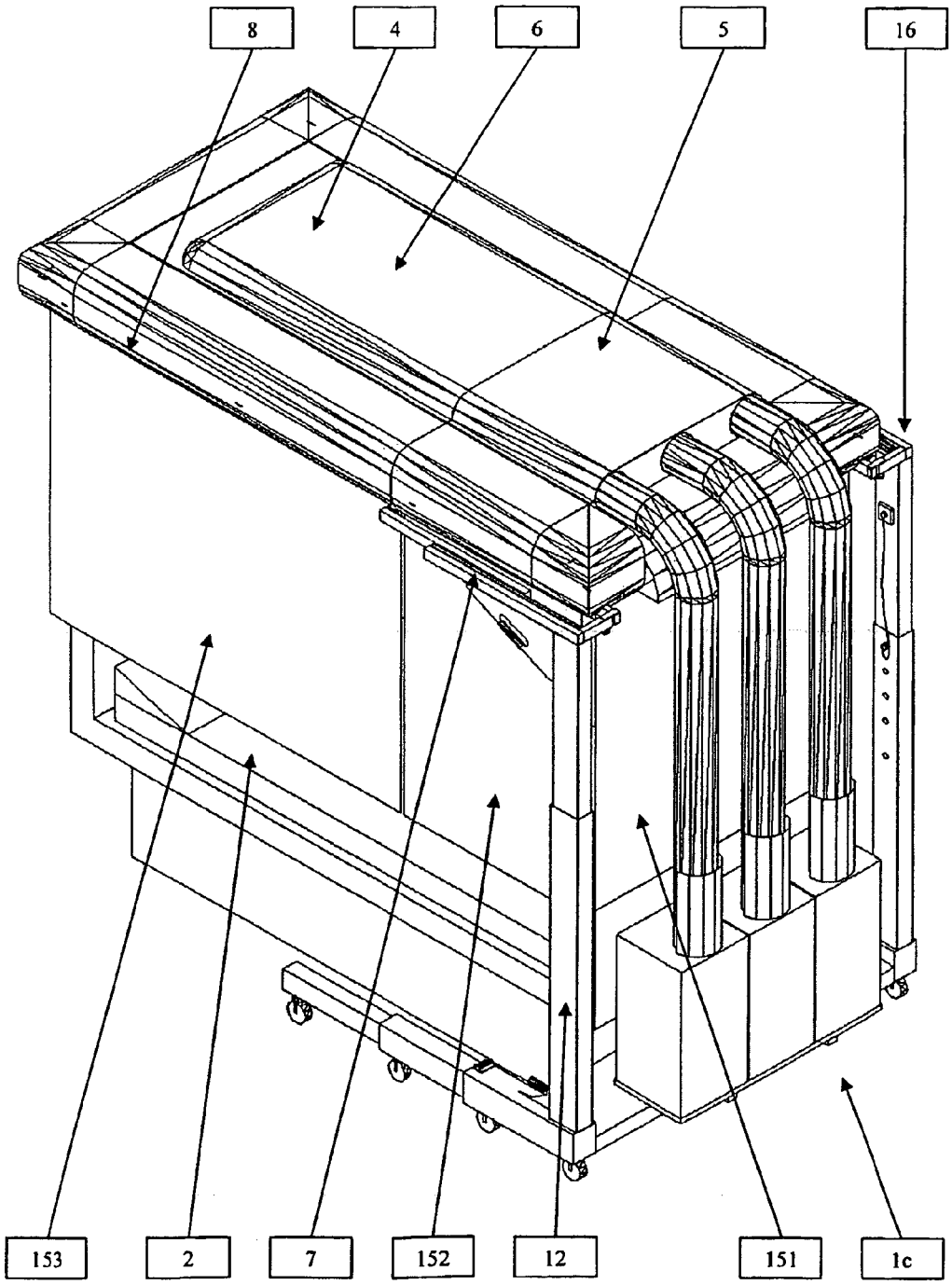

FIG. 23 is a rear perspective view of a mobile aeraulic isolation device 1*c* in open position covering a hospital bed.

Figure 24:
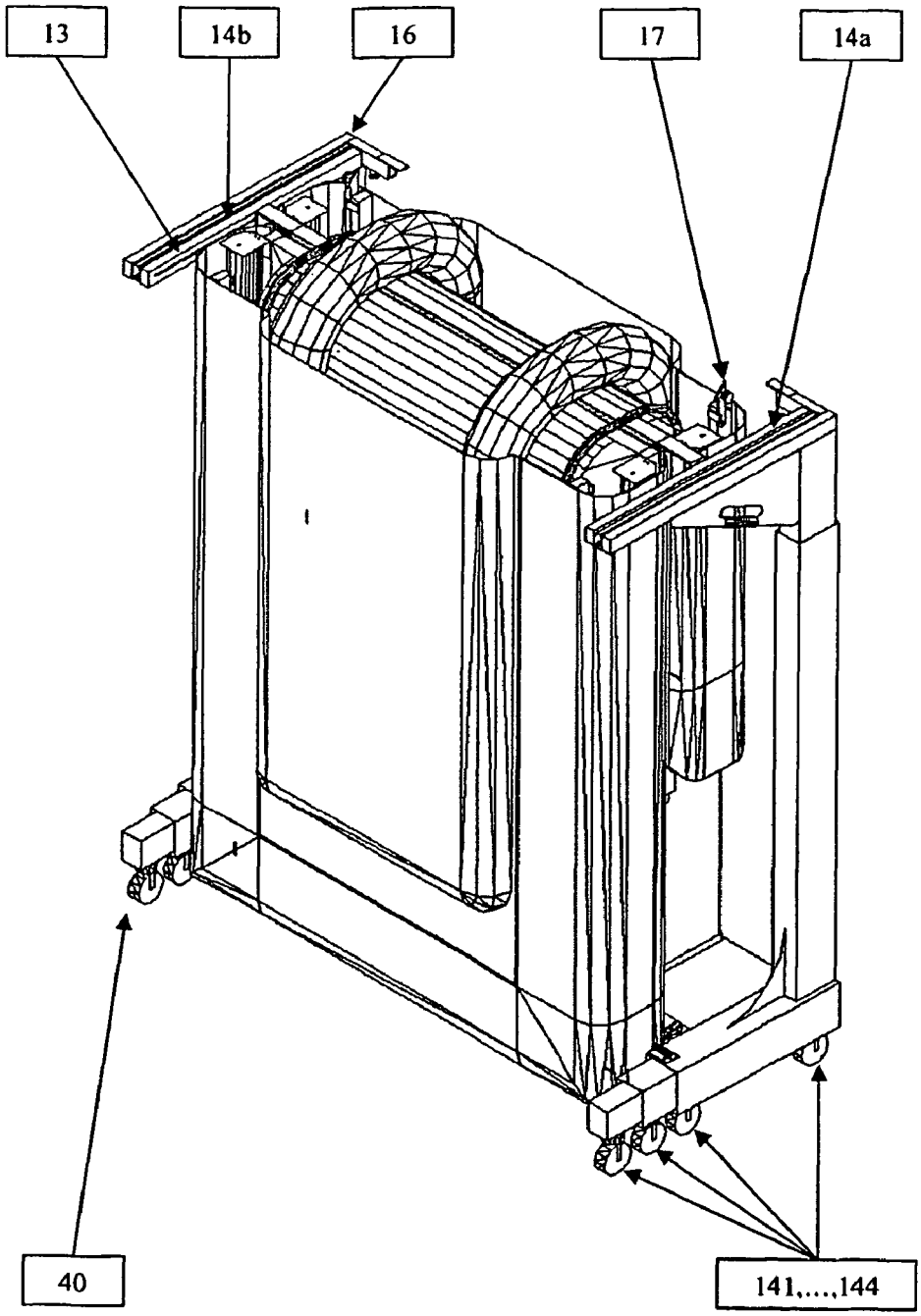

FIG. 24 is a front perspective view of a mobile aeraulic isolation device 1*c* in closed position.

Figure 25:
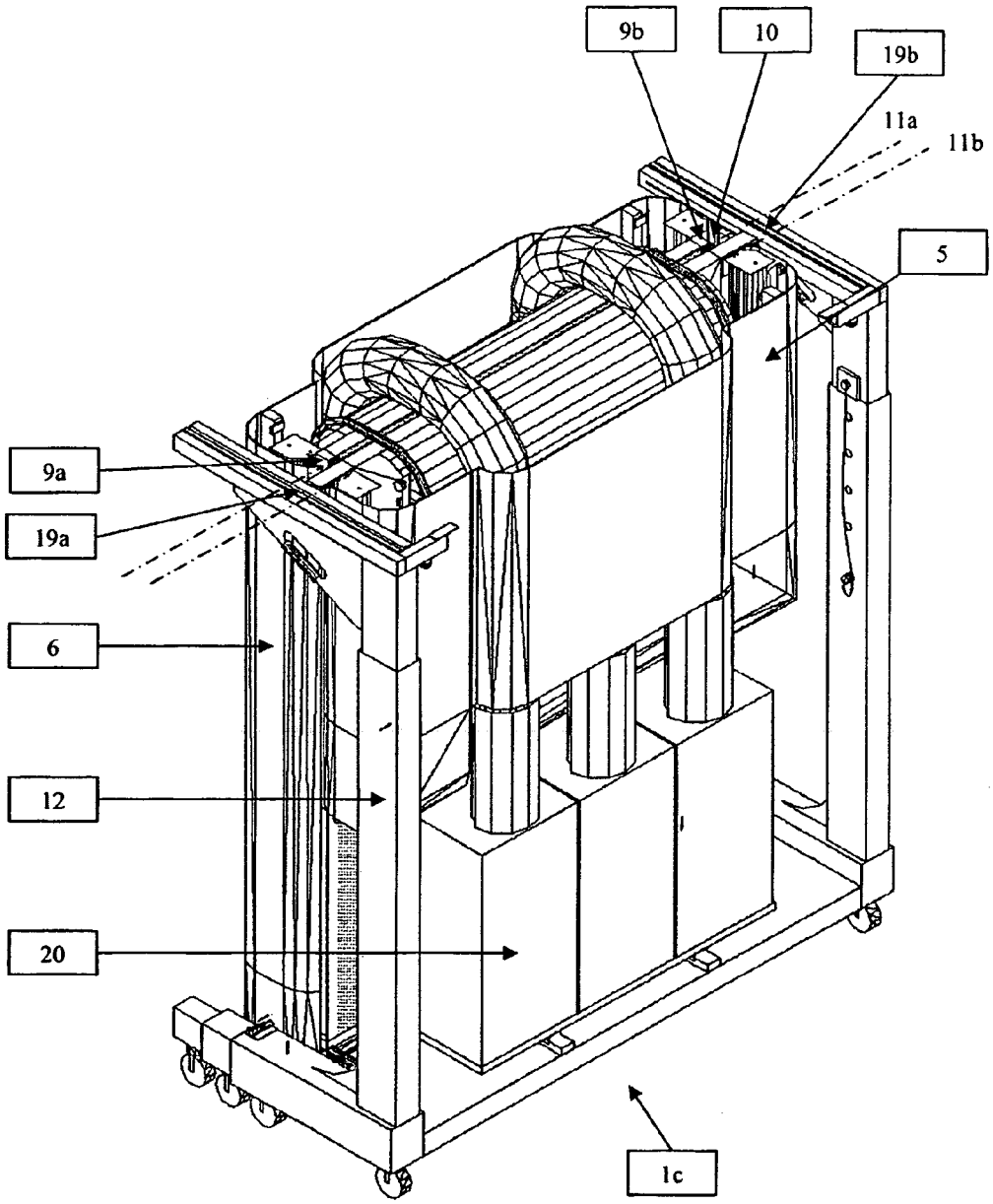

FIG. 25 is a rear perspective view of a mobile aeraulic isolation device 1*c* in closed position.

Figure 26A:
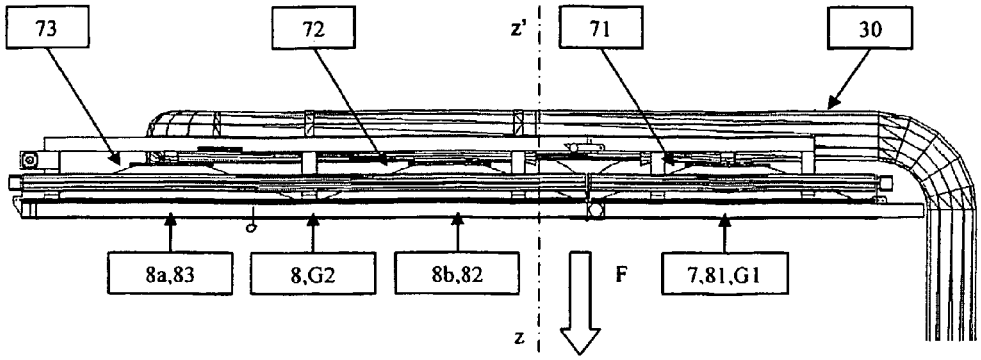
Figure 26B:
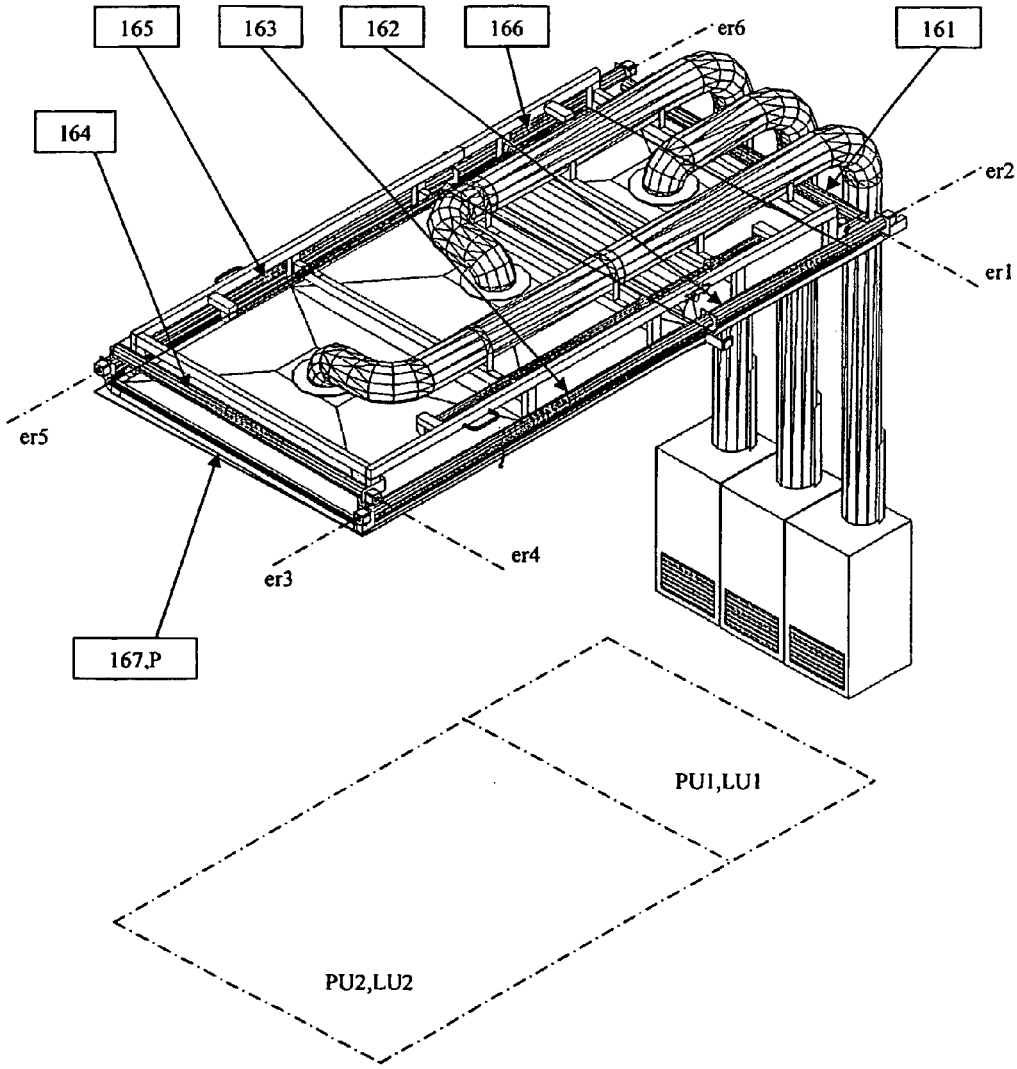

FIGS. 26*a* and 26*b* are left views in upper front perspective of the diffuser of a mobile aeraulic isolation device 1*c* in open position with hoods dismounted.

Figure 27A:
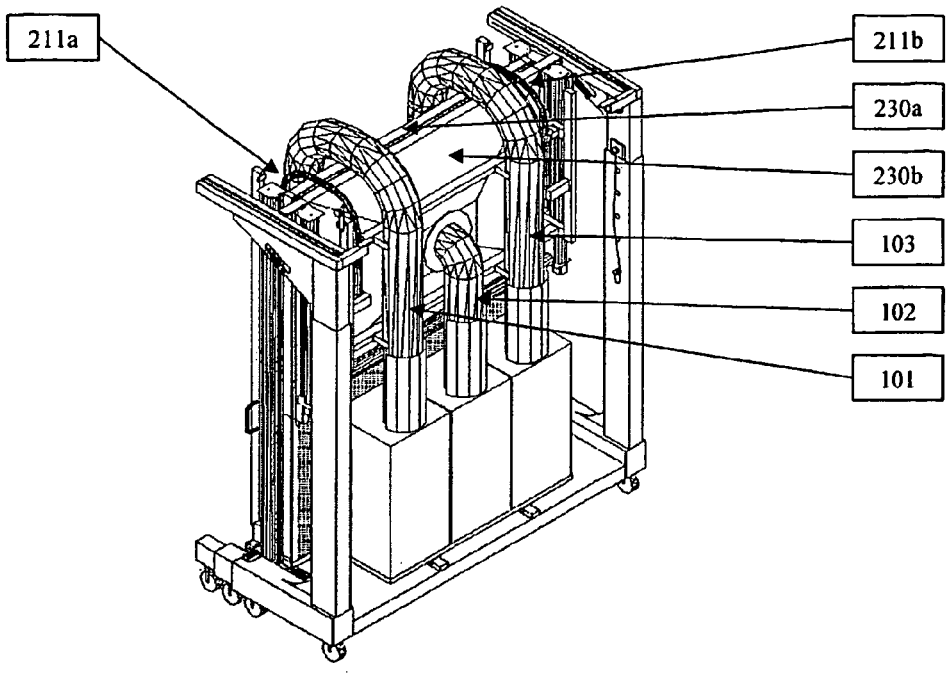

FIG. 27*a* is a front perspective view of a mobile aeraulic isolation device 1*c* in closed position, hoods removed.

Figure 27B:
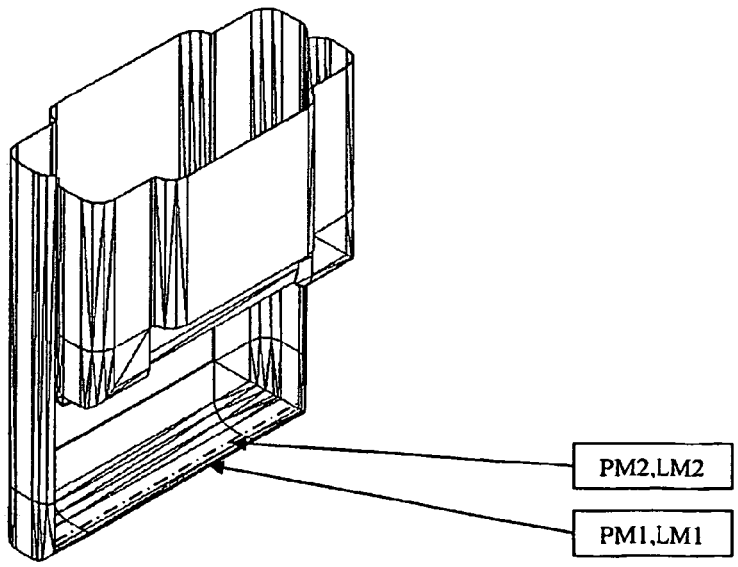

FIG. 27*b* is a front perspective view of the hoods of a mobile aeraulic isolation device 1*c* in closed position.

Figure 28A:
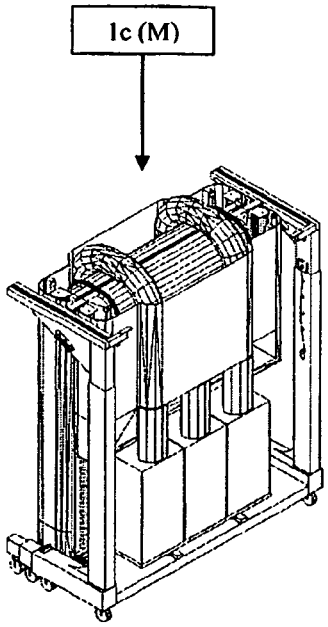
Figure 28B:
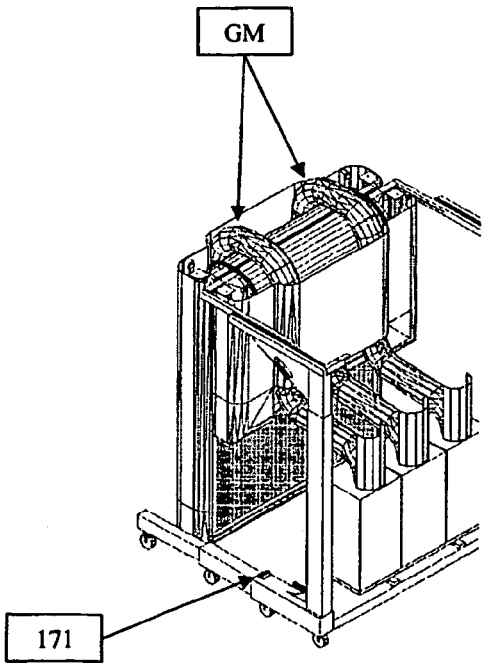
Figure 28C:
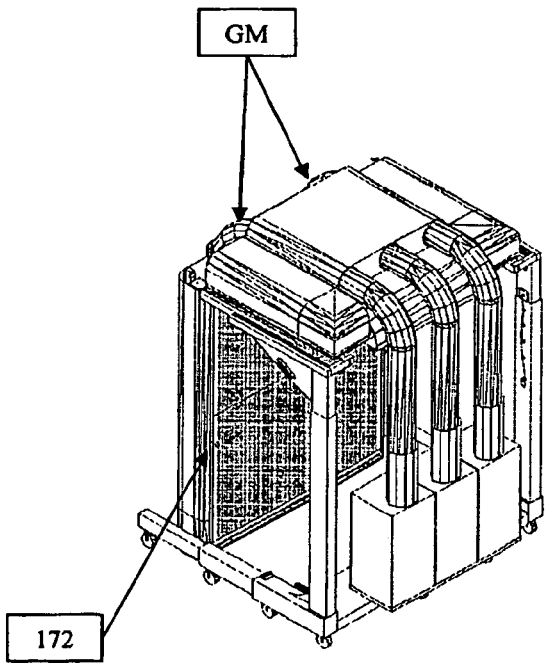
Figure 28D:
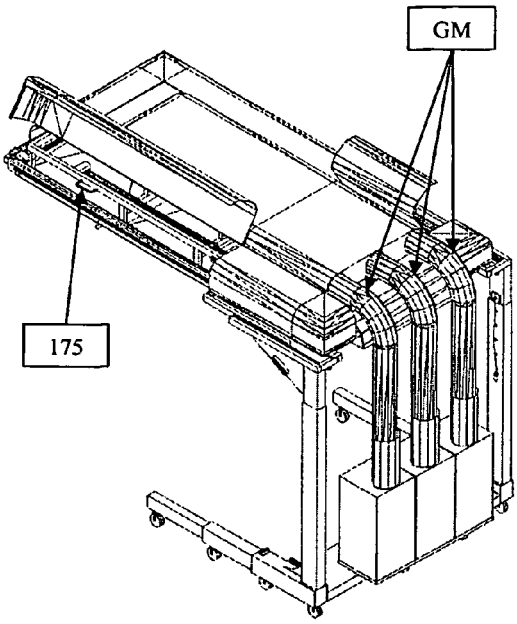
Figure 28E:
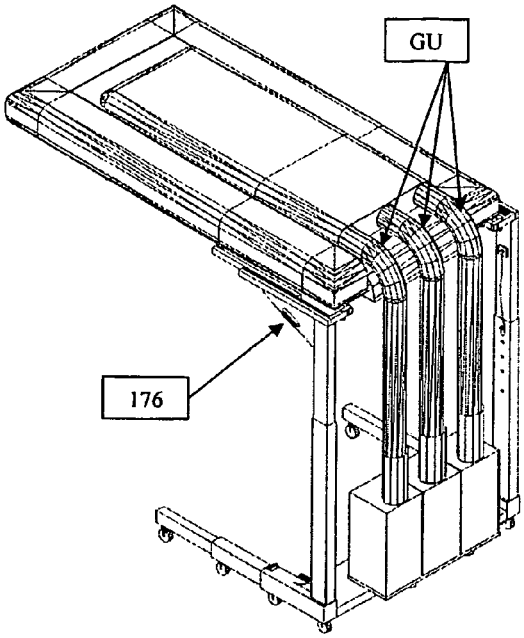
Figure 28F:
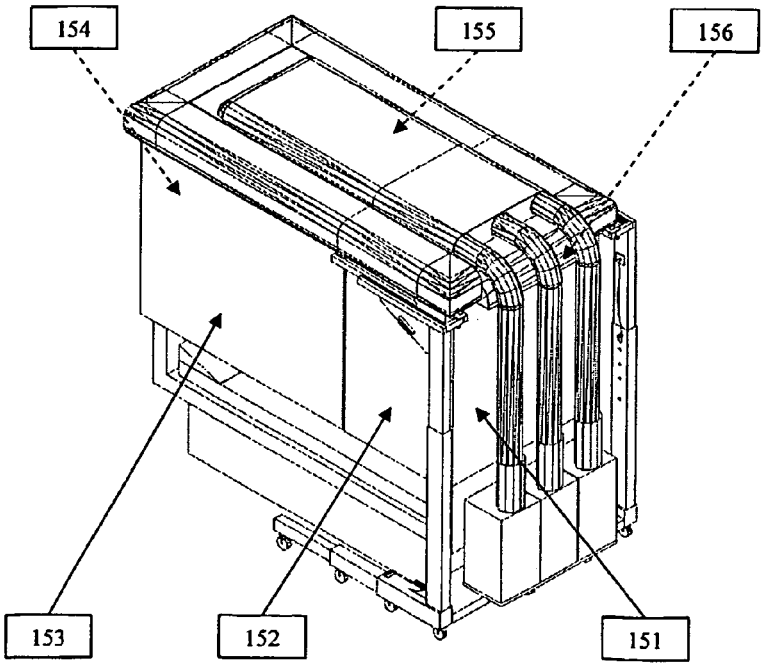

FIGS. 28*a* to 28*f* show the different phases in setting up a mobile aeraulic isolation device 1*c*, from closed position (so-called floor movement position) to open position (so-called fixed in use position):

FIG. 28*a*: closed position next to a hospital bed, left view,

FIG. 28*b*: semi-closed position with rotation axis of plenums brought forward, front perspective view, FIG. 28*c*: semi-closed position: with rotation axis of plenums brought forward and front plenum raised and fixed, front perspective view, FIG. 28*d*: open position, with rotation axis of plenums brought forward, front and back plenums raised and fixed, hoods partially open, in bottom position, front perspective view, FIG. 28*e*: open position with rotation axis of plenums brought forward, front and rear plenums raised and fixed, hoods closed, in top position, front perspective view, FIG. 28*f*: opened, top position on hospital bed, rear perspective view.

Figure 29A:
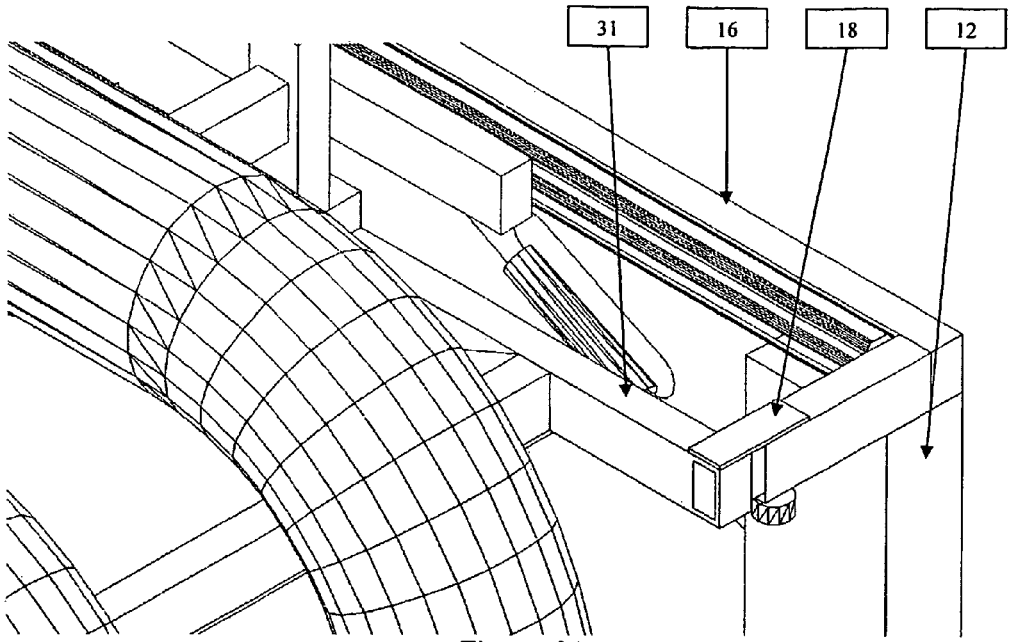

FIG. 29*a* is a detailed view in upper front perspective of the sliding means for the rotation axis of the mobile plenums and of the means for locking the front plenum relative to the chassis.

Figure 29B:
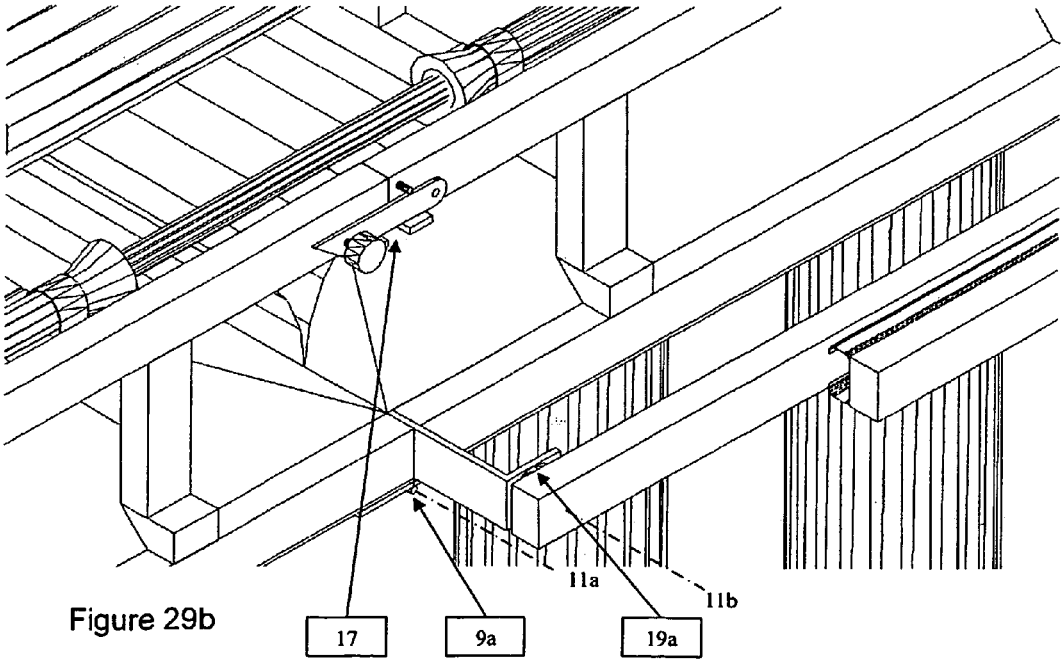

FIG. 29*b* is a detailed view in rear perspective of the mobile, releasable interlocking means of the mobile plenums.

Figure 30A:
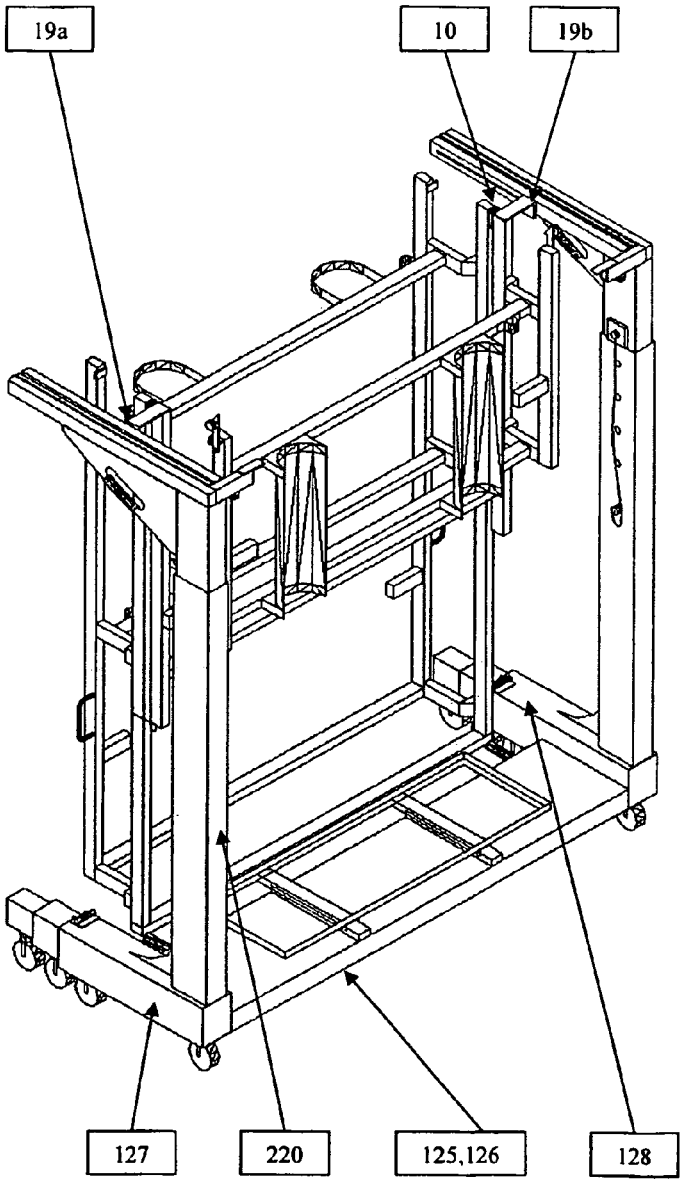
Figure 30B:
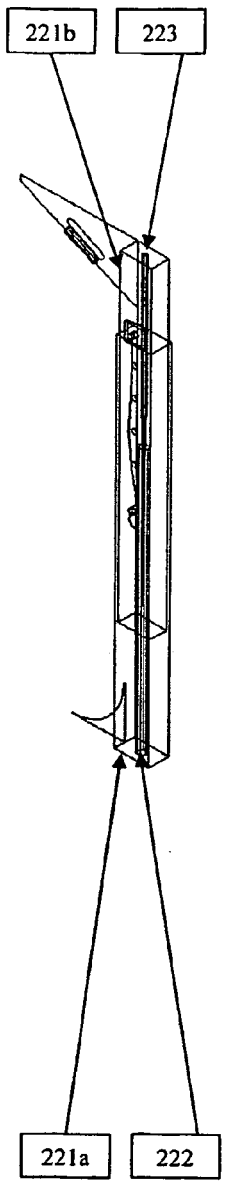

FIGS. 30*a* and 30*b* are front perspective partial left side views of the chassis alone in closed position.

Figure 31:
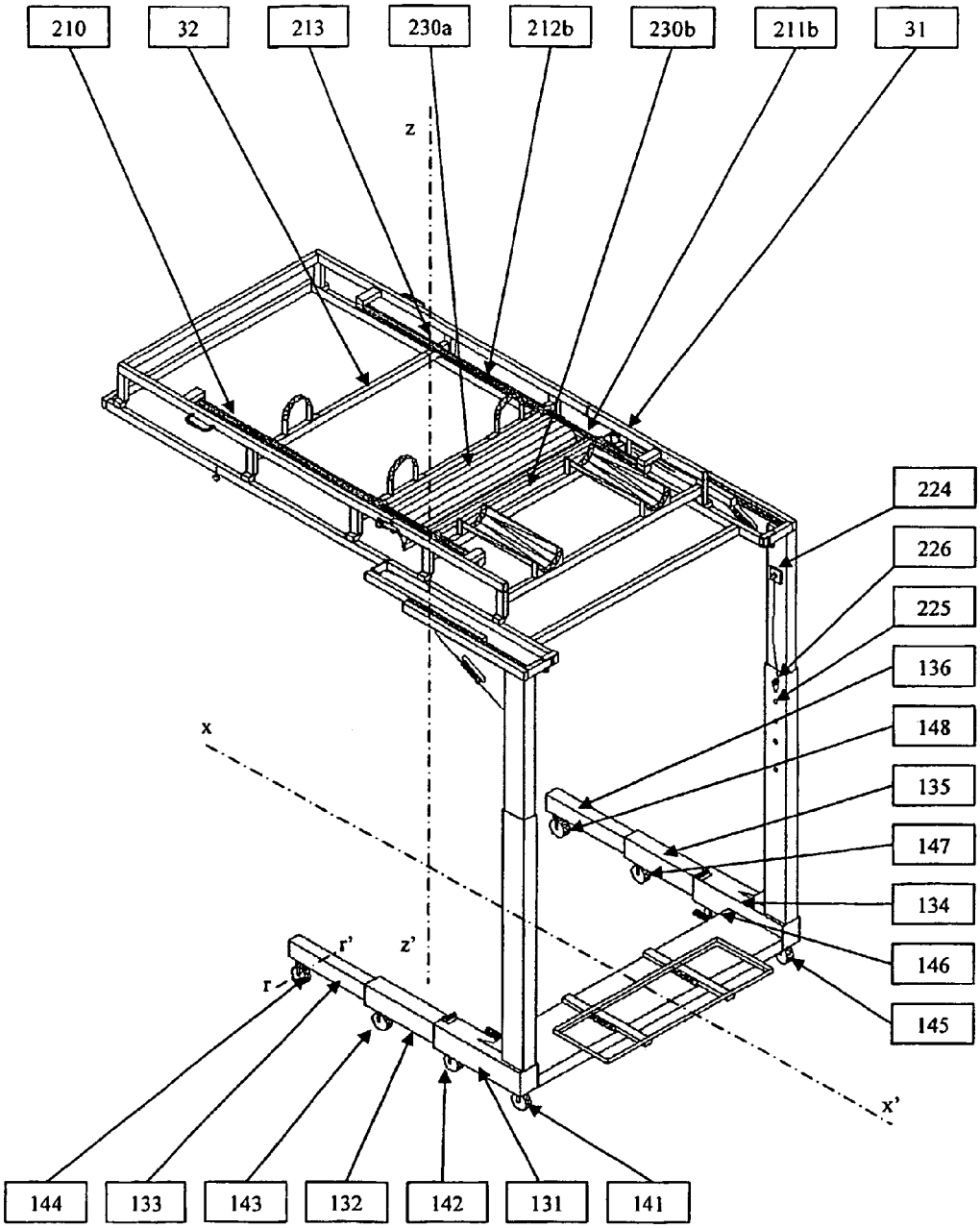

FIG. 31 is front perspective view of the chassis alone in open position.

Figure 32:
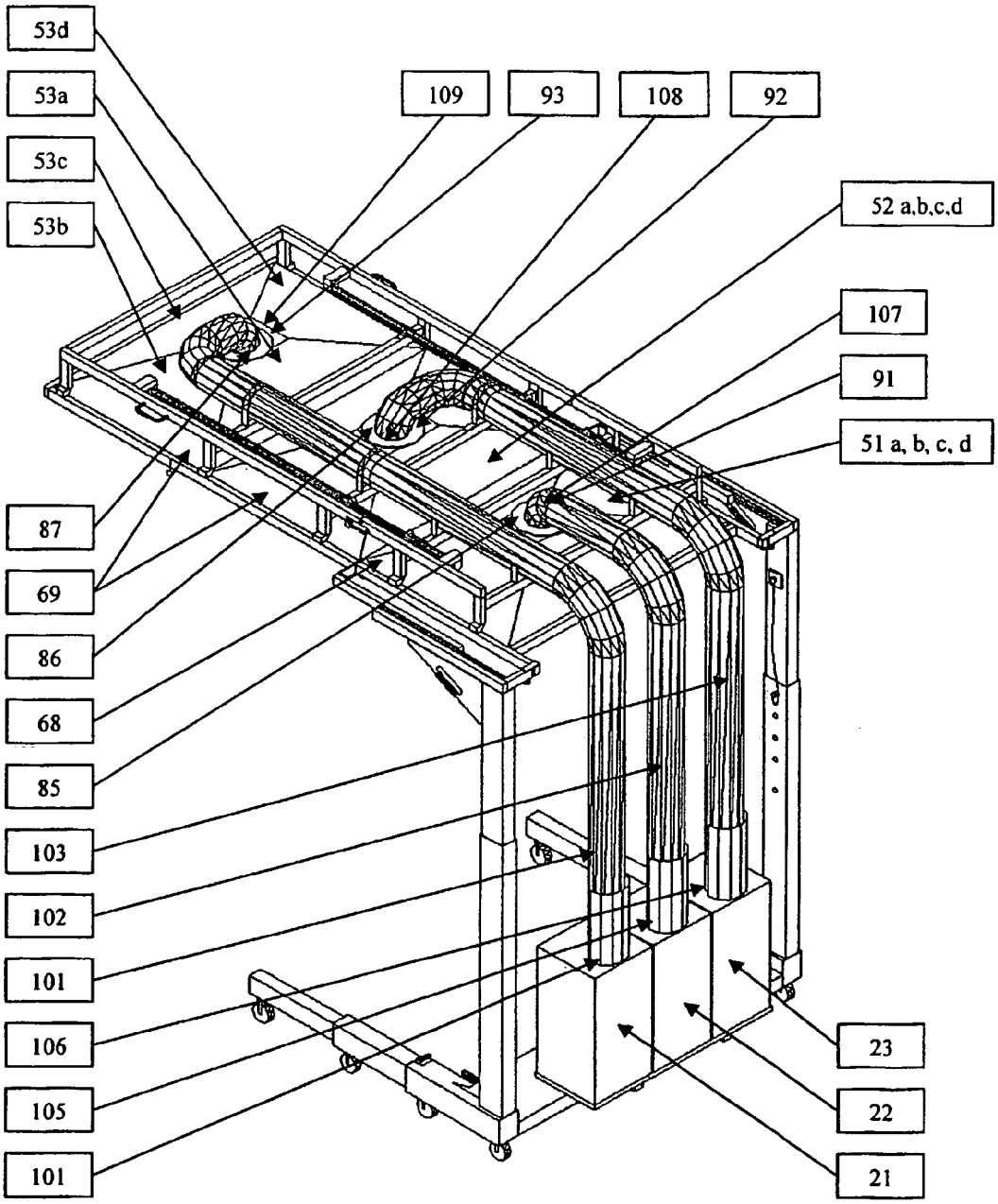

FIG. 32 is front perspective view of the chassis in open position equipped with its plenums, physical decontamination means and aeraulic connection means.

Figure 33A:
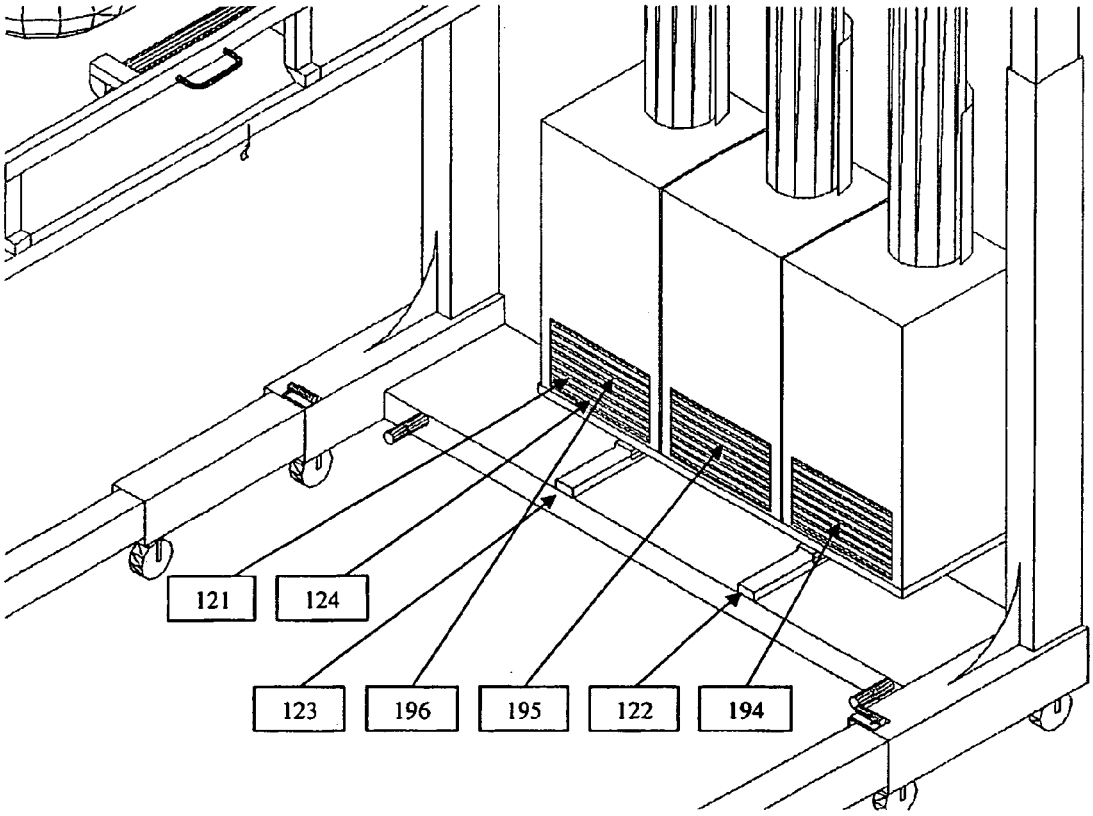

FIG. 33*a* is detailed rear perspective view showing the air intake of the physical decontamination means and the base of the chassis.

Figure 33B:
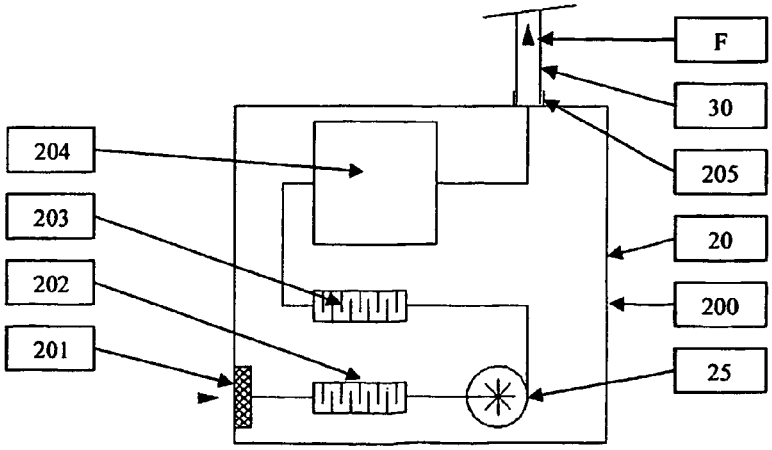

FIG. 33*b* is a schematic diagram of the principle of inner organization of the physical decontamination means.

DESCRIPTION OF THE INVENTION WITH REFERENCE TO THE FIGURES

FIGS. 1 to 10*a* show a mobile aeraulic isolation device 1*a* of the invention in a first variant of embodiment comprising:

means for relative movement 10 of plenums 5,6 of the type in which they slide into one another drawer-fashion, and complementary means for absolute movement 13 of the group of two plenums 5,6, of horizontal rotating axis type 13*a* for absolute movement connected to the upper part of the mobile supporting chassis 12 and to the upstream mobile plenum 5.

Figure 1:
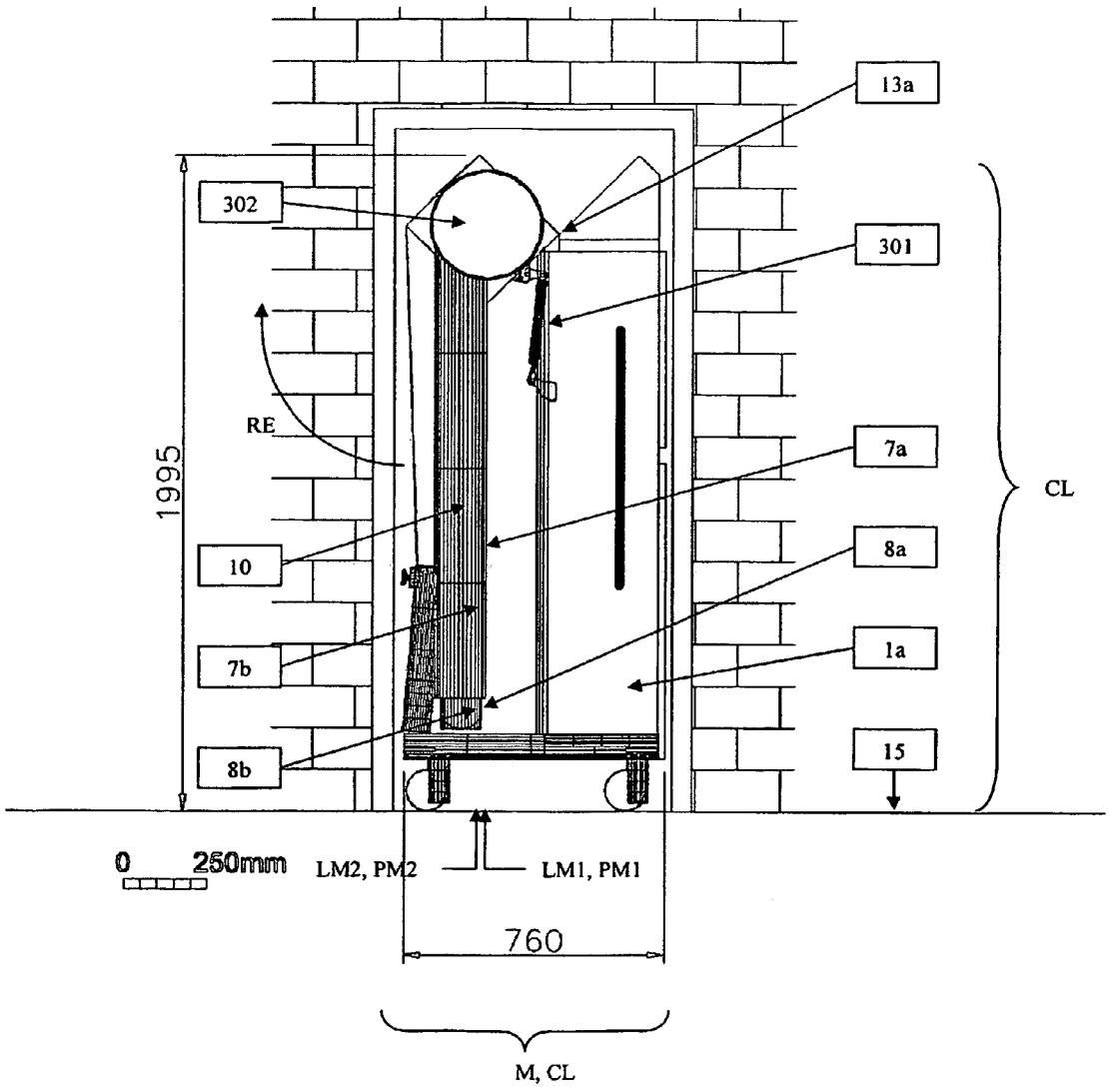
FIG. 1 is a left view of a mobile aeraulic isolation device 1*a*, in closed position (floor movement) passing through a doorway.
Figure 2:
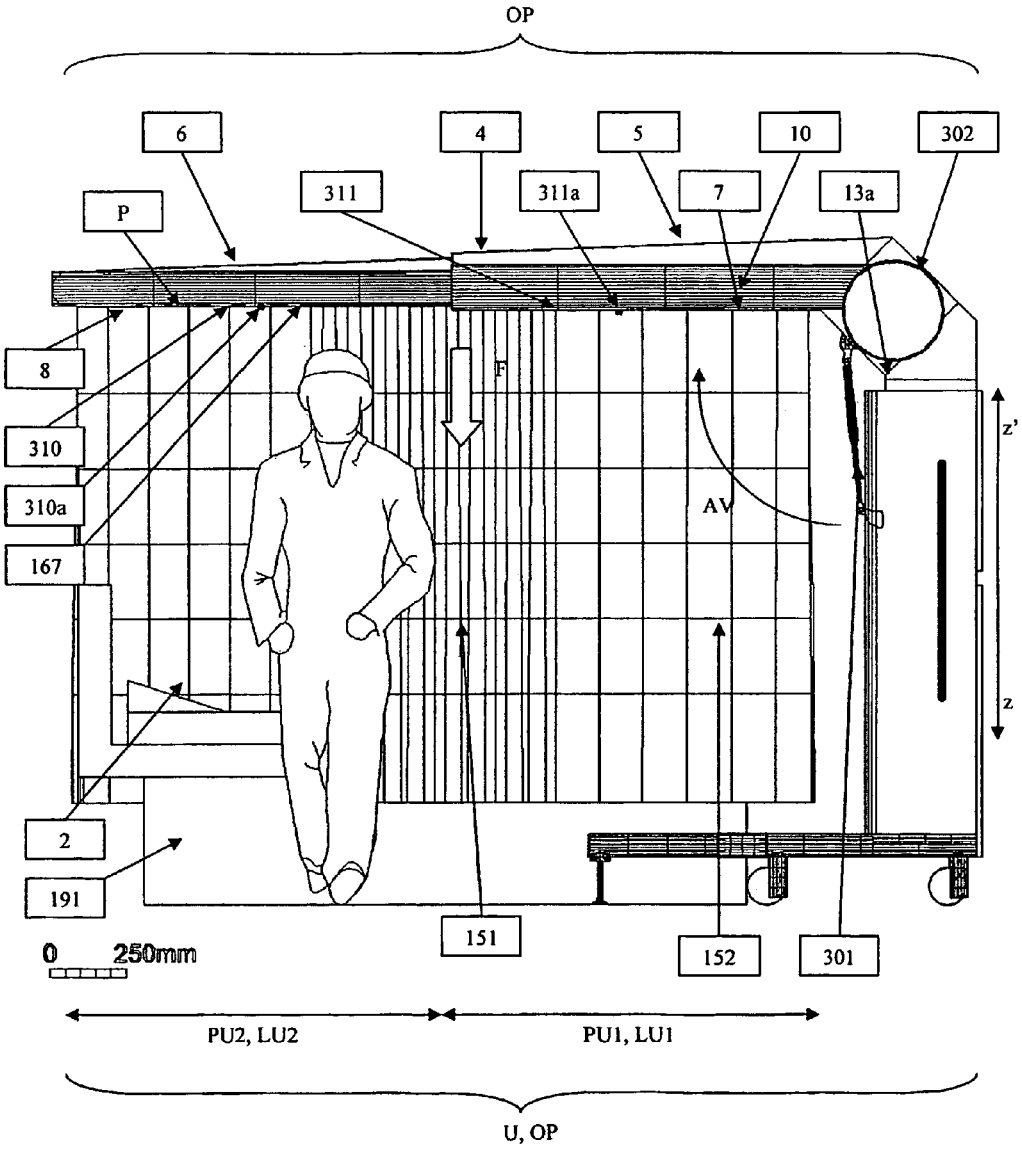
FIG. 2 is a left view of a mobile aeraulic isolation device 1*a*, in open position (fixed in use) covering a hospital bed.

A mobile aeraulic isolation device 1*a* according to this first variant of the invention is shown: in global closed position, so-called floor movement position M in FIG. 1; and in global open position, so called fixed in-use position U covering a hospital bed 191 in FIG. 2. The mobile aeraulic isolation device 1*a* is intended, in open fixed position for use U, to protect a sensitive area 2 formed by the hospital bed in particular 191, against contaminating airborne aerosols (not shown) in the patient's room. It will be subsequently understood that on account of the great mobility of the device 1*a*, the bed 191 to be protected can be located in a hospital or at home. It will also be understood that the mobile aeraulic isolation device 1*a* of the invention may be used to protect any localized sensitive area, an industrial area in particular, and not solely for medical applications.

It will be noted that the mobile aeraulic isolation device 1*a* is equipped with a twin-block air diffusion chamber (or diffuser) 4 of variable geometry type. With reference to FIGS. 7 and 8, it can be seen that the diffusion chamber 4 of the isolation device 1*a* is formed of two rigid air diffusion plenums, one upstream 5 and the other downstream 6 mechanically joined to one another and mobile relative to one another. Each of the two rigid plenums 5,6 is delimited by an outer envelope 5*a*, 6*a*, of substantially parallelepiped shape with rectangular cross section 5*b*, 6*b* delimiting a hollow inner volume. As shown in FIG. 7, each envelope 5*a*, 6*a* of plenums 5,6 has a lower air diffusing surface 7,8 substantially planar and porous to air to enable the diffusion of air through it. Such as shown in FIG. 8, each envelope 5*a*, 6*a*, at one first contact end at least 5*c*, 6*c*, is provided with a first free end contacting surface 5*e*, 6*e* substantially perpendicular to the corresponding diffusing surface 7,8, surrounded by so-called intermediate rectangular ring joint plane 5*d*, 6*d* whose size and geometry is substantially identical for both rigid plenums 5,6.

With reference to FIGS. 9*e* to 9*h*, it can be seen that the mobile aeraulic isolation device 1*a* is fitted with means for relative movement 10 of the first upstream mobile plenum 5 relative to the other second mobile downstream plenum 6. This makes it possible to move and position plenums 5,6 relative to one another in at least two distinct relative positions.

In a so-called open relative position (OP) shown in FIGS. 2, 7, 9*g* and 9*h*, the first diffusing surface 7 of the first upstream mobile plenum 5 is substantially coplanar and abutting substantially in the extension of the second diffusing surface 8 of the second downstream mobile plenum 6. Also, intermediate joint planes 5*d*, 6*d* of the mobile plenums (hidden in the figures) are immediately adjacent so that mobile plenums 5,6 are hermetically coupled.

In another closed relative position (CL) shown in FIGS. 1, 5 and 9*a* to 9*e*, the first diffusing surface 7 of the first upstream mobile plenum 5 does not lie in the extension of diffusing surface 8 of the second downstream mobile plenum 6. The intermediate joint planes 5*d*, 6*d* (hidden in the figures) of the mobile plenums are distanced from one another and uncoupled.

In exploded view FIG. 8 it can be seen that the mobile aeraulic isolation device 1*a* is equipped with physical decontamination means 20,21,22,23 for moving air passing through it, and with air pressurizing means 25, in particular a fan 330. Aeraulic connection and air circulation means 30 formed by a hollow parallepid column 331 and an upper distribution caisson 332 joined to it, aeraulically connect the air pressurizing means 25, physical decontamination means 20,21,22,23 and a second free intake surface 5*f* of the first upstream plenum 5 of the two rigid plenums 5,6 of air distribution chamber 4. The second downstream mobile plenum 6 has a second closed end surface 6*f*.

As shown in FIG. 2, the flow of air F is therefore forced to pass through porous, air diffusing surfaces 7, 8 when the two plenums 5,6 are in open position OP and hermetically coupled and when air pressurizing means 25 are activated.

FIG. 8 in particular shows that the mobile aeraulic isolation device 1*a* comprises a mobile supporting chassis 12, mechanically connected to the two rigid plenums 5,6 of air diffusion chamber 4, to the physical air decontaminating means 20,21,22 23, to air pressurizing means 25 and to the aeraulic connection means 30 formed by a hollow parallelepiped column 331 and upper distribution caisson 332. The mobile supporting chassis 12 is equipped (described below) with horizontal movement means 40 for the chassis 12 relative to floor 15.

One first essential provision, characteristic of the invention is apparent in FIGS. 1 and 2. It will be seen that mobile aeraulic isolation device 1*a* comprises complementary means for absolute movement 13 of the group of two rigid plenums 5,6 relative to the supporting chassis 12. It arises from the kinematics diagram of the opening process shown in FIGS. 9*a* to 9*h*—using the combined action of relative movement means 10 for mobile plenums 5,6 relative to one another and of complementary means 13 for absolute movement of the group of two plenums 5,6—that the first rigid plenum 5 and second rigid plenum 6 for air diffusion are both mobile both relative to one another and relative to chassis 12.

A second essential provision, characteristic of the invention is that the opening kinematics of mobile aeraulic isolation device 1*a* via the combination of relative movement means 10 and absolute movement means 13 make it possible to position mobile plenums 5,6 in at least two global positions relative to chassis 12.

In a so-called fixed in-use global position U regarding sensitive area 2 shown in FIGS. 2 and 9*h*, the two plenums 5,6 are placed in relative open position OP via relative movement means 10. So that the first diffusing surface 7 of the first upstream mobile plenum 5 is substantially coplanar and abutting substantially in the extension of the second diffusing surface 8 of the second downstream mobile plenum 6. The intermediate joint planes 5*d*, 6*d* positioned inside the mobile plenums are immediately adjacent. The mobile plenums 5, 6 are coupled. This is hidden in the figures. And as shown in FIGS. 9*g* and 9*h* the group of two plenums 5,6 in relative open position OP is by combination placed in absolute (horizontal) position distanced (AV) from chassis 12 through absolute movement means 13. In this way, the first mobile diffusing surface 8 of the first upstream mobile plenum 5 and the second mobile diffusing surface 7 of the second downstream mobile plenum 6 are horizontal and positioned facing the floor 15 but away from it. As shown in FIG. 2 the consequence is that the flow of clean air F passing through diffusing surfaces 7,8 is diffused in a substantially vertical air direction zz' covering sensitive area 2. Also, it will be noted that the projection surface PU1 on floor 15 of the first mobile diffusing surface 7 and the projection surface PU2 on floor 15 of the second mobile diffusing surface 8 are of respective maximum size LU2, LU1.

In the other global position, so-called floor movement position M, shown in FIGS. 1, 4, 5 and 9*a*, the two plenums 5,6 are placed in closed relative group position CL via relative movement means 10. In this relative position the first diffusing surface 7 of the first upstream mobile plenum 5 does not lie in the extension of diffusing surface 8 of the second downstream mobile plenum 6. Also, intermediate joint planes 5*d*, 6*d* of mobile plenums 5,6 are distanced from one another and uncoupled. This is masked in the figures. The group of two plenums in closed relative position CL is at the same time placed in absolute (vertical) recessed position RE relative to chassis 12 via absolute movement means 13. In this way, the floor projection surface PM1 of the first mobile diffusing surface 7 of the first upstream mobile plenum 5 and the floor projection PM2 of the second mobile diffusing surface 8 of the second downstream mobile plenum 6 are of minimum size LM1, LM2 (here zero) both much smaller than their maximum sizes LU2, LU1 mentioned above.

With reference to FIGS. 1 and 2, it is found that relative movements means 10 for rigid plenums 5,6 of the mobile aeraulic isolation device 1*a* ensure relative movement of the two rigid plenums 5,6 relative to one another in at least two distinct relative positions. In open relative position OP shown in FIG. 2, the first diffusing surface 7 of the first mobile plenum 5 is substantially coplanar and abutting with the second diffusing surface 8 of the second mobile plenum 6. A third characteristic of the invention is that, in addition, in the closed relative position CL shown in FIG. 1, the first diffusing surface 7 of the first upstream mobile plenum 5 is substantially opposite the second diffusing surface 8 of the second downstream mobile plenum 6. It will indeed be understood that since the second downstream plenum 6 slides inside the first upstream plenum 5, their diffusing surfaces 7,8 are opposite one another. Also, it is seen that relative movement means 10 for plenums 5,6 is mobile relative to chassis 12 via complementary absolute movement means 13 for the group of two rigid plenums 5,6, and in absolute movement between the two absolute recessed RE and distanced AV positions.

A fourth provision, characteristic of the recommended use of mobile aeraulic isolation device 1*a* of the invention lies in the fact that its relative movement means 10 for plenums 5,6 shown in more detail in FIGS. 6*a* and 7, is made up of drawer-fashion sliding means 11*c*. This is achieved through side sliding rails 334 ensuring this sliding of envelope 6*a* of the second downstream mobile plenum 6 inside envelope 5*a* of the first upstream mobile plenum 5. On account of this drawer-like recessing, it will be understood that in closed relative position CL the outer 7*a* and inner 7*b* surfaces of first diffusing surface 7 of the first upstream mobile plenum 5 and the inner 8*a* and outer 8*b* surfaces of second diffusing surface 8 of the second downstream mobile plenum 6 are stacked in alternate manner.

A fifth provision, characteristic of recommended use of the mobile aeraulic isolation device 1*a* of the invention, consists of providing it with complementary sealed closing means 300 in closed relative position CL. These are shown in FIG. 6*a* in open position OP. But it will be understood that these complementary sealed closing means 300 come into sealed contact with the first free contact surface 5*e* positioned at the first contact end 5*c* of the first rigid upstream plenum 5 when the two rigid plenums 5,6 are in closed relative position CL and the intermediate joint planes 5*d*, 6*d* (not visible in the figure) of mobile plenums 5,6 are distanced from one another and uncoupled. The complementary sealed closing means 300 of the first free contact surface 5*e* positioned at the first contact end 5*c* of the first rigid plenum 5 are formed by a second rectangular ring joint closing plane 6*g* surrounding the second closed end surface 6f of the second mobile plenum 6. The latter is pinned in sealed manner against a second rectangular ring joint closing plane 5*g* outwardly surrounding the first free end contacting surface 5*e* positioned at the first contact end 5*c* of envelope 5*a* of the first rigid plenum 5; at the same time when the two mobile plenums 5,6 are in closed relative position CL. This fifth characteristic provision makes it possible to use the mobile aeraulic isolation device 1*a* according to two size geometries for the diffusion chamber and floor surface area, and for different surfaces of sensitive area 2. In particular, it can be used with the plenums in open position OP to protect an adult patient's bed, positioned longitudinally—and with the plenums in closed position CL to protect a cot, positioned crosswise.

A sixth provision, characteristic of recommended use of the mobile aeraulic isolation device 1*a* of the invention is shown in FIG. 10*a*. It consists of equipping it with gravity effect compensation means 301 (jacks in particular) to offset the weight of mobile plenums 5,6 in their movement relative to the chassis 12. This facilitates opening operations between absolute recessed position RE and absolute distanced position AV. These gravity effect compensation means 301 are integral both via one of the ends 301*a* of upstream mobile plenum 5 and via the other end 301*b* of supporting chassis 12.

A seventh provision, characteristic of recommended use of the mobile aeraulic isolation device 1*a* of the invention is shown in FIG. 8. It consists of arranging the physical decontamination means 20,21,22,23 equipping the mobile aeraulic isolation device 1*a* opposite a second free intake surface 5*f* of at least one of the two rigid plenums 5,6, in particular the first upstream plenum 5. According to the described variant of the mobile aeraulic isolation device 1*a*, the physical decontamination means 20,21,22,23 are placed in a decontamination caisson 302 placed opposite the second free intake surface 5*f* of the first rigid plenum 5. This decontamination caisson 302 is mechanically integral with and hermetically connected with this corresponding second free intake surface 5*f* of envelope 5*a* of the first upstream plenum 5. So that physical decontamination means 20,21, 22,23 are mobile relative to chassis 12 through the complementary absolute movement means 13 of the group of two plenums 5,6. The decontamination means 20,21,22,23 are pinned against and fixed via their rear surface to a supporting plate 336 pierced with air passage holes. This bearing plate 336 is itself fixed around its edges to decontamination caisson 302.

An eighth provision, characteristic of recommended use of the mobile aeraulic isolation device 1*a* of the invention is also shown in FIG. 8. This shows a downstream group of muffling elements 313*b* positioned downstream from the air pressurizing means 25 and formed of a plurality of panels 316*a* made of soundproofing material. The panels are arranged vertically and set at intervals inside hollow column 331 of frame 12. Column 331 is closed by two sealed doors 332*a*, 332*b*.

A ninth provision, characteristic of recommended use of the mobile aeraulic isolation device 1*a* is shown in FIGS. 3*a*, 4, 5 and 8. According to this first variant of embodiment, the mobile aeraulic isolation device 1*a* comprises complementary absolute movement means 13 for the group of two rigid plenums 5,6 formed of a fixed axis of absolute rotation 13*a* fixed to chassis 12. It will be understood that this arrangement ensures relative rotation movement for physical decontamination means 20,21,22,23 and their caisson 302 relative to supporting chassis 12, from front to back, via the complementary means of absolute movement 13 for the group of two rigid plenums 5,6 around the axis of absolute rotation 13*a*, during their absolute movement between absolute distanced position AV and absolute recessed position RE.

A tenth provision, characteristic of recommended use of the mobile aeraulic isolation device 1*a* is described with reference in particular to FIGS. 3, 4 and 6*b*. It is seen that the mobile supporting chassis 12 of the mobile aeraulic isolation device 1*a* has at its base a lower mobile trolley 125 in the shape of a fork 126 formed of at least two supporting arms 127,128 that are horizontal, parallel and distanced from one another. The supporting arms 127,128 of chassis 12 are made up of several horizontal portions 131,132,133,134, 135,136 connected together and mobile relative to one another. In the described solution, the front mobile portions 133 and 136 pivot about a horizontal axis aj1,aj2 relative to rear horizontal portions 131 and 134. Portions 132 and 135 are sliding sleeves which take part in locking the different portions to one another.

Fixed portions 131, 134 of lower fork 126 of mobile trolley 125 have wheels 141,142,143,144 with a horizontal rotating axis Ir. Mobile portions 133, 136 are fitted with support shoes 335, 336 to improve the equilibrium of the device 1*a* when in in-use position U such as described in FIG. 6*b*.

An eleventh provision, characteristic of recommended use of the mobile aeraulic isolation device 1*a*, is described with particular reference to FIG. 2. The mobile aeraulic isolation device 1*a* comprises vertical channelling means 150 for airflow for in-use position U. These are formed of two transparent plastic curtains 151,152 fixed to linear hanging supports 310,311 integral with the lower part 167 and on the periphery P of diffusing surfaces 7,8 of plenums 5,6 of the air diffusion chamber 4. These linear hanging means 310, 311 are formed of a first linear supporting portion 310 integral with the first upstream plenum 5 and a second linear supporting portion 311 integral with the second downstream plenum 6. SO that the two linear supporting portions 310, 311 are mobile relative to one another through relative movement means 10 and are both mobile relative to chassis 12 through the complementary absolute movement means 13 for the group of two plenums 5,6. In addition, a plurality of mobile hanging rings of quarter turn type 310*a*, 311*a*, are fixed in removable manner on linear supporting portions 310,311. The two curtains 151,152 comprise a plurality of equidistant metal eyelets 310*b*, 311*b* positioned on their upper edge each one engaged in the corresponding rings. This allows for quick fixing and dismounting of the two curtains 151,152 on the periphery P of diffusing surfaces 7,8.

A twelfth advantageous provision for use of the mobile aeraulic isolation device 1*a* is described with reference to FIG. 3*a*. Some of the curtains and in particular the bed-head panel 155*a* of curtain 155 positioned on the second downstream plenum 6, distanced from chassis 12 when opened for use—position OP, comprise at least one portal hole for utilities 312. This portal 312 is formed of a metal frame 155*b* substantially oblong, resting via its edges on panel 155*a* and binding a soft membrane in PTFE 312*a* provided with cross cuts 312*b* for the practically sealed passing of utility tubes 338 such as: oxygen, vacuum, air.

A thirteenth advantageous provision for use of the mobile aeraulic isolation device 1*a* is that, in complementary fashion, the other side surfaces of the two curtains 151,152 are provided, substantially at mid-height, with holes whose closure can be deactivated 340. This enables the passing of small-sized items required for patient care such as trays, instruments. In the embodiment described in FIG. 3*a*, these are of "letter-box flap door" type. They enable the relative overpressure of the isolated area to be maintained above the sensitive surface 2 when inserting or withdrawing items. It is not necessary to open the curtains.

A fourteenth advantageous provision for use of the mobile aeraulic isolation device 1*a* concerns the configuration of its aeraulic means described in FIG. 8. Air pressurizing means 25 and aeraulic connection 30 and air circulation means are positioned inside a vertical hollow column 331 of chassis 12, closed by sealed doors 332*a*, 332*b*. The air intake 342 of device 1*a* is positioned substantially horizontally below and in the lower part 198 of aeraulic connection column 331 of chassis 12 opposite the plane of the sensitive area 2 (floor 15 in particular).

A fifteenth advantageous provision for use of the mobile aeraulic isolation device 1*a* is shown in FIG. 8. It consists of equipping the mobile aeraulic isolation device la with means 313 to muffle noise conveyed by the air chiefly produced by air pressurizing means 25. These sound muffling means 313 are positioned inside the vertical column 331 of chassis 12.

Preferably, these muffling means 313 for air-conveyed noise are made up of two groups of muffling elements 313*a*, 313*b* positioned inside vertical column 331 of chassis 12 of which one 313*a* is positioned upstream and the other 313*b* is positioned downstream from the air pressurizing means 25. The muffling means 313 for air-conveyed noise are preferably according to the invention formed of panels 316 in sound-absorbing material. For this purpose a microbiologically neutral material is advantageously used, such as glass wool panels whose two surfaces and edges are coated with a protective PTFE film. One provision recommended by the invention is that muffling means 313 for air-conveyed noise are made up of:

firstly, an upstream group of muffling elements 313*a*, positioned upstream from air pressurizing means 25 and formed by at least one panel 316*a* of noise absorbing material arranged horizontally, and secondly, a downstream group of muffling elements 313*b*, positioned downstream from air pressurizing means 25 and made up of a plurality of panels 316*a* in noise absorbing material, arranged vertically and distanced from one another inside column 331 of chassis 12.

A sixteenth advantageous provision for use of the mobile aeraulic isolation device 1*a*, concerns an industrial embodiment of the lower air diffusing surface 7,8 of the two mobile plenums 5,6 of the mobile aeraulic isolation device 1*a* described in FIG. 7. According to this embodiment, the lower air diffusing surface 7,8 of the two mobile plenums 5,6 is formed of a plurality of panels 318 (substantially rectangular) made in plastic material (epoxy glass in particular called FR4 routinely used for printed circuits) pierced with a multitude of cylindrical holes 318*a* uniformly distributed over surface 318*b* of each panel 318. Preferably the lower air diffusing surface 7,8 in plastic material of the two plenums 5,6 is formed of a combination between: two frames 321,322 mobile relative to chassis 12, that are substantially rectangular, mechanically and hermetically connected around their periphery P to the lower part of outer envelopes 5*a*, 6*a* of the two plenums 5,6 and provided with a multitude of cross braces 321*a*, 321*b*, 322*a*, 322*b* and with a plurality of panels 318 (substantially rectangular) in plastic material (epoxy glass in particular) pierced with a multitude of cylindrical holes 318*a* uniformly distributed. Panels 318 are placed edge to edge and screwed around their periphery to the cross braces 321*a*, 321*b*, 322*a*, 322*b*.

With reference to FIGS. 2 and 3, a particularly effective application of the invention can be seen.

An aeraulically decontaminated hospital bed 190 of the invention is formed by the combination between:

a bed 191 for an immunosuppressed patient—and a mobile aeraulic isolation device 1*a* of the invention such as described above. Device 1*a* is mounted on a chassis 12. Its air diffuser 4 comprises at least two rigid mobile air diffusion plenums 5,6 mechanically connected to one another. The mobile aeraulic isolation device 1*a* placed in in-use position U. Its plenums 5,6 are in open relative position OP through relative movement means 10 according to which the first diffusing surface 7 of the first mobile plenum 5 is substantially coplanar, abutting and substantially in the extension of the second diffusing surface 8 of the second mobile plenum 6. Also, the group of plenums 5,6 is in absolute distanced position AV relative to chassis 12 through absolute movement means 13 so that the projection surface of the two plenums substantially covers the surface of the bed.

An aeraulically decontaminated hospital bed 190 of the invention is recognisable in particular by the fact that its rigid plenums 5,6 are mobile relative to one another and both plenums are mobile relative to chassis 12 of the mobile aeraulic isolation device 1*a*, 1*b*, 1*c*.

One configuration preferred by the invention for an aeraulically decontaminated bed 190 is remarkable in that mobile chassis 12 of the mobile aeraulic isolation device 1*a* and its decontamination means 20,21,22,23 are arranged at the foot of bed 191, and in that the second rigid downstream mobile plenum 6 for air diffusion the furthest away from chassis 12 is positioned on the side of and above the head of bed 191.

FIG. 3*a* describes a mobile aeraulic isolation device 1*a* in use position U, in which the width of the plenums is substantially equal to the width of bed 191 it is to protect.

A seventeenth advantageous provision for use of the mobile aeraulic isolation device 1*a* is described in FIG. 3*b*. The mobile aeraulic isolation device 1*a* is equipped with plenums whose width is substantially equivalent to 1.5 times the width of bed 191 it protects.

With this provision it is possible to protect the sensitive area, such as the patient and the bed together with accessories, furniture (chair, console, hygiene equipment, . . . ) and monitoring or treatment devices. This also allows attending staff or visitors to be included under the flow, thereby limiting opening and closing of the curtains and providing improved protection.

FIGS. 11 to 20 show a mobile aeraulic isolation device 1*b* of the invention in a second variant of embodiment comprising:

relative movement means 10 for plenums 5,6 of the type with rotation about a mobile horizontal axis for relative movement 11*a* connected to both plenums 5,6, complementary means for absolute movement 13 of the group of two plenums 5,6 of the type with horizontal rotating axis 13*a* connected to the upper part of mobile supporting chassis 12 and to the upstream mobile plenum 5.

A mobile aeraulic isolation device 1*b* according to this second variant of the invention is shown: in global closed position, so-called floor movement position M in FIG. 11—and in global open position, so-called fixed in-use position U covering a medical bed 191 in FIG. 12.

It will be seen that the aeraulic isolation device 1*b* of this second variant identically reproduces most particular aspects of aeraulic isolation device 1*a* described above in the first variant. The common elements are denoted with the same references in drawings 11 to 20. It appears unnecessary to repeat their description.

AN eighteenth advantageous provision for use of the mobile aeraulic isolation device 1*b* is seen in FIGS. 13,14 and 15. Its relative movement means 10 for plenums 5,6 is formed by a relative rotation axis 11*a* around a hinge connected respectively to each of the first two contact ends 5*c*, 6*c* of the envelope of plenums 5,6.

This hinge forming the relative rotation axis 11*a* is shown in more detail in FIG. 20. It will be understood that the relative rotation axis 11*a* of mobile plenums 5,6 is itself mobile relative to mobile supporting chassis 12 via the complementary means 13 of absolute movement for the group of two plenums 5;6

A nineteenth advantageous provision for use of the mobile aeraulic isolation device 1*b* is shown in FIGS. 13,14,16 and 17. The mobile aeraulic isolation device 1*b* comprises mobile releasable means 17,305,306 for relative interlocking of rigid plenums 5,6 in their relative movement. They are formed of interlocking elements 305*a*, 305*b*, 306*a*, 306*b* integral with plenums 5,6 ensuring firstly their locking in open relative position OP, so that mobile plenums 5,6 are coupled rigidly and hermetically and their first and second diffusing surfaces 7,8 are coplanar, and ensuring secondly their unlocking for placing in closed relative position CL. It will be seen that the different interlocking elements 305*a*, 305*b*, 306*a*, 306*b* of this mobile releasable relative interlocking means 17 of plenums 5,6 are integral with plenums 5,6 and fully mobile relative to mobile supporting chassis 12 via relative movement means 10 and complementary absolute movement means 13.

FIG. 17 shows that device 1*b* also comprises a second group of interlocking elements 303,304 for the first upstream plenum 5 relative to chassis 12. These are intended to ensure locking of the group of two plenums 5,6 in absolute forward position AV, and when released to ensure closing in absolute recessed position RE during rotation around the horizontal rotating axis of absolute movement 13*a*.

FIGS. 21 to 33*a* show a mobile aeraulic isolation device 1*c* of the invention in a third variant of embodiment comprising:

relative movement means 10 for plenums 5,6 of the type with rotation around a mobile horizontal axis of relative movement 11*a* connected to both plenums 5,6, and complementary means of absolute movement 13 for the group of two plenums 5,6 of the type with horizontal translation of the mobile horizontal axis of relative movement.

A mobile aeraulic isolation device 1*c* of this third embodiment is shown: in closed global position, so-called floor movement position M in FIG. 21, and in open global position so-called fixed in-use position U covering a hospital bed 191 in FIG. 22.

It is seen that the aeraulic isolation device 1*c* of this third variant identically reproduces most of the particular aspects described above for the first variant 1*a* of the invention. The common elements are denoted with the same references in drawings 21 to 33*a*. It appears unnecessary to repeat their description.

The aeraulic isolation device 1*c* comprises relative movement means 10 for the plenums formed of: two hinges 9*a*, 9*b* integral with two abutting edges of plenums 5,6, and pivots 19*a*, 19*b* shown in FIGS. 25 and 29*b* (whose functioning is described in detail below). They allow the second rigid downstream mobile plenum 6 for air diffusion to be folded relative to the first rigid air diffusing upstream plenum 5 of diffuser 4. Therefore the second rigid mobile downstream plenum 6 can be folded relative to chassis 12 and in at least two distinct relative positions, one so-called fixed in-use position U shown in FIG. 22 and the other so-called movement position M over floor 15 shown in FIG. 21.

With reference to FIGS. 26*a* and 26*b* it is seen that the two rigid plenums 5,6 are formed of diffusing caissons 71,72,73 delimited by side surfaces 51*a/b/c/d*, 52*a/b/c/d*, 53*a/b/c/d* that are independent (do not directly communicate)so as to delimit two inner volumes 68,69 of disjoined plenums 5,6. In the particular case described, the downstream plenum 6 is itself formed of two diffusing caissons (as described below). This increases the number of side surfaces of downstream plenum 6. But it will be understood that the downstream plenum 6 formed of its two caissons 72,73 is entirely closed, disjoined and non-communicating with the upstream plenum 5 itself formed of caisson 71. This arrangement in multiple caissons recommended by the invention increases the homogeneity of the airflow and enables modulated flow adjustment between the different areas.

In the variant of the invention shown in the drawings and recommended by the invention, the first rigid upstream plenum 5 and the second rigid downstream plenum diffusing air are both mobile and adjustable relative to chassis 12 in two distinct relative positions.

In fixed in-use position U above bed 191 shown in FIG. 22, the first mobile diffusing surface of the first upstream plenum 5 and the second diffusing surface 8 of the second downstream plenum 6 are horizontal and positioned facing the floor at a distance from it. In this in-use position the airflow F passes through the two diffusing surfaces 7,8 in a substantially vertical air direction zz' and entirely covers the sensitive area 2. It is seen that in this in-use position the projection surface PUl over floor 15 of the first mobile diffusing surface 7 and the projection surface PU2 over floor 15 of the second mobile diffusing surface 8 have a maximum size of LU1,LU2.

In the other floor movement position M shown in FIGS. 21,27*b*, the floor projection surface PM1 of the first mobile diffusing surface 7 of the first mobile plenum 5 and floor projection PM2 of the second mobile diffusing surface of the second mobile plenum 6 are zero and are therefore of minimum size LM1,LM2. The two diffusing surfaces 7,8 are vertical.

Relative movement means 10 formed of two hinges 9*a*, 9*b* and pivots 19*a*, 19*b* shown in FIGS. 25 and 29*b* enable movement of the first 5 and second 6 rigid diffusion plenums both relative to chassis 12 and relative to one another.

Physical air decontamination means 20 of moving air crossing through them ensure decontamination of airborne aerosols. In the variant shown, air pressurizing means 25 are seen, FIG. 33*b*, formed of a fan 25 fitted to each of physical decontamination means 20.

Also, aeraulic connection 30 and air circulation means aeraulically connect air pressurizing means 25, physical air decontamination means 20 and the two rigid air diffusing plenums 5,6 of air diffuser 4. They force the airflow F to pass through the porous air diffusing surfaces 7,8.

FIG. 24 shows a mobile supporting chassis 12 bearing the entire mobile aeraulic isolation device 1*c*. It is mechanically connected to the two rigid plenums 5,6 of air diffuser 4, to the physical air decontamination means 20, to the air pressurizing means 25 and to the aeraulic connection means 30. It is provided with horizontal movement means 40 for chassis 12 relative to the floor, formed of casters (141 .148).

With reference to FIG. 25 it is seen that the relative movement means 10 is made up of two rotation axes 11*a*, 11*b* formed by two hinges 9*a*, 9*b* cooperating with two pivots 19*a*, 19*b* shown FIG. 29*b*. The plenum rotation axis 11*a* substantiated by hinges 9*a*, 9*b* allows rigid plenums 5,6 to move relative to one another. The rotation axis 11*b* relative to the frame substantiated by pivots 19*a*, 19*b* allows rotation of both rigid plenums 5,6 relative to frame 12.

With reference to FIGS. 21 and 25, it is seen that the two rotation axes 11*a*, 11*b* of rigid plenums 5,6 are positioned horizontally relative to floor 15. Also, in the so-called floor movement position M shown in FIGS. 21 and 25 both rigid plenums 5,6 are hinge folded around plenum rotation axis 11*a* so that the first mobile diffusing surface 7 of the first mobile upstream plenum 5 is facing and is opposite the second mobile diffusing surface 8 of the second mobile downstream plenum 6.

Horizontal sliding means 13 of rotation axis 11*b* of plenums 5,6 relative to frame 12 are fitted to device 1*c*. They are formed of two extendable horizontal slide rails 14*a*, 14*b* of "drawer" type integral with the chassis and positioned in its upper part. The two pivots 19*a*, 19*b* slide horizontally on rollers along and between the two slide rails 14*a*, 14*b*.

In floor movement (or closed) position M shown in FIGS. 21 and 25, the two rigid plenums 5,6 are fodled relative to hinges 9*a*, 9*b* so that the first mobile diffusing surface 7 of the first mobile upstream plenum 5 faces and is opposite the second mobile diffusing surface 8 of the second mobile downstream plenum 6.

With reference to FIGS. 23 and 24 it is seen that the horizontal sliding means 13 of rotation axes 11*a*, 11*b* of rigid plenums 5,6 between themselves and relative to chassis 12 comprise two extreme sliding positions. In in-use position U shownn in FIG. 23, the first mobile diffusing surface 7 of the first upstream plenum 5 and the second mobile diffusing surface 8 of the second downstream plenum 6 are horizontal. Rotation axes 11*a*, 11*b* of rigid plenums 5,6 are in so-called forward position. So that plenums 5,6 are away from the so-called rear portion 16 of chassis 12 that is the furthest from the centre of sensitive area 2. In floor move position M shown FIG. 24 the first mobile diffusing surface 7 of the first mobile upstream 5 faces and is opposite the second mobile diffusing surface 8 of the second mobile downstream plenum 6. The two diffusing surfaces 7,8 are vertical. Rotation axes 11*a*, 11*b* of rigid plenums 5,6 are in so-called near-rear position close to the so-called rear portion 16 of chassis 12. So that plenums 5,6 are close to the so-called rear portion of chassis 12 the furthest away from the centre of sensitive area 2.

With reference to FIGS. 28*d*, 29*b* and 32 it is seen that device 1*c* comprises mobile releasable interlocking means 17 for rigid plenums 5,6 in aligned in-use position U so that the first and second diffusing surfaces 7,8 of plenums 5,6 are coplanar. These mobile releasable interlocking means 17 are integral with the two side frame parts 31,32 supporting the two plenums and therefore with the two sliding pivots 19*a*, 19*b*. So that the mobile releasable interlocking means 17 are mobile during horizontal sliding of said rotation axis 11*b* of rigid plenums 5,6 relative to chassis 12.

Referring to FIG. 29*a*, it is seen that device 1*c* comprises releasable locking means 18 to chassis 12 for frame part 31 which bears mobile plenum 5 and is closest to the so-called rear portion 16 of chassis 12, when in aligned in-use position U. So that in in-use position U the diffusing surface 7 is horizontal and fixed relative to chassis 12. On account of prior activation of mobile releasable interlocking means 17, the diffusing surface 8 is also fixed in horizontal position relative to chassis 12.

FIGS. 21, 24, 25, 26*a*, 26*b*, 27*a*, 29*b* and 31 show means 210 to aid extension of plenums 5,6 recommended by the invention. They are formed of tensioning means, springs in particular 211*a*, 211*b*, positioned above plenums 5,6 housed in casings 212*a*, 212*b* themselves fixed at their base and maintained in position by collars 213 on frames 31,32 of plenums 5,6. Springs 211*a*, 211*b* are taut when device 1*c* is in floor movement position M and released in fixed in-use position U.

Their bending at hinge 10 is guided by shaped parts 230*a*, 230*b* described below. Retraction of springs 211*a*, 211*b* offsets the weight of plenums 5,6 and aids their extension until they reach their coplanar in-use position U.

Shown in transparency in FIG. 30*b* are adjustment means 220 for the height of plenums 5,6 recommended by the invention. Each of the two vertical side posts of chassis 12 is similar. FIGS. 30*b* and 31 describe the right post 221. It is formed of two hollow coaxial telescopic uprights 221*a*, 221*b* which fit into one another by vertical translation. Inside uprights 221*a*, 221*b* is a pressure-tared jack 22 to offset the weight of the height-adjustable mobile assembly, and a wedge-block 223 integral with the upper upright 221*b* ensuring size adjustment for jack installation, jack 22 itself being integral with lower upright 221*a*. Uprights 221*a*, 221*b* have lower height adjustment via position stop 224 and upper adjustment via the stroke of jack 222. A range of holes 225 with pegs 226 ensures the maintaining and adjustment of height position for plenums 5,6.

FIGS. 24, 25, 26*a*, 26*b*, 27*a* show bending means both for the tubes of aeraulic connection means 30 and for springs 211*a*, 211*b* when device 1*c* is in floor movement position M. They are formed of quarter-circle shaped parts 230*a*, 230*b* integral with frames 31,32 of plenums 5,6 and on which they bend during folding. These shaped parts provide the tubes of aeraulic connection means 30 with sufficient curve radius so that they are not excessively deformed when in floor movement position M.

In FIGS. 26*a*, 26*b*, 27*a*, 32 the truncated pyramid shape can be seen of diffuser caissons 71,72,73. This provides improved dispersion of airflow F while enabling the installation of shaped parts 230*a*, 230*b* between plenums 5,6. FIGS. 26*a*, 26*b*, 27*a* and 32 show the aeraulic connection 30 and air circulation means which comprise a plurality of aeraulic lines 101,102,103.

With reference to FIGS. 23, 25, 26*b*, 27*a*, 33A it is seen that each aeraulic line is connected (directly or indirectly) by a first end 104,105,106 to one of physical air decontamination means 21,22,23. Each aeraulic line 101, 102, 103 has a mobile portion 111,112,113 relative to chassis 12. And each aeraulic line 101,102,103 is connected via a second end 107,108,109 to one of mobile plenums 5,6.

FIGS. 26*a*, 26*b* show that the first 5 and second 6 rigid air-diffusing plenum are each formed of a group G1,G2 of at least one closed, air-distribution diffusing caisson 71,72,73. The front plenum 5 is formed of one diffusing caisson 71. Downstream plenum 6 is formed of two caissons 72,73. Each closed diffusing caisson 71,72,73 has a so-called diffusing surface 7,8*a*, 8*b* covered by a wall in diffusing material 81,82,83 porous to air. As shown in detail in FIG. 32, each caisson 71,72,73 has another so-called supply surface 85,86,87 each fitted with an air intake collar 91,92, 93. The other (side) surfaces 53*a/b/c/d* . . . of caissons 73 . . . are solid. The diffusing caissons 72,73 of the first rigid plenum 6 are mobile relative to supporting chassis 12 and to caissons 71 of the second rigid plenum 5 via relative movement means 10 and pivots 19*a/b*.

FIG. 32 shows that device 1*c* comprises three physical decontamination means 21,22,23 aeraulically independent. Aeraulic connection means 30 comprise three independent networks of aeraulic lines 101,102,103 each connecting one physical decontamination means 21,22,23 to one of mobile plenums 5,6.

FIG. 33*a* shows that device 1*c* comprises means 121 for horizontal movement of physical decontamination means 21,22,23 relative to supporting chassis 12. These are formed of two slide rails 122,123 that are horizontal and integral with chassis 12 on which a mobile frame 124 slides horizontally. Physical decontamination means 21,22,23 are positioned on and fixed onto mobile frame 124.

It is seen that horizontal movement means 121 for physical decontamination means 21,22,23 relative to supporting chassis 12 have two extreme positions. In in-use position U shown in FIGS. 22, 23, 28*c*, 28*d*, 31, 32 and 33 physical decontamination means 21,22,23 are recessed relative to centre of gravity CU of the mobile isolation device 1*c*. On the contrary, in floor movement position M shown in FIGS. 21, 24, 25, 27*a*, 28*a* and 30*a* the physical decontamination means are brought forward in direction of the centre of gravity CM of mobile isolation device 1*c*. This makes it possible to increase the stability of device 1*c* in in-use position U, while reducing required floor space in floor movement position M. It is also seen in FIGS. 28*a*, 28*b*, 28*c*, 28*d*, 28*e*, 28*f* that aeraulic connection means 30 have modified geometry GU,GM during extension of plenums 5,6 between floor movement position M and in-use position U.

FIGS. 30*a*, 31, 32 show that mobile supporting chassis 12 comprises a lower mobile trolley 125 that is fork-shaped 126. It is formed of two horizontal, parallel supporting arms 127,128 distant from one another. The supporting arms 127,128 of chassis 12 are formed of several horizontal portions 131,132,133,134,135,136 connected together and mobile relative to one another. In the version recommended by the invention shown in FIGS. 30*a*, 31, 32 the lower mobile trolley 125 in fork shape 126 comprises two supporting arms 127,128 each formed of several horizontal portions 131,132,133,134,135,136 connected together and can slide relative to one another along a horizontal axis x,x'. In another variant, not shown, the lower mobile trolley 125 in fork shape 126 could be fitted with two arms 127,128 each formed of several horizontal portions 131,132,133,134,135, 136 connected together and pivoting relative to one another along a vertical axis of vertical rotation z,z'.

In FIGS. 30*a*, 31, 32 it is seen that lower mobile trolley 125 in fork shape 126 comprises arms 127,128 of which each of horizontal portions 131,132,133,134,135,136 comprises at least one wheel 141,142,143,144,145,146,147,148 with a horizonal rotation axis r,r'. These rotation axes r,r' of the wheels preferably pivot horizontally to facilitate multidirectional movements of device 1*c* over the floor 15 in floor movement position M.

With reference to FIGS. 22, 23, 28*d*, 28*f* it is seen that mobile aeraulic isolation device 1*c* comprises vertical channelling means 150 for airflow for in-use position U comprising curtains 151,152,153 . . . 156 surrounding sensitive area 2 on its four sides. It is seen that curtains 151,12, 153 . . . 156 shown are both mobile relative to chassis 12 during movement between in-use position U and floor movement position M since they are fixed by their upper part around the edge of the two frame portions 31,32 supporting the two plenums 5,6. But they are also mobile relative to at least mobile plenum 5 when they are opened up on the edge of plenums 5,6 particularly in in-use position U. In the configuration shown in FIGS. 26*a*, 26*b* the vertical channelling means 150 for airflow are formed of curtains 151, 152,152 . . . 156 with winders 161,162,163,164,165,166 whose winder axes er1, er2, er3, er4,er5 er6 are positioned at the lower part 167 and on the periphery P of air diffusing plenums 5,6.

In another variant (not shown) vertical channelling means 150 for airflow may be formed of curtains sliding on a rail positioned at the lower part 167 and on periphery P of air diffuser plenums 5,6.

In a further variant (not shown) these channelling curtains comprise a plurality of abutting parallel strips. This facilitates hand access for medical staff to attend a patient in the bed protected by the system 1*c*.

In another variant (not shown) vertical channelling means 150 for airflow also comprise a combination of: detection means (of movement of persons and/or increase in contamination)—and activation means for the level (and/or position relative to plenums) of vertical channelling means 150 of airflow in relation to the measurement taken by the detection means. This makes it possible only to activate the air channelling means, in particular to lower or slide the curtains into active position, when a visitor is present or when there is movement inside the room which risks increasing contamination.

FIG. 22 shows an aeraulically decontaminated bed 190 formed of the combination between: a hospital bed 191—and a mobile aeraulic isolation device 1*c* such as described above. The two rigid air diffusing plenums 5,6 can be seen, mechanically connected to one another and mobile relative to one another. They each have a planar, air-porous air diffusing surface 7,8 in fixed, open in-use position U. The diffusing surfaces 7,8 are coplanar, horizontal and positioned facing the upper part of bed 191 and away from it so as to diffuse an airflow F crossing through them in an air direction zz' substantially perpendicular to mattress 192 of bed 191. As described above, aeraulically decontaminated bed 190 is remarkable in that its rigid plenums 5,6 are delimited by independent side surfaces 51*a/b/c/d*, 52*a/b/c/d*, 53*a/b/c/d* (do not communicate directly) so as to delimit at least two inner disjoined plenum volumes 68,69.

In the configuration recommended by the invention, it is seen in FIGS. 22 and 33*a* that the physical air decontamination means 20,21,22,23 have an air intake 194,195,196 located at the foot end 197 of bed 191 and in its lower part 198. This arrangement improves the aeraulics of air movement and reduces turbulence. Air moves vertically over the bed, enters vertically under the bed via its two sides and is then channelled under the bed in direction of air intakes 194,195,196. The mobile chassis 12 of mobile aeraulic isolation device 1*c* and its decontamination means 20,21, 22,23 are arranged at the foot end 197 of bed 191. The second mobile rigid downstream plenum the furthest from chassis 12 is positioned at the head end 199 of bed 191.

FIG. 33*b* is a schematic diagram of a recommended example of configuration of physical decontamination means 20. Thy are contained inside a metal parallelepiped envelope 200. The air derived from foot end 197 of bed 191 enters via an air intake 194 fitted with a coarse disposable pre-filter 201. The coarse pre-filter 201 is intended to block large particles, "fluff", textile dust . . . which may be present under bed 191. The air then passes through an inlet noise muffler 202, then an electric fan 25, an outlet noise muffler 203 and finally through air sterilisation reactor 204 before reaching the outlet collar 205 which is connected to one of aeraulic lines 101 supplying one of the plenums.

Preferably, the invention recommends using a sterilisation reactor of the type described in patent U.S. Pat. No. 5,474,600 "apparatus for biological purification and filtration of air". Preferably a device for amplifying electrostatic fields will be used of the type described in French patent application FR 99 14899 and an ionic emission device of the type described in French patent application FR 00 16607.

FIGS. 28*a* to 28*f* describe the opening sequence of device 1*c* from its floor movement position M to its fixed in-use position U. FIG. 28*a* shows the device 1*c* in floor movement position M close to a hospital bed 191. FIG. 28*b* describes the opening along axis x,x' of horizontal portions 131, 136) of the two supporting arms 127,128 of chassis 12, the unlocking of means 171 maintaining plenums 5,6 in folded position relative to chassis 12, the forward horizontal movement of both plenums 5,6 via the two slide rails 14*a*, 14*b*. FIG. 28*c* shows unlocking of means 172 maintaining plenums in folded position then the rotation of upstream plenum 5 along axis 11*b* of pivots 19*a*, 19*b* as far as the stop position and locking of means 18 relative to chassis 12, and finally the rear positioning of decontamination means 21,22, 23. FIG. 28*d* shows the rotation of downstream plenum 6 along axis 11*a* of hinges 9*a*, 9*b*, hood raised to access handling means 175, as far as its locking into position by means 17 relative to the upstream plenum 5. FIG. 28*e*, plenums 5,6 reach their height of use U by unlocking the vertical translation of uprights 221*a*, 221*b* using pegs 226, the chassis handling means 176 facilitate adjustment at desired height then pegs 226 associated with holes 225 ensure the maintaining in in-use position. Finally, FIG. 28*f* shows the device 1*c* in in-use position U provided with channelling means 150 for airflow over an aeraulically decontaminated bed 190.

Subject and Industrial Applications of the Invention

On the basis of the described invention, the applicants have developed a mobile protective isolation device for immunocompromised and/or fragile persons called ImmunAIR™. This device is equipped with 4 physical decontamination means of the type described above. When in in-use position U, it can cover and protect a hospital bed with a size of: length 2.4 m, width: 1.05 m by means of a uniform sterilised vertical airflow at low speed 640 $m^3$/hour, i.e. approximately 210 sterilised air changes per hour within the 3 $m^3$ of isolator covering the bed. In the room of an immunocompromised patient occupying the bed, it can also generate a vertical airflow of 640 $m^3$/hour ensuring 25 sterilised air changes per hour in the room. It forms a "mobile sterile room" which can be set up or taken down in less than 10 minutes.

In folded floor movement position M, its vertical cross size is: width 0.760 m and height 1.98 m. So that the device can easily be passed through a doorway of standard size: width 0.8 m and height less than 2 m.

By means of the so-called PLASMER sterilisation technique described above, the aeraulic load loss is approximately 250 Pascals and the noise level is 43 DB. It ensures destruction of mycoses, bacteria, spores and viruses in the room.

Tests in hospital rooms, initially with massive contamination (>300 cfu/$m^3$ bacteria and 285 cfu/$m^3$ in fungi) have shown complete biodecontamination under the airflow for total flora (bacteria) and fungi in less than 20 minutes. Repeated measurements under the flow for several hours have shown stability over time of absolute decontamination at less than 1 cfu/$m^3$. In a room with average contamination (29 cfu/$m^3$ total flora and 38 cfu/$m^3$ fungi) room decontamination was ascertained (outside the flow) in less than 20 minutes to reach stabilised contamination values of less than 4 cfu/$m^3$ total flora and <2 cfu/$m^3$ fungi.

In a hospital environment, the device can substitute for laminar flow rooms for the protective isolation of weakened or immunosuppressed patients. It can also, for an investment that is approximately 4 times less and operating costs that are 5 to 10 times less, substitute for laminar flow clean rooms to provide protective isolation equipment in: district hospitals, clinics and functional rehabilitation centres for immunosuppressed patents. Finally it can be used for early home discharge of immunosuppressed or aplasic patients.

The applications of the protective isolation device of the invention firstly concern haematology departments for aeraulic protection of patients undergoing bone marrow homografts and in haemopathy cases leading to severe neutropaenia. In oncology departments, it is recommended for patients with solid tumours that are particularly unresponsive and require aggressive chemotherapy or extended high dose corticotherapy. It is of particular use in serious burns departments. Finally, it is recommended in intensive care units, in particular for patients undergoing immunosuppressive treatment for solid organ transplants and patients requiring transient intensive care subsequent to haemopathy with therapeutic aplasia.

In the entire above description, particular attention was focused on aseptic isolation of immunosuppressed patients. The airflow in this case is directed from the diffusers towards the area over the bed. It will easily be understood that the invention also adapts to septic isolation of contagious patients by reversing the direction of airflow.

Advantages of the Invention

One first advantage of the mobile aeraulic isolation device with variable geometry air diffuser and two mobile plenums according to the invention is that it can be used to form a mobile room with absolute sterility, that can be provisionally installed inside a patient's room and folded up into a size enabling it to pass through a standard doorway approximately 205 cm high and 80 cm wide, i.e. approximately 81 inches×31 inches. This means that the device of the invention can be used for home medical care, especially to treat immunosuppressed patients at home.

A second advantage of the device of the invention is that the effective width of the plenums it uses is not limited by the width of doors through which it must pass through. So that the volume of protection surrounding the patient is not itself limited. This is beneficial to patient comfort and protection.

A third advantage of the device of the invention is that it leaves the head of the patient's bed entirely free and in no way hinders the positioning of medical technical equipment placed at the top of the bed (monitoring devices, resuscitation devices, gas outlets . . . )

A fourth advantage of the device is that it provides greater stability when in use.

A fifth advantage of the device is that its mobile geometry can offset displacement of the centre of gravity to the free end of the device when the two plenums are joined in in-use position, to increase its stability.

A sixth advantage of the device is that by means of its mobile accessory curtains it can improve air pressure over the bed and accelerate evacuation of parasite contamination. They stop the penetration into the sensitive bed area of Pflügge droplets emitted by visitors or attending staff when speaking, coughing or sneezing. They facilitate visitor and personnel accesses to the bedside of highly immunosuppressed patients.

A seventh advantage of the device is that its aeraulic design makes it less noisy and less energy-consuming.

An eight advantage is to enable mobility through any doorway or window and hence great adaptability from one hospital room to another and/or from one hospitalised patient's home to another. So that it ensures greater capacity of use and better amortization of operational costs.

A ninth and chief advantage of the invention is that, in closed floor movement position, the size of the device is much smaller than that of devices of the prior art which can cover and protect a bed. This provides better mobility.

The scope of the invention is to be considered more in relation to the following claims and their legal equivalents than to the examples given above.

The invention claimed is:

1. Mobile aeraulic isolation device (1*a*, 1*b*, 1*c*) with variable geometry, multi-block air diffusion chamber (4), to protect a sensitive area such as a bed (2) against contaminating airborne aerosols (3), this isolation device (1) being of the type made up of:

an air diffusion chamber (4), formed of at least two rigid air diffusing plenums (5,6), mechanically connected together so as to be mobile relative to one another, each of the two rigid plenums (5,6) being delimited by an outer envelope (5*a*, 6*a*, )

of substantially parallelepiped shape with rectangular cross-section (5*b*, 6*b*), having an air diffusing lower surface (7,8) substantially planar and porous to air, to enable diffusion of air through it, provided, at least at one first contact end (5*c*, 6*c*) with a first free end contacting surface (5*e*, 6*e*) substantially perpendicular to the corresponding diffusing surface (7,8) surrounded by a so-called intermediate ring joint plane (5*d*, 6*d*) of substantially identical size and geometry for both rigid plenums (5,6), relative movement means (10) for at least one first mobile plenum (5) relative to the other second mobile plenum (6), so that they can be positioned one relative to the other in at least two different relative positions including:

a so-called open relative position (OP) in which the first diffusing surface (7) of the first mobile plenum (5) is substantially coplanar and abutting substantially in the extension of the second diffusing surface (8) of the second mobile plenum (6), and the intermediate ring joint planes (5*d*, 6*d*) of the mobile plenums are distant from one another and uncoupled, at least one physical decontamination means (20,21, 22,23) for moving air passing through it, at least one means of air pressurization (25)

aeraulic connection (30) and air circulation means, (20,21,22,23) and a second free intake surface (5*f*) of at least one (5) of the two rigid plenums (5,6) of the air distribution chamber (4), forcing the airflow (F) to pass through their porous air diffusing surface (7,8) when the latter are in relative open position (OP) and hermetically coupled, a mobile supporting chassis (12), relative to the mobile supporting chassis (12), so that its first (5) and second (6) air diffusing rigid plenums (6) are mobile both relative to one another and relative to the chassis (12), mechanically connected to the two rigid plenums (5,6) of the air diffusion chamber (4), to physical air decontamination means (20,21,22,23), to air pressurizing mean (25) and to aeraulic connection (30), and fitted with horizontal movement means (40) for the chassis relative to the floor; this said mobile isolation device (1*a*, 1*b*, 1*c*) being characterized in that in addition:

it comprises at least one complementary means of absolute movement (13) for the group of two rigid plenums (5,6) relative to mobile supporting chassis (12), so that it first (5) and second (6) air diffusing rigid plenums (6) are mobile both relative to one another and relative to the chassis (12).

2. Mobile aeraulic isolation device (1*a*, 1*b*, 1*c*) with two rigid plenums (5,6) mobile in relation to chassis (12) according to claim 1, characterised in that in addition the combined movements of the plenums (5,6) via the relative movement means (10) and absolute movement means (13) enable the mobile plenums (5,6) to be positioned in at least two positions vis-á-vis the chassis (12):

one is a so-called fixed in-use position (U) regarding the sensitive area (2) in which:

the two plenums (5,6) are placed in open relative group position (OP) via the relative movement means (10) so that the first diffusing surface (7) of the first mobile plenum (5) is substantially coplanar and abutting substantially in the extension of the second diffusing surface (8) of the second mobile plenum (6), and the intermediate joint planes (105,106) of the mobile plenums are immediately adjacent so that the mobile plenums (5,6) are coupled, and the group of two plenums (5,6) in relative open position (OP) is brought into absolute distanced position (AV) relative to chassis (12) via the absolute movement means (13) so that the first mobile diffusing surface (8) of the first mobile plenum (5) and the second mobile diffusing surface (7) of the second mobile plenum (6) are horizontal and are positioned facing the floor (15) and away from it so as to diffuse the airflow (F) passing through them in a substantially vertical air direction (zz') covering the sensitive area (2), and so that the projection surface (PU1) over floor (15) of the first mobile diffusing surface and the projection surface (PU2) over floor (15) of the second mobile diffusing surface (8) have a maximum size (LU2,LU1), and the other is a so-called floor (15) movement position (M), in which the two plenums (5,6) are placed in closed relative group position (CL) via relative movement means (10) so that the first diffusing surface (7) of the first mobile plenum (5) does not lie in the extension of the diffusing surface (8) of second mobile plenum (6) and the intermediate joint planes (105,106) of the mobile plenums are distanced from one another and uncoupled, and the group of two plenums in relative closed position (CL) is brought into absolute recessed position (RE) relative to chassis (12) via the absolute movement means (13), so that the floor projection surface (PM1) of the first mobile diffusing surface (7) of the first mobile plenum (5) and the floor projection surface (PM2) of the second mobile diffusing surface (8) of the second mobile plenum (6) have a minimum size (LM1,LM2) both much smaller than their maximum sizes LU2,LU1.

3. Mobile aeraulic isolation device (1*c*) according to claim 2, characterised in that in addition its aeraulic connection means (30) have modified geometry (GU,GM) when plenums (5,6) are extended between their movement position (M) and their in-use position (U).

4. Mobile aeraulic isolation device (1*a*, 1*b*, 1*c*, ) with two mobile rigid plenums (5,6) according to claim 1, characterised in combination so that in addition:

firstly, its relative movement means (10) for rigid plenums (5,6) ensure relative movement of both rigid plenums (5,6) relative to one another in at least two distinct relative positions, including:

one so-called open relative position (OP) in which the first diffusing surface (7) of the first mobile plenum (5) is substantially coplanar and abuts the second diffusing surface (8) of the second mobile plenum (6), the other so-called closed relative position (CL), in which the first diffusing surface (7) of the first mobile plenum (5) is substantially opposite the second diffusing surface (8) of the second mobile plenum (6), and secondly, the relative movement means (10) of plenums (5,6) are mobile relative to chassis (12) via the complementary means of absolute movement (13) for the group of two rigid plenums (5,6).

5. Mobile aeraulic isolation device (1*b*, 1*c*) with two mobile rigid plenums (5,6) according to claim 4, characterised in combination in that in addition:

firstly, the relative movement means (10) of rigid plenums (5,6) ensure a relative movement of both rigid plenums (5,6) relative to one another in at least two distinct relative positions, including:

one so-called open relative position (OP) in which the first diffusing surface (7) of the first mobile plenum (5) is substantially coplanar and abuts the second diffusing surface (8) of the second mobile plenum (6), the other so-called closed relative position (CL) in which the outer surface (7*a*) of the first diffusing surface (7) of the first mobile plenum (5) and the outer surface (8*a*) of the second diffusing surface (8) of the second mobile plenum (6) are face to face, and secondly, the relative movement means (10) of plenums (5,6) are mobile relative to chassis (12) via complementary absolute movement means (13) for the group of two rigid plenums (5,6).

6. Mobile aeraulic isolation device (1*a*) with two mobile rigid plenums (5,6) according to claim 4, characterised in combination in that in addition:

firstly, the relative movement means (10) of rigid plenums (5,6) ensure relative movement of both rigid plenums (5,6) relative to one another in at least two distinct relative positions, including:

one so-called open relative position (OP) in which the first diffusing surface (7) of the first mobile plenum (5) is substantially coplanar and abuts the second diffusing surface (8) of the second mobile plenum (6), and the other so-called closed relative position (CL) in which the outer (7*a*) and inner (7*b*) surface of the first diffusing surface (7) of the first mobile plenum (5) and the outer (8*a*) and inner (8*b*) surfaces of the second diffusing surface (8) of the second mobile plenum (6) are alternated, and secondly, the relative movement means (10) of plenums (5,6) are mobile relative to chassis (12) via complementary absolute movement means (13) for the group of two rigid plenums (5,6).

7. Mobile aeraulic isolation device (1*b*) with two mobile plenums (5,6) according to claim 1, of the type whose relative movement means (10) for plenums (5,6) are formed by a relative rotation axis (11*a*) and characterised in that:

its relative rotation axis (11*a*) of mobile plenums (5,6) is itself mobile relative to mobile supporting chassis (12) via complementary absolute movement means (13) for the group of two plenums (5,6).

8. Mobile aeraulic isolation device (1*a*) with two mobile plenums (5,6), according to claim 1, and characterised in that:

its relative movement means (10) for plenums (5,6) are formed by drawer-type sliding means (11*c*) for envelope (5*b*) of the second mobile plenum (6) inside the envelope (5*a*) of the first mobile plenum (5).

9. Mobile aeraulic isolation device (1*a*) with two mobile plenums (5,6) according to claim 8, characterised in that, in addition, its complementary sealed closing means (300) of the first free contact surface (5*e*) positioned at the first contact end (5*c*) of the first rigid plenum (5) are formed by:

a second closing ring joint plane (6*g*) surrounding a second closed end surface (6*f*) of the second mobile plenum (6), pinned in sealed manner against a second closing ring joint plane (5*g*) surrounding the first free end contacting surface (5*e*) positioned at the first contact end (5*c*) of envelope (5*a*) of the first rigid plenum (5), during the time when the two mobile plenums (5,6) are in closed relative position (CL) in which the second plenum (6) is fitted drawer fashion inside the body of the first plenum (5) and the intermediate ring joint planes (105,106) of the plenums are distanced from one another and uncoupled.

10. Mobile aeraulic isolation device (1*a*) with two mobile plenums (5,6) according to previous claim 1, characterised in that in addition:

it comprises complementary means for sealed closing (300) of the first free contact surface (5*e*) positioned at the first contact end (5*c*) of the first rigid plenum (5) when both rigid plenums (5,6) are in relative closed position (CL), in which the first diffusing surface (7) of the first mobile plenum (5) does not lie in the extension of diffusing surface (8) of the second mobile plenum (6), and the intermediate joint planes (5*d*, 6*d*) of mobile plenums (5,6) are distanced from one another and uncoupled.

11. Mobile aeraulic isolation device (1*c*) with two mobile plenums (5,6) according to claim 1, characterised in that, in addition, its complementary absolute movement means (13) for the group of two plenums (5,6) relative to mobile supporting chassis (12) is formed by horizontal sliding means (13, 14*a*, 14*b*, 19*a*, 19*b*) of said axis of relative rotation (11*a*) of rigid plenums (5,6) relative to frame (12).

12. Mobile aeraulic isolation device (11*c*) with two mobile plenums (5,6), according to claim 11, characterised in that in addition:

its horizontal sliding means (13,14*a*, 14*b*, 19*a*, 19*b*) of said axis of relative rotation (11*a*, 11*b*) of rigid plenums (5,6) relative to chassis (12) comprise two extreme sliding positions:

an in-use position (U) in which:

the first mobile diffusing surface (7) of the first plenum (5) and second diffusing surface (8) of the second plenum (6) are horizontal, and the axis (axes) of relative rotation (11*a*, 11*b*) of rigid plenums (5,6) is (are) in so-called forward position away from the so-called rear portion (16) of chassis (12) and the closest to the centre of the sensitive area (2), and a floor (15) movement position (M) in which the first mobile diffusing surface (7) of the first mobile plenum (5) is facing and opposite the second mobile diffusing surface (8) of the second mobile plenum (6), and the rotation axis (axes) (11*a*, 11*b*) of the rigid plenums is (are) in so-called back position closed to the so-called rear portion (16) of chassis (12).

13. Mobile aeraulic isolation device (1*c*) with two mobile plenums (5,6) according to preceding claim 1, characterised in that in addition:

it comprises a mobile, releasable relative interlocking means (17,305,306) for rigid plenums (5,6) in their relative movement, formed of interlocking elements (305*a*, 305*b*, 306*a*, 306*b*) integral with plenums (5,6) and ensuring their locking in open relative position (OP) so that mobile plenums (5,6) are rigidly and hermetically coupled and their first and second diffusing surfaces (7,8) are coplanar, and enabling their unlocking for placing in closed position (CL), the different interlocking elements (305*a*, 305*b*, 306*a*, 306*b*) of this mobile, releasable, relative interlocking means (17) for plenums (5,6) are integral with plenums (5,6) and fully mobile relative to mobile supporting chassis (12) via relative movement means (10) and complementary absolute movement means (13).

14. Mobile aeraulic isolation device (1*a*) with two mobile plenums (5,6) according to preceding claim 1 charaterised in that in addition:

it comprises gravity effect compensation means (301) (jacks in particular) to offset the weight of the plenums in their movement relative to the chassis, these gravity effect compensation means (301) being integral both with one of the two mobile plenums (5) and with the supporting chassis (12).

15. Mobile aeraulic isolation device according to claim 1, charterised in that in addition in combination:

the first (5) and the second (6) air diffusing rigid plenums are each formed of a group (G1,G2) of at least one closed diffusing caisson (71,72,73) for air distribution, each closed diffusing caisson (71,72,73) has:

a so-called diffusing surface (SD0,SD1,SD2) closed by a wall in diffusing material (80,81, 82) porous to air, and another so-called supply surface (SA0,SA1,SA2) is provided with at least one nozzle (90,91,92) for air passage, and the other (side) surfaces (SL0,SL1,SL2) are solid, the diffusing caisson(s) (71) of the first rigid plenum (5) are mobile relative to the supporting chassis (12) via absolute movement means (13), caisson(s) (71,72) of the second rigid plenum (6) via relative movement means (10)

the diffusing caisson(s) (72,73) of the second rigid plenum are mobile relative to:

supporting chassis (12) via absolute movement means (13)

and caisson(s) (71) of the first rigid plenum (5) via relative movement means (10).

16. Mobile aeraulic isolation device (1*a*) according to claim 1, characterised in that in addition it comprises physical decontamination means (20,21,22,23) positioned opposite a second free intake surface (5*f*) of at least one (5) of the two rigid plenums (5,6).

17. Mobile aeraulic isolation device (1*a*) according to preceding claim 16, characterised in that in addition its physical decontamination means (20,21,22,23) are positioned in a decontamination caisson (302) opposite a second free intake surface (5f) of the first rigid plenum (5) and mechanically integral with and hermetically connected to the second corresponding free end of envelope (5*a*) of first rigid plenum (5) so that the physical decontamination means (20,21,22,23) are mobile relative to chassis (12) via complementary absolute movement means (13) of the group of two plenums (5, 6).

18. Mobile aeraulic isolation device (1*c*) according to claim 1, characterised in that in addition it comprises horizontal movement means (121) for one or more physical decontamination means (20,21,22,23) relative to supporting chassis (12).

19. Mobile aeraulic isolation device (1*c*) according to claim 18, characterised in that in addition it comprises horizontal movement means (121) for one or more physical decontamination means (20,21,22,23) relative to supporting chassis (12) formed by at least one slide rail (122,123).

20. Mobile aeraulic isolation device (1*c*) according to claim 18, characterized in the in addition it comprises horizontal movement means (121) for one or more physical decontamination means (20,21,22,23) relative to supporting chassis (12) having two extreme positions:

an in-use position (U) in which the physical decontamination means (20,21,22,23) are recessed relative to the centre of gravity (CU) of the mobile isolation device (1*c*), a movement position (M) in which the physical decontamination means (20,21,22,23) are brought forward in direction of the centre of gravity (CM) of the mobile isolation device (1*c*).

21. Mobile aeraulic isolation device (1*a*, 1*b*, 1*c*) according to claim 1, in which mobile supporting chassis (12) comprises a lower mobile trolley in the shape of a fork (126) formed of at least two horizontal, parallel supporting arms (127,128) distanced from one another, characterised in that in addition the supporting arms (127,128) of chassis 12 are made up of several horizontal portions (131,132,133,134, 135,136) connected together and mobile relative to one another.

22. Mobile aeraulic isolation device according to claim 21, characterised in that in addition its lower mobile trolley (125) in fork shape (126) comprises supporting arms (127, 128) each formed of several horizontal portions (131,132, 133,134,135,136) connected together and which slide relative to one another along a horizontal axis (Ag1,Ag2).

23. Mobile aeraulic isolation device (1*c*) according to claim 21, characterised in that in addition its lower mobile trolley (125) in fork shape (126) comprises two arms (127, 128) each formed of several horizontal portions (131, 132, 133, 134,135,136) connected together and which pivot in relation to one another along a vertical rotation axis (Ah1, Ah2).

24. Mobile protective aeraulic isolation device (1*a*, 1*b*, 1*c*) according to claim 21, characterised in that in addition its lower mobile trolley (125) in fork shape (126) comprises two arms (127,128) each formed of several horizontal portions (131,132,133,134,135,136) connected together and which pivot in relation to one another along a horizontal rotation axis (Aj1,Aj2).

25. Mobile aeraulic isolation device (1*a*, 1*b*, 1*c*) according to claim 21, characterised in that in addition its lower mobile trolley (125) in fork shape (126) comprises arms (127,128) of which each of horizontal portions (131, 132, 133,134,135,136) mobile relative to one another comprises at least one caster (141,142,143,144,145,146) with a horizontal rotation axis (Ir).

26. Mobile aeraulic isolation device (1*a*, 1*b*, 1*c*), according to claim 1, comprising vertical channelling means (150) for airflow in in-use position (U) comprising curtain(s) (151,152,153,154,155,156)) surrounding the base of diffusing surfaces (7,8) of plenums (5,6), this device being characterised in that:

each of curtain(s) (151,152,153,154,155,156) are mobile both relative to chassis (12) during absolute movement of the group of plenums (5,6) in relation to chassis (12) between a recessed position (RE) and distanced position (AV), and mobile relative to the opposite mobile plenum (5,6) during relative movement between closed position (CL) and open position (OP) of plenums (5,6).

27. Mobile aeraulic isolation device (1*c*) according to claim 26, comprising vertical channelling means (150) for airflow in in-use position (U), this device being characterised in that its vertical channelling means (150) for the airflow are formed by at least one of curtain(s) (151,152, 153,154,155,156) with winder(s) (161, 162, 163, 164, 165, 166) whose winder axis (axes) (er1,er2,er3,er4,er5,er6) are located in the lower part (167) and on the periphery (P) of diffusing surfaces (7,8) of plenums (5,6).

28. Mobile aeraulic isolation device (1*b*) according to claim 26, comprising vertical channelling means (150) for the airflow in in-use position (U), this device being characterised in that its vertical channelling means (150) for the airflow are formed of at least two curtains (151,152) sliding on at least two rails (308,309) positioned in the lower part (167) and on the periphery (P) of diffusing surfaces (7,8) of air diffusing plenums (5,6); these rails (308,309) being formed of at least one first rail portion (308) integral with the first plenum (5) and a second rail portion (309) integral with the second plenum (6) so that the two rail portions (308,309) are mobile relative to one another via relative movement means (10) and are both mobile relative to chassis (12) via complementary absolute movement means (13) of the group of two plenums (5,6).

29. Mobile aeraulic isolation device (1*a*) according to claim 26, comprising vertical channelling means (150) for the airflow in in-use position (U), this device being characterised in that its vertical channelling means (150) for the airflow are formed of at least two curtains (151,152) fixed on linear hanging supports (310,311) positioned in the lower part (167) and on the periphery (P) of diffusing surfaces (7,8) of air diffusing plenums (5,6); these linear hanging supports (310,311) being formed of at least one first linear support portion (310) integral with first plenum (5) and a second linear support portion (311) integral with second plenum (6) so that the two linear support portions (310,311) are mobile both relative to one another via relative movements means (10) and both are mobile relative to chassis (12) via complementary absolute movement means (13) of the group of two plenums (5,6).

30. Mobile aeraulic isolation device (1*c*) according to claim 26, characterised in that in addition at least some of its channelling curtain(s) (155,156) comprise a plurality of parallel joining strips (171,172,173).

31. Mobile aeraulic isolation device (1*a*) according to claim 26 characterised in that in addition at least some of its channelling curtain(s) (155,156), in particular those positioned on the second plenum distanced from the chassis (12) in open position (OP) comprise at least one portal hole for passing utilities (312).

32. Mobile aeraulic isolation device (1*c*) according to claim 26, comprising vertical channelling means (150) for the airflow, this device (1) being characterised in that it also comprises in combination:

detection means (detecting movement of persons and/or increase in contamination) activation mean for the level of physical vertical channelling means (150) of airflow in relation to the measurement made by the detection means.

33. Mobile aeraulic isolation device (1*a*) according to claim 1 whose air pressurising means (25) and aeraulic connection (30) and air circulation means are positioned inside a vertical column (331) of chassis (12) and characterised in that they comprise an air intake positioned substantially horizontally underneath and in the lower part (198) of aeraulic connection column (331) of chassis (12) opposite the plane of the sensitive area (2) (floor (15) in particular).

34. Mobile aeraulic isolation device (1*a*) according to claim 1, whose air pressurising means (25) and aeraulic connection (30) and air circulation means are positioned inside a vertical post (341) of chassis (12) and also comprise muffling means (313) for noise conveyed by air and produced by the air pressurising means (25), said mobile aeraulic isolation device (1) being characterised in that its noise muffling means (313) are positioned inside vertical post (314) of chassis (12).

35. Mobile aeraulic isolation device according to claim 34 characterised in that its muffling means (313) for noise conveyed by air are formed of two groups of dampening elements (313*a*, 313*b*) positioned inside a vertical post (314) of chassis (12) of which one (313*a*) is positioned upstream and the other (313*b*) is positioned downstream from air pressurising means (25).

36. Mobile aeraulic isolation device (1*a*) according to claim 35 characterised in that its muffling means (313) for noise conveyed by air are formed of:

a head group of muffling elements (313*a*) positioned ahead of air pressurizing means (25) and formed by at least one panel (316*a*) of sound absorbing material arranged horizontally, a tail group of muffling elements (313*b*) positioned below air pressurizing means (25) formed of a plurality of panels (316*a*) made of sound absorbing material, arranged vertically and distanced from one another inside vertical post (314) of chassis (12).

37. Mobile aeraulic isolation device (1*a*) according to claim 34, characterised in that its muffling means (313) for noise conveyed by air are formed of panels (316) made of sound absorbing material.

38. Mobile aeraulic isolation device (1*a*) according to claim 1, characterised in that this lower air diffusing surface (7,8) substantially planar and porous to air of each of mobile plenums (5,6) relative to chassis (12), is made up of a plurality of panels (318) (substantially rectangular) in plastic material (epoxy glass in particular) pierced with a multitude of uniformly distributed cylindrical holes.

39. Mobile aeraulic isolation device (1*a*) according to claim 38, characterised in that the lower air diffusing surface (7,8) in plastic material of both plenums (5,6) is made up of a combination between:

two frames (319*a*, 319*b*) mobile in relation to chassis (12) substantially rectangular connected to outer envelope (5*a*, 6*a*) of the two plenums (5,6) and provided with a multitude of cross braces (320*a*, 320*b*), and a plurality of (substantially rectangular) panels (318) in plastic material (epoxy glass in particular) pierced with a multitude of uniformly distributed cylindrical holes, placed edge to edge and screwed around their periphery to cross braces (320*a*, 320*b*).

40. Aeraulically decontaminated bed (190) formed of a combination between:

a bed (191), and a mobile aeraulic isolation device (1*a*, 1*b*,1*c*) according to claim 1, mounted on a chassis (12) and whose air diffuser (4) comprises at least two mobile rigid air diffusion plenums (5,6)mechanically connected together, in a horizontal open relative position (OP) in which the first diffusing surface (7) of the first mobile plenum (5) is substantially coplanar and abutting substantially in the extension of the second diffusing surface (8) of the second mobile plenum (6) and whose group of plenums (5,6) is in an absolute distanced position (AV) relative to chassis (12) via absolute movement means (13) so that the projection surface of the two plenums substantially covers the surface of a bed, said aeraulically decontaminated bed (191) being characterised in that:

its rigid plenums (5,6) are mobile relative to one another and both are mobile relative to chassis (12) of the mobile aeraulic isolation device (1*a*, 1*b*, 1*c*).

41. Aeraulically decontaminated bed (190) according to claim 40 characterised in that:

the mobile chassis (12) of the mobile aeraulic isolation device (1) and its decontamination means (20,21,22,23) are placed at the foot of the bed, the second mobile rigid air-diffusing plenum (6) the furthest from chassis (12) is placed at the side of the head of the bed (191).

* * * * *